US012076632B1

(12) United States Patent
Joseph

(10) Patent No.: US 12,076,632 B1
(45) Date of Patent: Sep. 3, 2024

(54) BASKETBALL LAUNCHING DEVICE

(71) Applicant: Shoot-A-Way, Inc., Upper Sandusky, OH (US)

(72) Inventor: John G. Joseph, Upper Sandusky, OH (US)

(73) Assignee: Shoot-A-Way, Inc., Upper Sandusky, OH (US)

( * ) Notice: Subject to any disclaimer, the term of this patent is extended or adjusted under 35 U.S.C. 154(b) by 0 days.

(21) Appl. No.: 17/238,930

(22) Filed: Apr. 23, 2021

Related U.S. Application Data

(60) Provisional application No. 63/142,570, filed on Jan. 28, 2021, provisional application No. 63/014,765, filed on Apr. 24, 2020.

(51) Int. Cl.
*A63B 69/40* (2006.01)
*A63B 63/00* (2006.01)
(Continued)

(52) U.S. Cl.
CPC ..... *A63B 69/408* (2013.01); *A63B 63/083* (2013.01); *A63B 69/0071* (2013.01);
(Continued)

(58) Field of Classification Search
CPC ..... A63B 63/083; A63B 71/0622; A63B 2063/001; A63B 2071/0675; A63B 69/406; A63B 69/0071; A63B 69/408
See application file for complete search history.

(56) References Cited

U.S. PATENT DOCUMENTS 435,964 A 9/1890 Compton
1,223,386 A 4/1917 Handelan
(Continued)

FOREIGN PATENT DOCUMENTS

CN 303127130 3/2015
CN 303207615 5/2015
(Continued)

OTHER PUBLICATIONS

The Gun 6000 Series, Shoot-A-Way, Inc. Upper Sandusky, Ohio, http://www.shootaway.com/Gun1.htm/, at least as early as Jun. 2000.

(Continued)

*Primary Examiner* — Melba Bumgarner
*Assistant Examiner* — Amir A Klayman
(74) *Attorney, Agent, or Firm* — Standley Law Group LLP; Jeffrey S. Standley; Adam J. Smith

(57) ABSTRACT

A throwing mechanism is provided. A basketball holder is located at a first portion of a catapult arm at a first side of a pivot, and a spring is attached to a second portion of said catapult arm located at a second side of the pivot. A motor is cycled to cause a ram mounted to one or more linkages connected to the motor to contact the second portion of said catapult arm for pivoting the catapult arm into a second position where the first portion is secured by an engagement arm located rearward of the catapult arm, and subsequently contact the engagement arm to release the catapult arm for pivoting movement into a first position by forces exerted by the spring to launch the basketball located at the first portion of said catapult arm.

16 Claims, 38 Drawing Sheets

(51) Int. Cl.
*A63B 63/08* (2006.01)
*A63B 69/00* (2006.01)
*A63B 71/06* (2006.01)

(52) U.S. Cl.
CPC .... *A63B 71/0622* (2013.01); *A63B 2063/001* (2013.01); *A63B 2071/0675* (2013.01)

(56) References Cited

U.S. PATENT DOCUMENTS 1,344,378 A 6/1920 Ward
2,153,315 A 4/1939 Richter
2,650,585 A * 9/1953 Farre, Jr. ..... A63B 69/408 124/36
2,655,908 A * 10/1953 Calleo ..... A63B 69/408 124/41.1
2,696,204 A * 12/1954 Gilgoff ..... A63B 69/408 124/50
D174,027 S 2/1955 Farkas
2,815,743 A * 12/1957 Brunderman ..... A63B 69/408 221/175
2,908,266 A 10/1959 Cooper
D204,309 S 4/1966 Murray
3,272,194 A * 9/1966 Egbert ..... A63B 69/408 74/2
3,406,674 A * 10/1968 Zone ..... A63B 69/408 124/36
3,776,550 A 12/1973 McNabb
3,777,733 A * 12/1973 Mitchell ..... F41B 3/03 124/16
3,802,703 A 4/1974 Van Tassel
3,878,828 A 4/1975 Francesco
3,977,386 A * 8/1976 Meyer ..... F41B 3/03 124/40
4,004,567 A 1/1977 Henderson
4,082,076 A 4/1978 Perry
4,168,695 A * 9/1979 Haller ..... A63B 69/408 124/16
4,262,648 A 4/1981 Wegener et al.
4,269,162 A * 5/1981 Abraham ..... A63B 69/408 221/200
4,269,163 A 5/1981 Feith
4,391,264 A * 7/1983 Abraham ..... A63B 69/408 124/36
4,471,746 A 9/1984 Ando
4,579,340 A 4/1986 Jenkins et al.
4,611,571 A * 9/1986 Tressler ..... A63B 69/408 124/7
D287,854 S 1/1987 Crews
4,667,957 A 5/1987 Joseph
4,678,189 A 7/1987 Koss
4,699,378 A * 10/1987 Sung ..... A63B 69/408 124/41.1
4,714,248 A 12/1987 Koss
4,717,149 A 1/1988 Juhl
4,913,431 A 4/1990 Jakobs
4,936,577 A 6/1990 Kington et al.
4,940,231 A 7/1990 Ehler
4,955,605 A 9/1990 Goldfarb
4,995,371 A * 2/1991 Kuizinas ..... A63B 69/40 124/36
5,016,875 A 5/1991 Joseph
5,039,977 A 8/1991 Mele et al.
5,121,735 A 6/1992 Hancock
5,125,651 A 6/1992 Keeling et al.
5,312,099 A 5/1994 Oliver, Sr.
5,342,041 A 8/1994 Aguinek et al.
5,365,427 A 11/1994 Soignet et al.
5,393,049 A 2/1995 Nelson
5,409,211 A 4/1995 Adamek
5,417,196 A 5/1995 Morrison et al.
5,450,540 A 9/1995 Spohrer et al.
5,540,428 A 7/1996 Joseph
5,562,282 A * 10/1996 Stevenson ..... A63B 69/407 124/16
5,619,977 A * 4/1997 Gatin ..... A63B 69/408 124/16
5,647,747 A 7/1997 Macri et al.
5,676,120 A * 10/1997 Joseph ..... A63B 69/40 124/32
5,681,230 A 10/1997 Krings
5,746,668 A 5/1998 Ochs
5,749,797 A * 5/1998 Sunseri ..... A63B 69/407 124/16
5,768,151 A 6/1998 Lowy et al.
5,776,018 A 7/1998 Simpson et al.
5,782,639 A 7/1998 Beal
5,813,926 A 9/1998 Vance
5,816,953 A 10/1998 Cleveland
5,842,699 A 12/1998 Mirando et al.
5,911,214 A * 6/1999 Andrews ..... A63B 69/408 124/16
5,975,527 A * 11/1999 Winchester ..... A63B 69/408 124/36
6,089,215 A * 7/2000 Morris ..... A63B 69/408 124/16
6,224,503 B1 * 5/2001 Joseph ..... A63B 69/40 473/436
6,237,583 B1 5/2001 Ripley
6,241,628 B1 6/2001 Jenkins
D445,426 S 7/2001 Wang et al.
6,280,352 B1 8/2001 Coffeen et al.
6,389,368 B1 5/2002 Hampton
6,659,893 B1 12/2003 Campbell et al.
6,707,487 B1 3/2004 Aman et al.
6,715,478 B1 * 4/2004 Tanner ..... A63B 69/408 124/16
6,731,316 B2 5/2004 Herigstad et al.
6,746,397 B2 6/2004 Lee et al.
6,918,591 B2 7/2005 D'Amico et al.
7,094,164 B2 8/2006 Marty et al.
D554,661 S 11/2007 Hoover et al.
D554,662 S 11/2007 Hoover et al.
7,445,003 B2 * 11/2008 Smith ..... A63B 69/406 124/78
D591,305 S 4/2009 Shimoda
7,620,466 B2 11/2009 Neale et al.
7,628,147 B2 * 12/2009 Estalella ..... A63B 69/407 124/16
7,780,573 B1 8/2010 Carmein
7,802,699 B1 9/2010 Hoy
7,850,552 B2 12/2010 Marty et al.
7,854,669 B2 12/2010 Marty et al.
7,927,237 B2 4/2011 Jenkins et al.
D637,199 S 5/2011 Brinda et al.
7,938,746 B2 5/2011 Chipperfield
8,012,046 B2 9/2011 Campbell et al.
8,016,687 B2 9/2011 Martin et al.
8,123,634 B1 2/2012 Lovett
8,147,356 B2 4/2012 Campbell et al.
8,206,246 B2 6/2012 Joseph et al.
8,261,729 B2 * 9/2012 Laszlo ..... A63B 69/0017 124/78
8,286,619 B2 * 10/2012 Mihaljevic ..... A63B 69/408 124/16
8,408,982 B2 4/2013 Marty et al.
8,409,024 B2 4/2013 Marty et al.
D681,662 S 5/2013 Fletcher et al.
D687,845 S 8/2013 Lee
8,540,560 B2 9/2013 Crowley et al.
D690,728 S 10/2013 Brinda
8,579,632 B2 11/2013 Crowley
8,617,008 B2 12/2013 Marty et al.
8,622,832 B2 1/2014 Marty et al.
D704,734 S 5/2014 Wafapoor
8,727,784 B1 5/2014 Wolf
D714,321 S 9/2014 Pereira
D714,325 S 9/2014 Pereira
8,852,030 B2 10/2014 Campbell et al.
8,854,457 B2 10/2014 De Vleeschouwer et al.
8,908,922 B2 12/2014 Marty et al.

(56) References Cited

U.S. PATENT DOCUMENTS 8,948,457 B2 2/2015 Marty et al.
9,010,309 B2 4/2015 Lewis et al.
9,015,627 B2 4/2015 La
9,017,188 B2 4/2015 Joseph et al.
D729,488 S 5/2015 Pulskamp et al.
9,086,257 B2 7/2015 Aporte et al.
D737,278 S 8/2015 Shin et al.
D739,488 S 9/2015 Campbell et al.
D745,533 S 12/2015 Luo
D746,855 S 1/2016 Choi
9,233,292 B2 1/2016 Joseph et al.
9,238,164 B2 1/2016 Perry, Jr.
9,238,165 B2 1/2016 Marty et al.
9,248,368 B2 2/2016 Stimac
9,254,432 B2 2/2016 Tanni et al.
9,283,431 B2 3/2016 Marty et al.
9,283,432 B2 3/2016 Marty et al.
9,345,929 B2 5/2016 Marty et al.
9,358,455 B2 6/2016 Marty et al.
9,370,704 B2 6/2016 Marty
D760,769 S 7/2016 Ishii et al.
D761,840 S 7/2016 Patterson et al.
9,390,501 B2 7/2016 Marty et al.
D762,709 S 8/2016 Hsieh
D767,596 S 9/2016 Shi
9,452,339 B1 9/2016 Shah et al.
D768,143 S 10/2016 Drozd et al.
D768,148 S 10/2016 Jung et al.
9,474,953 B1 10/2016 Duke
D774,518 S 12/2016 Lv
D776,676 S 1/2017 Shi
D778,314 S 2/2017 Li et al.
D783,659 S 4/2017 Park
D786,269 S 5/2017 Lin et al.
D789,393 S 6/2017 Jaini et al.
D790,585 S 6/2017 Kim et al.
9,687,713 B1 6/2017 Duke
D791,786 S 7/2017 Chauhri et al.
9,694,238 B2 7/2017 Marty et al.
9,697,617 B2 7/2017 Marty et al.
9,724,584 B1 8/2017 Campbell et al.
9,734,405 B2 8/2017 Marty et al.
9,808,696 B2 * 11/2017 Campbell ..... A63B 71/0616
D808,976 S 1/2018 Shi
9,886,624 B1 2/2018 Marty et al.
9,914,035 B2 3/2018 Campbell et al.
D817,348 S 5/2018 Ishikawa et al.
D818,488 S 5/2018 Frazier
9,975,026 B2 5/2018 Campbell et al.
10,004,949 B2 6/2018 Brothers et al.
10,010,778 B2 7/2018 Marty et al.
D824,955 S 8/2018 Lee et al.
10,092,793 B1 10/2018 Marty et al.
D838,729 S 1/2019 Guerrieri et al.
10,252,133 B2 4/2019 Campbell et al.
10,315,090 B2 6/2019 Campbell et al.
10,343,015 B2 7/2019 Marty et al.
10,360,685 B2 7/2019 Marty et al.
D861,720 S 10/2019 Koller et al.
10,471,325 B2 11/2019 Marty et al.
10,537,780 B2 1/2020 Joseph et al.
10,561,916 B1 2/2020 Campbell et al.
10,596,436 B1 3/2020 Campbell et al.
10,600,334 B1 3/2020 Zhang et al.
10,603,568 B2 3/2020 Palanethra et al.
10,610,757 B1 4/2020 Marty
10,762,642 B2 9/2020 Marty et al.
10,898,782 B2 * 1/2021 Circosta ..... A63B 69/0002
10,994,182 B1 5/2021 Campbell et al.
11,049,258 B2 6/2021 Marty et al.
11,077,353 B1 8/2021 Kamstra et al.
11,097,176 B1 8/2021 Campbell et al.
11,123,605 B1 9/2021 Marty
11,135,500 B1 10/2021 Campbell et al.
11,247,109 B1 2/2022 Campbell et al.
11,247,111 B2 2/2022 Harvey, Jr. et al.
11,450,106 B2 9/2022 Marty et al.
11,491,383 B1 11/2022 Campbell et al.
D972,675 S 12/2022 Campbell et al.
11,577,139 B1 2/2023 Campbell et al.
11,715,214 B1 8/2023 Marty et al.
11,813,510 B1 11/2023 Campbell et al.
11,890,521 B1 2/2024 Campbell et al.
11,896,884 B2 2/2024 Marty et al.
2002/0010032 A1 1/2002 Stiteler
2003/0023145 A1 1/2003 Lee et al.
2005/0092311 A1 5/2005 Johndreau
2005/0143154 A1 6/2005 Bush
2006/0068945 A1 3/2006 Murchison, III
2006/0160639 A1 7/2006 Klein
2006/0236993 A1 10/2006 Cucjen et al.
2007/0026974 A1 2/2007 Marty et al.
2007/0026975 A1 2/2007 Marty et al.
2007/0173355 A1 7/2007 Klein
2007/0232419 A1 * 10/2007 Kosjer ..... F41B 3/03 473/451
2007/0265138 A1 11/2007 Ashby
2008/0015061 A1 1/2008 Klein
2008/0195005 A1 8/2008 Horst
2008/0200287 A1 8/2008 Marty et al.
2008/0254866 A1 10/2008 Young et al.
2008/0261726 A1 10/2008 Chipperfield
2008/0312010 A1 12/2008 Marty et al.
2009/0042672 A1 2/2009 Radice
2009/0045578 A1 2/2009 Wang
2009/0137347 A1 5/2009 Jenkins et al.
2010/0259412 A1 10/2010 Pagonakis
2010/0261557 A1 10/2010 Joseph et al.
2011/0013087 A1 1/2011 House et al.
2011/0071818 A1 3/2011 Jiang
2011/0214651 A1 9/2011 Woessner et al.
2011/0294585 A1 12/2011 Penna et al.
2011/0303207 A1 12/2011 Shober et al.
2012/0115651 A1 5/2012 Chipperfield
2013/0095959 A1 4/2013 Marty et al.
2013/0130845 A1 5/2013 Marty et al.
2013/0172058 A1 7/2013 Marty et al.
2014/0080675 A1 3/2014 Anderson
2014/0092253 A1 4/2014 Marty et al.
2014/0121043 A1 5/2014 Blanning et al.
2014/0135956 A1 5/2014 Thurman et al.
2014/0195022 A1 7/2014 Thurman et al.
2014/0200692 A1 7/2014 Thurman et al.
2014/0283142 A1 9/2014 Shepherd et al.
2014/0301601 A1 10/2014 Marty et al.
2014/0305420 A1 10/2014 Deese
2015/0028541 A1 1/2015 Murakami et al.
2015/0141144 A1 5/2015 Sprague et al.
2015/0258416 A1 9/2015 Ianni et al.
2015/0265897 A1 9/2015 Gordon et al.
2015/0290516 A1 10/2015 Joseph et al.
2015/0352425 A1 12/2015 Lewis et al.
2016/0082340 A1 3/2016 Adams
2016/0121193 A1 5/2016 Marty et al.
2016/0166907 A1 6/2016 Joseph et al.
2016/0193518 A1 7/2016 Baxter et al.
2016/0250536 A1 9/2016 Hart
2016/0250540 A1 9/2016 Joseph et al.
2016/0287964 A1 10/2016 Jones
2016/0310814 A1 10/2016 Joseph et al.
2016/0325168 A1 11/2016 Campbell et al.
2016/0346601 A1 12/2016 Marcandelli
2016/0354664 A1 12/2016 DeCarlo
2017/0007921 A1 1/2017 Baba et al.
2017/0095716 A1 4/2017 Lewis et al.
2017/0136333 A1 5/2017 Joseph et al.
2017/0157482 A1 6/2017 DeCarlo
2017/0161561 A1 6/2017 Marty et al.
2017/0232298 A1 8/2017 Joseph et al.
2017/0282044 A1 10/2017 Moore et al.
2017/0340943 A1 11/2017 Pierotti et al.
2017/0340949 A1 11/2017 Tsai
2018/0056124 A1 3/2018 Marty et al.
2018/0322337 A1 11/2018 Marty et al.

(56) References Cited

U.S. PATENT DOCUMENTS

| | | | | |
|---|---|---|---|---|
| 2019/0224555 | A1* | 7/2019 | Ward | A63B 69/408 |
| 2019/0329114 | A1 | 10/2019 | Marty et al. | |
| 2020/0098113 | A1 | 3/2020 | Marty et al. | |
| 2021/0166010 | A1 | 6/2021 | Marty et al. | |
| 2022/0122269 | A1 | 4/2022 | Marty et al. | |
| 2022/0288451 | A1 | 9/2022 | Hebbale et al. | |
| 2022/0415048 | A1 | 12/2022 | Marty et al. | |
| 2024/0071140 | A1 | 2/2024 | Marty et al. | |
| 2024/0087137 | A1 | 3/2024 | Marty et al. | |

FOREIGN PATENT DOCUMENTS

| | | | |
|---|---|---|---|
| EP | 2271414 | B1 | 6/2014 |
| RU | 2026104 | | 1/1995 |
| WO | 9530872 | A1 | 11/1995 |
| WO | 9532033 | | 11/1995 |
| WO | 2005062841 | | 7/2005 |
| WO | 2009126982 | A2 | 10/2009 |

OTHER PUBLICATIONS

Dr. Dish™, Airborne Athletics Inc., Belle Plaine, Minnesota, http://www.drdishbasketball.com/, at least as early as Jul. 29, 2003.

IMake ™, Airborne Athletics Inc., Belle Plaine, Minnesota, www.imakebasketball.com. (The iMake has a menu drive programming board allowing the user to select a shooting range by selecting a left and a right limit. The user is given the ability to select spots between said shooting range in spaced increments for the machine to fire balls in that direction. ) At least as early as Jun. 2008.

Vorelco, The Sniper Basketball Training System, https://www.youtube.com/watch?v=X9SqMy8xdf4, Uploaded on Jul. 5, 2008.

Brochure entitled "Sniper: The Ultimate Basketball Trainer." before Oct. 22, 1995, 5 pages including the cover letter.

Invalidity charts from ongoing arbitration involving patents issued from application(s) related to the present application.

BSN Sports, Hot Shot Basketball Shooting Machine, https://www.bsnsports.com/hot-shot-basketball-shooting-machine, site accessed Mar. 9, 2021.

ECoach, Learn From the Best Minds in Basketball and Grow Your Game, https://ecoachsports.com/basketball-old/, site accessed Aug. 28, 2019.

Sideline Scout, SideLine Live, https://sidelinescout.com/sports/basketball/, site accessed Aug. 28, 2019.

White, J., Technology Grows and Coaches Need to Grow With [it]: Remote Training Gives High School Athletes a Different Outlet, USA Today High School Sports, https://usatodayhss.com/2019/technology-grows-and-coaches-need-to-grow-with-it-remote-training-gives-high-school-athletes-a-different-outlet, Jul. 4, 2019.

MYOM, MYOM Basketball Shooting Gun Basketball Rebounder Machine—Best Basketball Shooting Trainer, https://www.amazon.com/MYOM-Basketball-Shooting-Rebounder-Machine/dp/B07HBN5X81, site accessed Mar. 9, 2021.

Siboasi, Basketball Passing Machine S6839, https://www.siboasi.com/basketball-passing-machine-s6839.html, site accessed Mar. 9, 2021.

SIBOASI, SIBOASI S6839 Programmable Basketball Shooting Machine, https://www.youtube.com/watch?v=ZjzTnal.OccY&t=16s, Jun. 1, 2019.

Homecourt, https://www.homecourt.ai/, site accessed Aug. 28, 2019.

Airborne Athletics, Inc., www.imakebasketball.com/training_features.html, Jun. 2008, visited Feb. 3, 2016 via http://web.archive.org/web/20080608033916/http://www.imakebasketball.com/training_features.html.

Airborne Athletics, Inc., www.airborneathletics.com/imake-basketball-machine.php, Feb. 2011, visited Feb. 3, 2016 via http://web.archive.org/web/20110213020947http://www.airborneathletics.com/imake-basketball-machine.php.

Airborne Athletics, Inc., www.drdishbasketball.com, visited Mar. 1, 2016.

Airborne Athletics, Inc., Dr. Dish Display, Available Apr. 2015.

Control Panel shown on webpage: https://web.archive.org/web/20131011040129/https://www.winners-choice.net/gun-8000.html, Web Archive Capture date: Oct. 11, 2013 [acessed on Feb. 24, 2018] (Year: 2013).

Shoot-A-Way, Inc., www.shootaway.com, visited Mar. 1, 2016.

Dr. Dish Owner's Manual, Airborne Athletics, Inc., 2005.

Reich, B. et al., A Spatial Analysis of Basketball Shot Chart Data, The American Statistician, Feb. 2006, vol. 60 No. 1.

Sniper, First Advanced Basketball Training Device, 2009.

* cited by examiner

START
STOP
LIGHT
LIGHT
LIGHT 256
258
276
277
278
271
272
273
274
275
279
START
STOP
TURN
TURN
TURN 259
256
258
MAKE PHOTO
CONTINUE
1
2
3
4
5
6
7
8
9
10
11
12
13
14
15
16
17
18
19
20
21
22
23
24
25
26
27
28
29
30
31
32
33
34
35
36
37
38
39
40

BASKETBALL LAUNCHING DEVICE

CROSS-REFERENCE TO RELATED APPLICATIONS

This application claims the benefit of U.S. Provisional Application Ser. No. 63/014,765 filed Apr. 24, 2020, and U.S. Provisional Application Ser. No. 63/142,570 filed Jan. 28, 2021, the disclosures of all of which are hereby incorporated by reference as if fully restated herein.

TECHNICAL FIELD

Exemplary embodiments relate generally to a launching device for basketballs.

BACKGROUND AND SUMMARY OF THE INVENTION

Traditionally, basketball players desiring to practice their shooting were required to gather a number of basketballs, shoot the basketballs towards a basketball goal, and subsequently gather the scattered basketballs from their shooting attempts in order to make additional shooting attempts. In recent years, basketball rebounding machines have emerged which facilitate the gathering and passing of basketballs to a player at various locations on a basketball playing area to facilitate repetitive shooting attempts. Some such rebounding machines utilize ramps or otherwise rely on gravity to return the basketballs to the user. Other such rebounding machines utilize passing devices to launch the basketballs to various locations on the basketball playing area. Examples of rebounding machines utilizing such passing devices include THE GUN® from Shoot-A-Way of Upper Sandusky, Ohio (https://shootaway.com/) and DR. DISH from Airborne Athletics of Minneapolis, Minnesota (https://www.drdishbasketball.com/). What is needed is a basketball launching device which is reliable, cost effective to manufacture, and/or mimics a human basketball pass.

A basketball launching device which is reliable, cost effective to manufacture, and/or mimics a human basketball pass is provided. A motor may turn a drive shaft coupled to a linkage. A ram may be connected to one or more arms forming the linkage. The linkage may be connected to a rotation device such that turning of the motor is translated into a back and forth swinging motion of the ram. The ram may cycle between engaging and pushing a first portion of a catapult arm and engaging and pushing an engagement arm.

As the ram engages and pushes the catapult arm, the catapult arm may be forced to rotate about the rotation device into a second position where an attachment portion on the catapult arm is received within a notch of the engagement arm. In the second position, the catapult arm may extend primarily in a horizontal direction. A spring may be attached to a second portion of the catapult arm and may increase in length, and thus tensioning forces, as the catapult arm is moved into the second position. A basketball may be positioned onto a basketball holder, which may be located at a first portion of the catapult arm.

The ram may subsequently contact and push the engagement arm, thereby releasing the attachment portion from the notch, and thus release the catapult arm. The spring may force the catapult arm to rapidly rotate. A stop bar may arrest the catapult arm from rotation beyond a first position where the catapult arm extends primarily in a vertical direction such that the basketball is launched to a user. The motor may continue to turn, thus repeating the cycle any number of times.

The spring may be connected to a tension adjustment member. The tension adjustment member may be secured in one of a number of positions along a post to adjust the tensioning forces in the spring, and thus the throwing force of the catapult arm and the throwing distance of the basketball.

In exemplary embodiments, a user interface may be provided. The user interface may be in electrical communication with the aforementioned launching mechanism, or another launching mechanism, directly or by way of one or more intermediate components such as, but not limited to, a controller. The user interface may be configured to receive a user selection of locations for the launcher to pass the basketballs to, timing between such launches, order of such launches, distance of such launches, combinations thereof, or the like. The user interface may comprise a touch screen or electronic display. A visual depiction of various components of a traditional basketball playing area may be provided at the user interface, such as but not limited to a baseline, key, and/or three-point line. The locations may be displayed and updated as they are selected by the user. Such updates may include illumination, highlighting, colorization, changing or other alteration of the displayed graphic, combinations thereof, or the like. Alternatively, no such locations may be displayed and the user's touch at a given point may cause a location to be displayed as the user selections are made. For example, an icon or the like may appear approximately where selected by the user. The user interface may be configured to permit the user to create any number of custom practice arrangements.

The user interface may be configured to permit revision of the selected locations after their initial selection, such as before the custom practice arrangement begins, during the practice session, or after the practice session is completed. In exemplary embodiments, the selected locations may be moved, such as but not limited to by a tap and drag technique, to move them from an initial location to a new location. In some embodiments, the order of the selected locations within the custom practice arrangement may be left unchanged. In other embodiments, the order of the selected locations within the custom practice arrangements may by automatically renumbered such that the basketballs are always passed in a particular order, such as but not limited to from right to left or left to right, closest to furthest, further to closest, etc.

In exemplary embodiments, the user interface may be configured to record the distance the selected location is from the launcher. For example, without limitation, some of the selected locations may be provided in front of the visual depiction of the three-point arc, while others may be provided behind. The user interface may be configured to note such distances.

The user interface may be configured to communicate the selected locations forming the custom practice arrangements to the launcher, such as but not limited to, by way of the controller. For those locations further from the launcher, the launcher may be configured to automatically launch basketballs with greater force (thus causing their normal passing distance to increase). Likewise, for those locations closer to the launcher, the launcher may be configured to automatically launch basketballs with less force (thus causing their normal passing distance to decrease). Such distance adjustment may be performed manually and/or by an automatic distance adjustment mechanism.

Alternatively, or additionally, the controller and/or user interface may be configured to assign points to each shooting attempt based on the distance from the launcher and/or basketball goal. For example, without limitation, those locations located behind the visual depiction of the three-point line may be assigned three points while those locations located in front of the three-point arc may be assigned two points. Such points may only be determined and/or recorded by the user interface, controller, or another component upon detection of a successfully made shot corresponding with a pass of a basketball to the respective location.

In exemplary embodiments, the automatic distance adjustment mechanism may comprise a movement imparting mechanism connected to a flexible member, such as a wire, rope, cable, or the like. The flexible member may travel about a pulley, or multiple pulleys (e.g., in one or more blocks), to a first linkage member. The first linkage member may be pivotally connected to a support member or platform. The first linkage member may be configured for counterclockwise movement upon retraction of said flexible member. A second linkage member may be pivotally connected to a support frame or platform, such as but not limited to a post extending therefrom.

The second linkage member may comprise a protrusion or guide extending from a second end thereof. The guide or protrusion may be configured to physically interact with at least a portion of the first linkage member. In exemplary embodiments, counterclockwise movement of said first linkage member may be configured to cause clockwise movement of said second linkage member, such as by way of contact with said guide or protrusion. The tensioning spring may be connected to the second linkage member such that movement of the second linkage member results in increased or decreased forces on said tensioning spring, thereby increasing or decreasing forces on the catapult arm and thus the forces the basketballs are launched with and the distance the basketballs travel if otherwise unimpeded. In exemplary embodiments, clockwise rotation of said second linkage member may be configured to increase tensioning forces on said tensioning spring.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Figure 1:
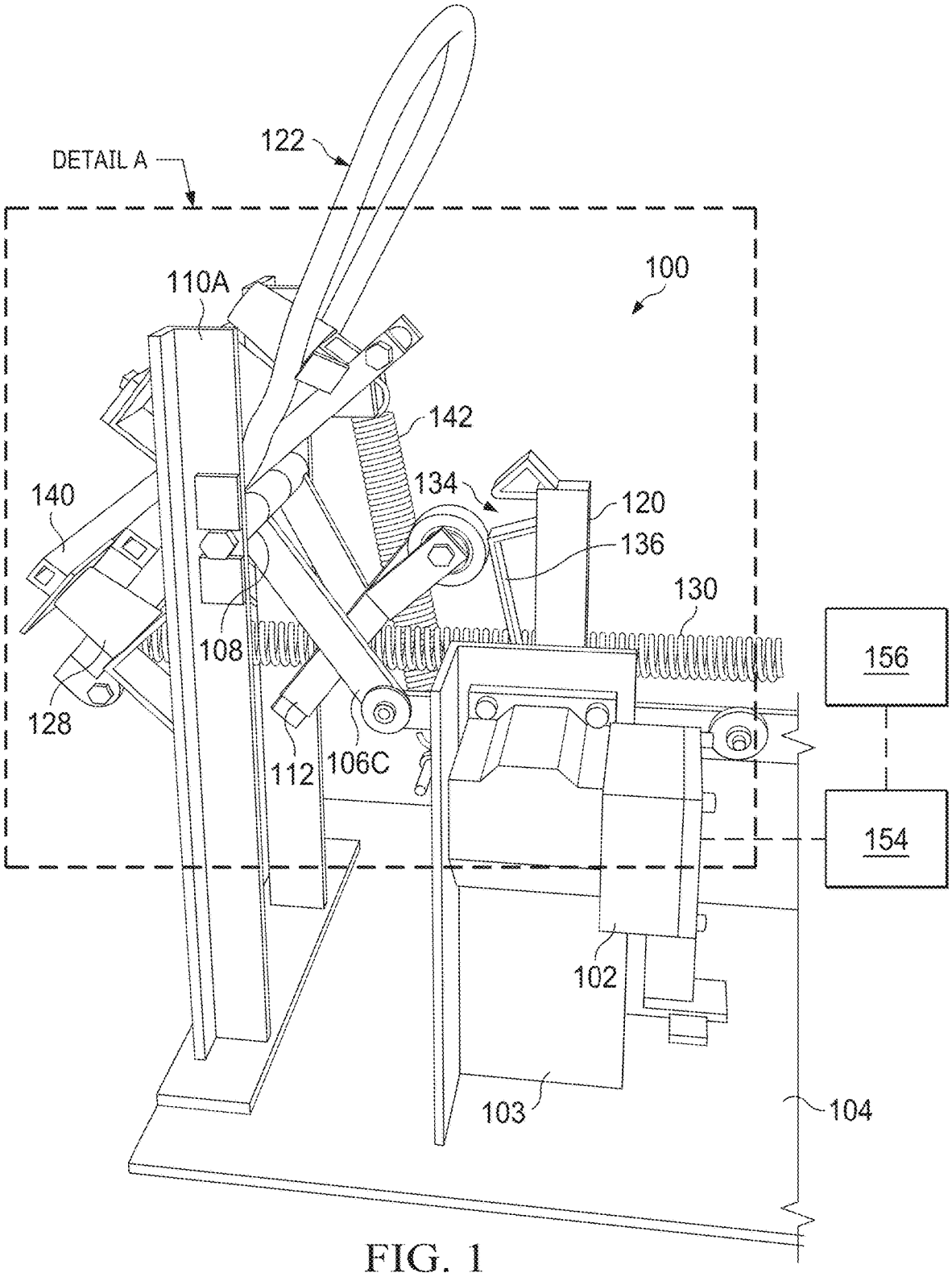
FIG. 1 is a side view of an exemplary basketball launching device in accordance with the present invention where the basketball launching device is in a first position.
Figure 2:
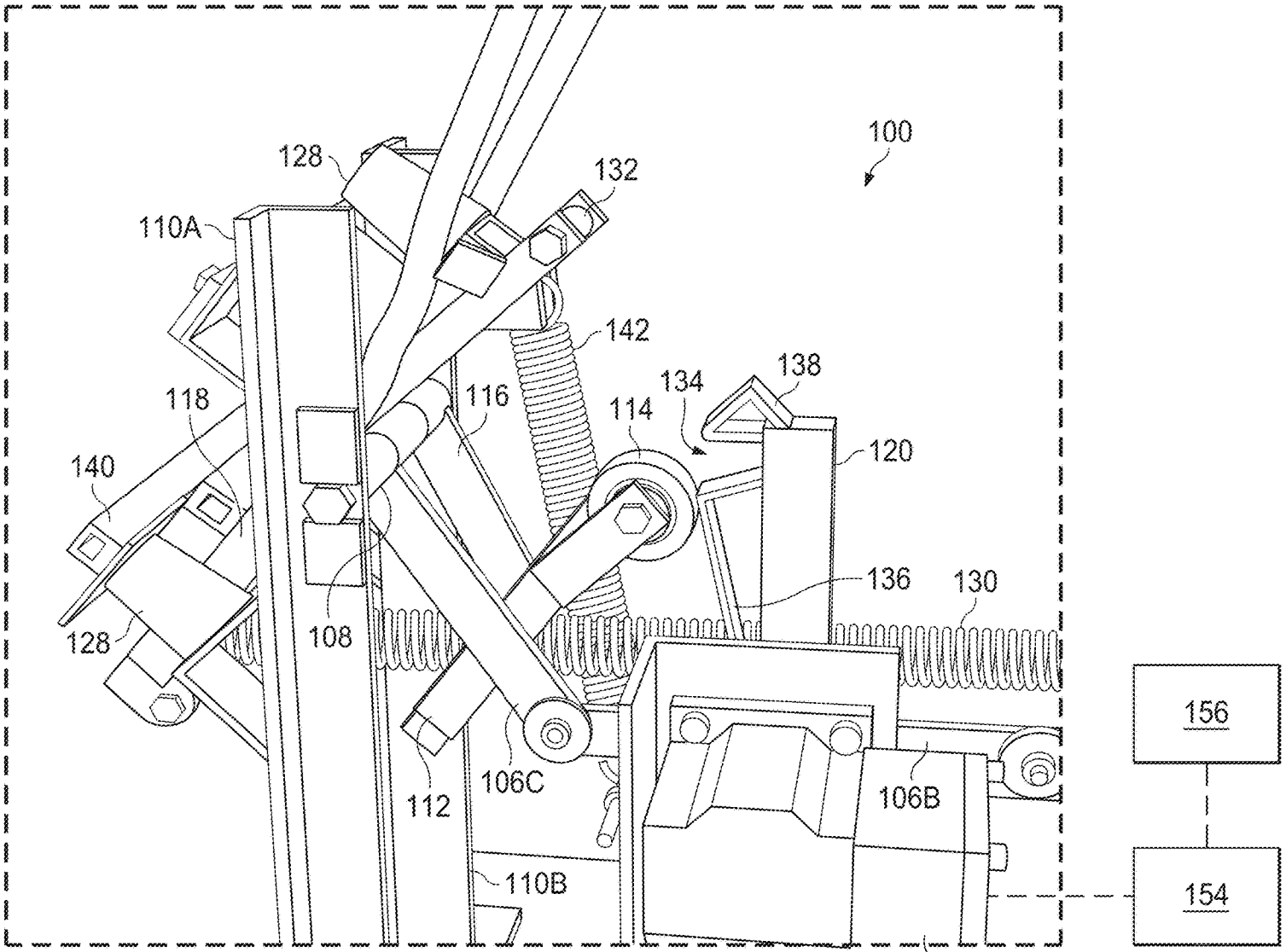
FIG. 2 is an enlarged side view of Detail A indicated in FIG. 1.
Figure 3:
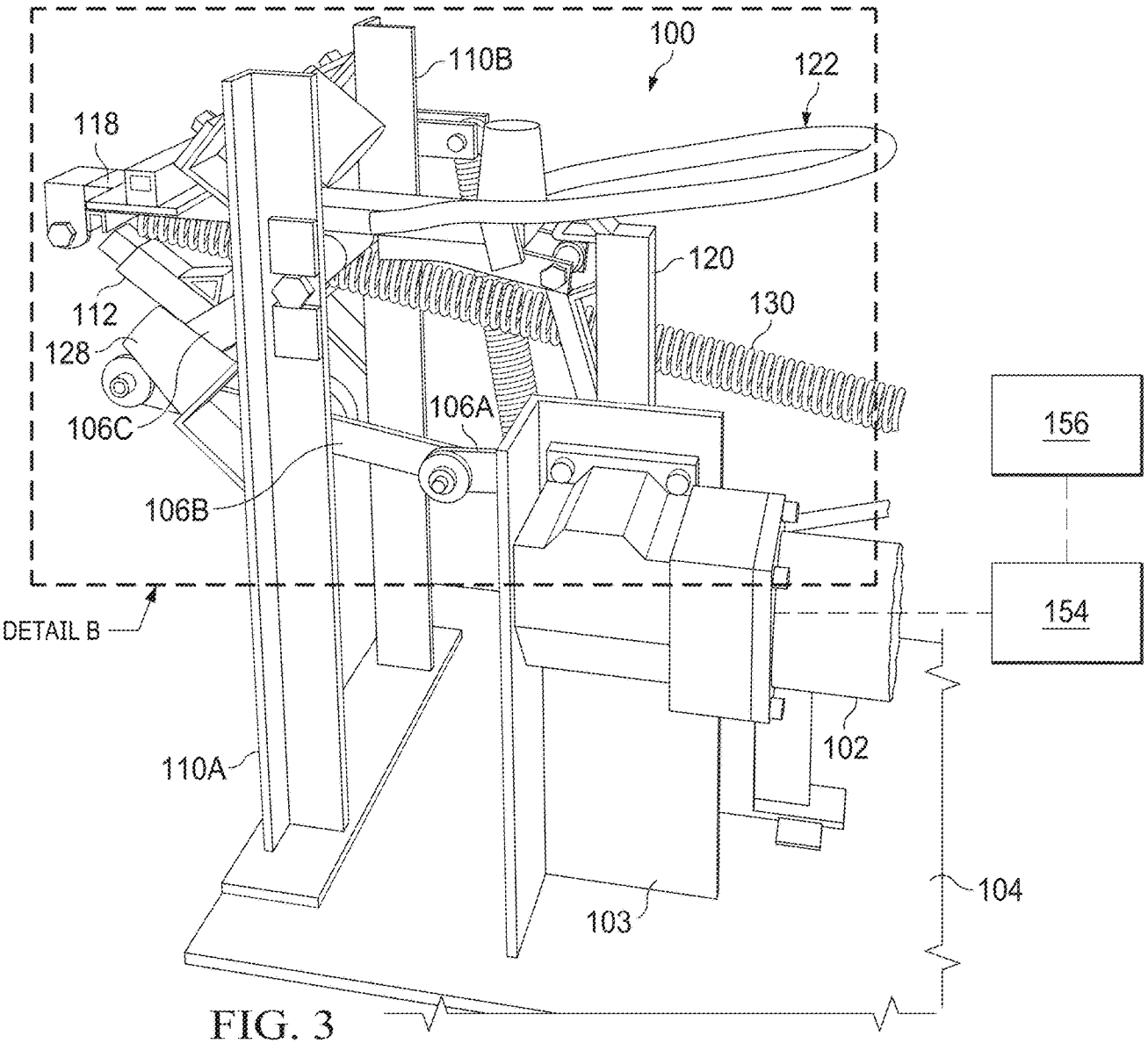
FIG. 3 is a side view of the basketball launching device of FIG. 1 in a second position.
Figure 4:
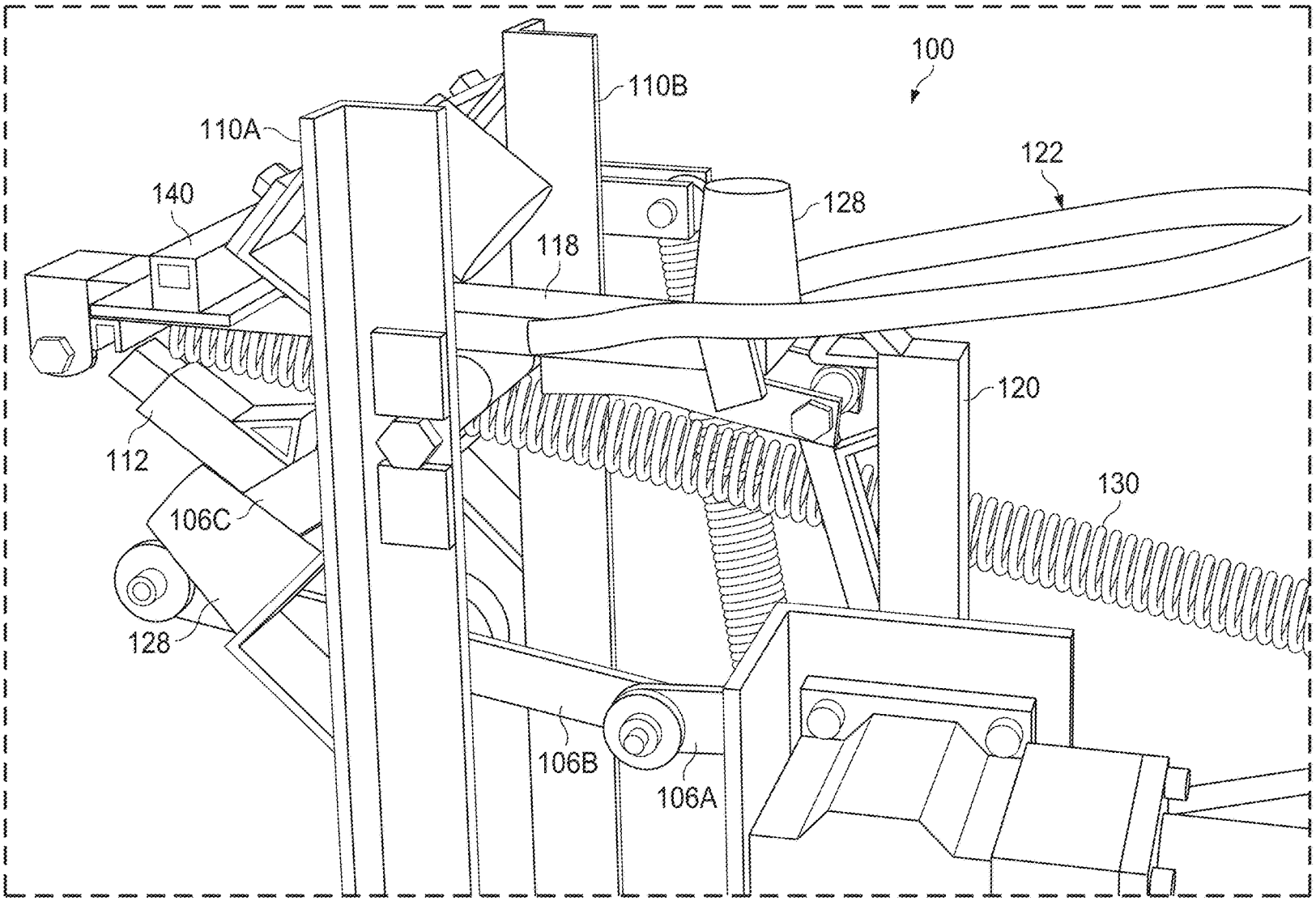
FIG. 4 is an enlarged side view of Detail B indicated in FIG. 3.
Figure 5:
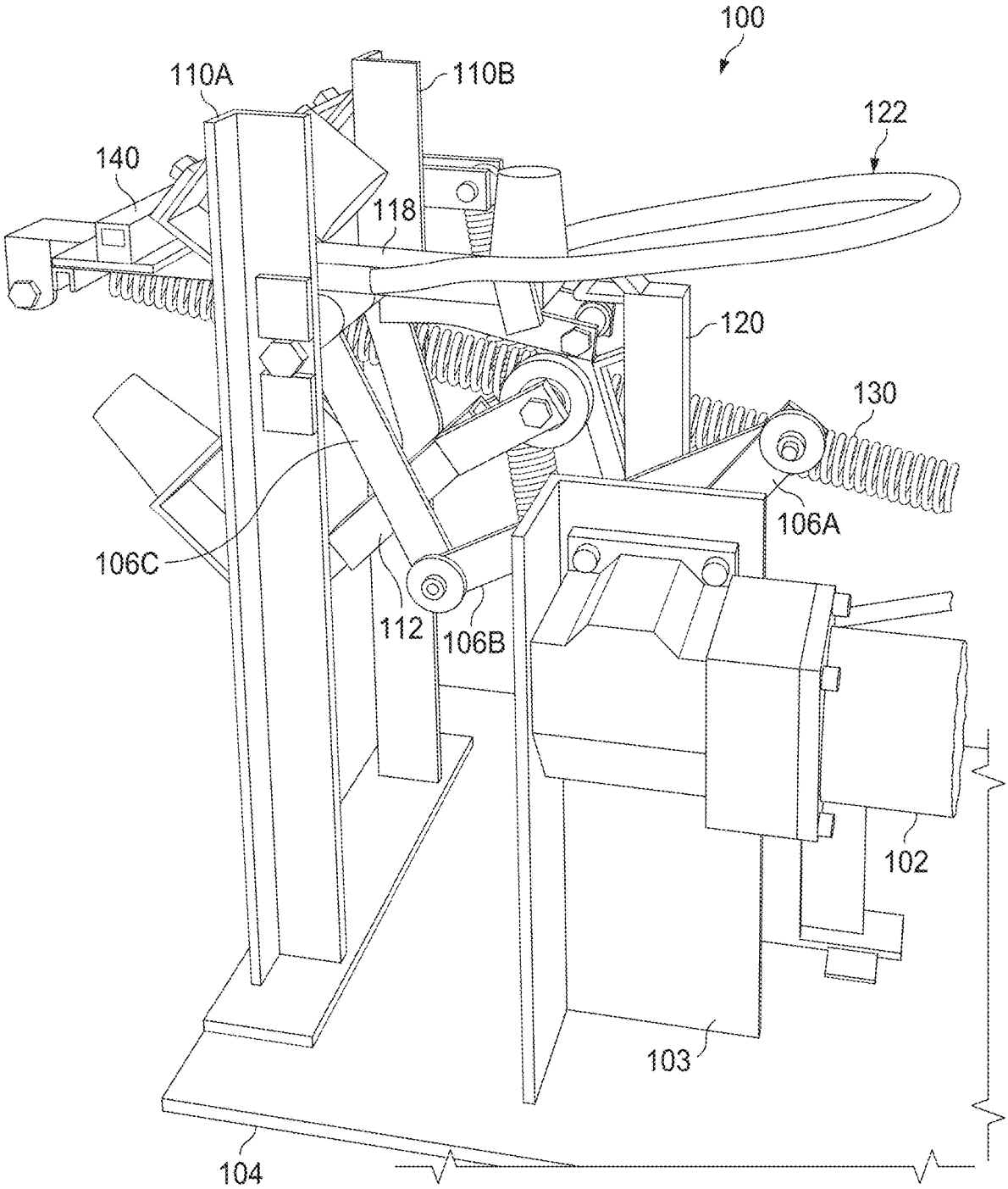
FIG. 5 is a side view of a portion of the basketball launching device of FIG. 1 in the second position.
Figure 6:
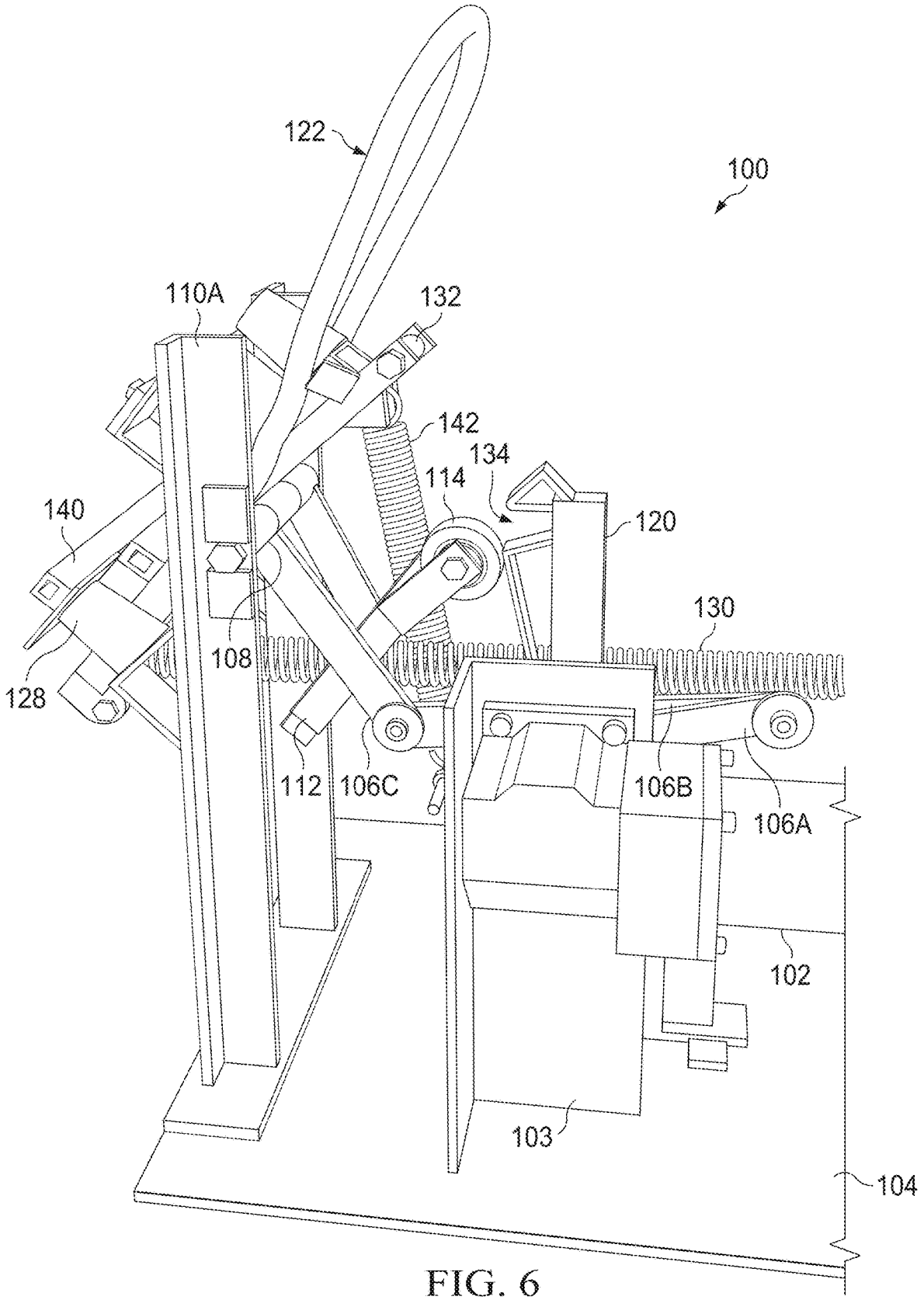
FIG. 6 is a side view of a portion of the basketball launching device of FIG. 1 in the first position.
Figure 7:
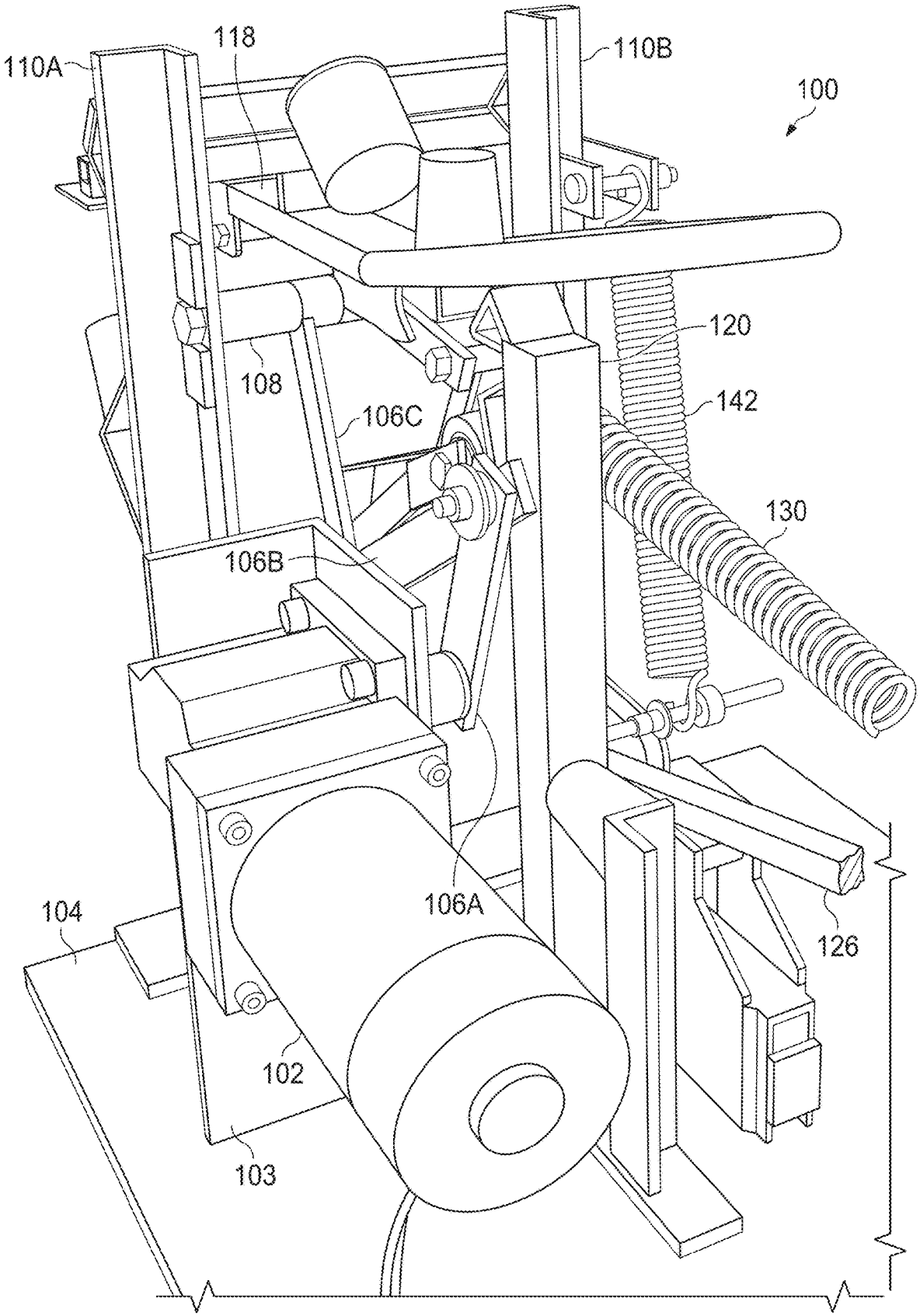
FIG. 7 is a rear view of a portion of the basketball launching device of FIG. 1 in the second position.
Figure 8:
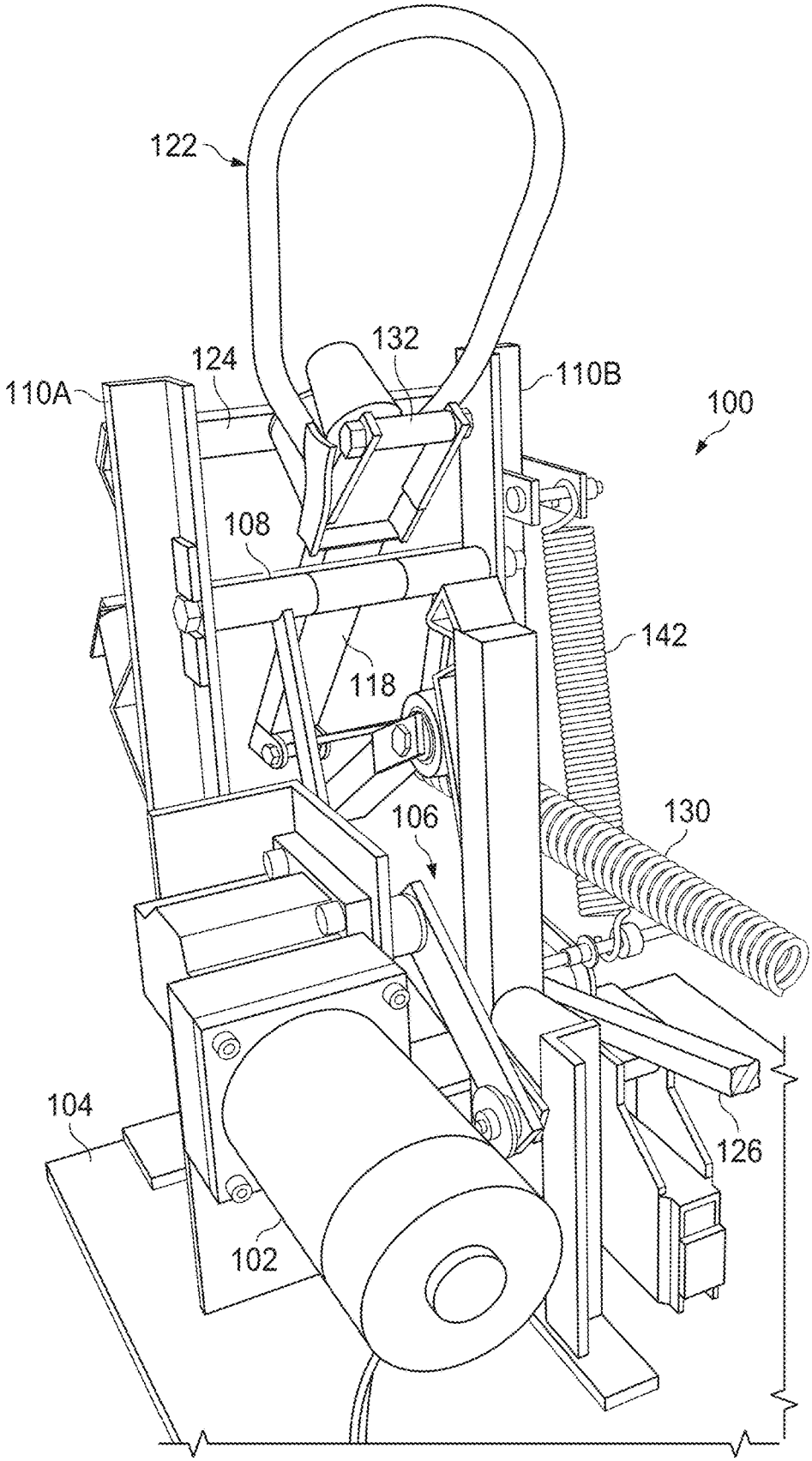
FIG. 8 is a rear view of a portion of the basketball launching device of FIG. 1 in the first position.
Figure 9:
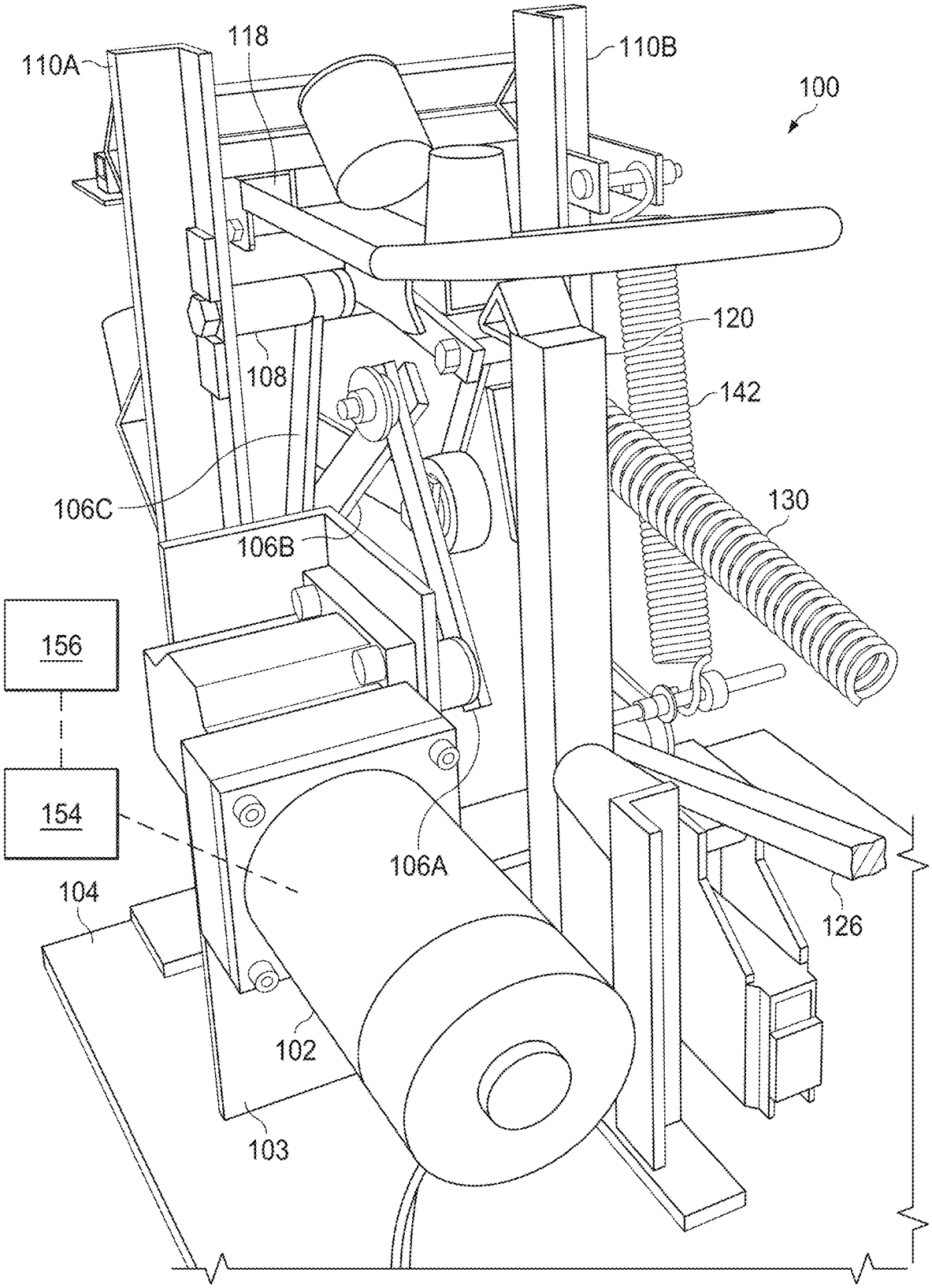
FIG. 9 is a rear perspective view of a portion of the basketball launching device of FIG. 1 in the second position.
Figure 10:
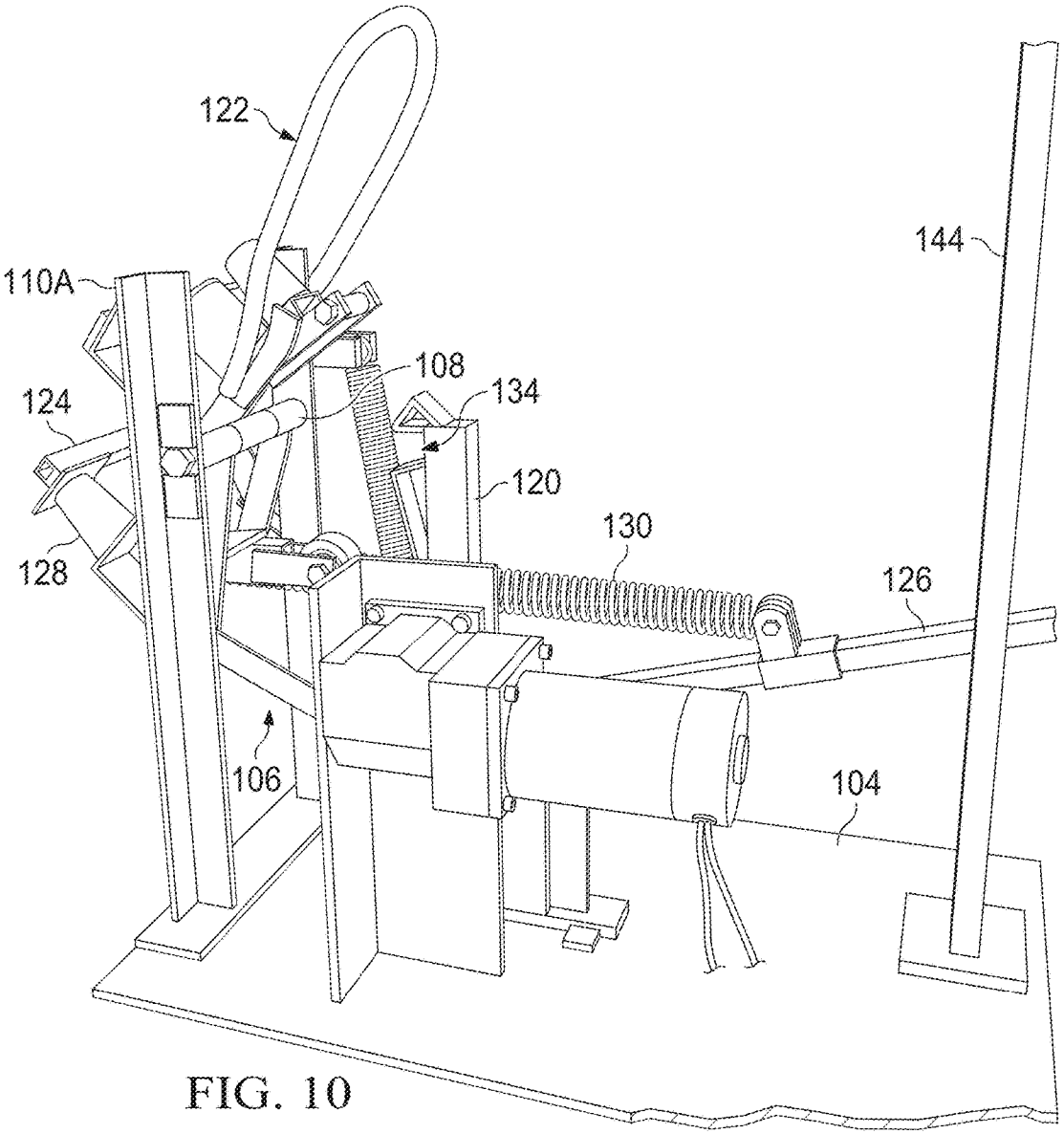
FIG. 10 is a side view of the basketball launching device of FIG. 1 in the first position.

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

FIG. 1 through FIG. 10 illustrates various views of an exemplary basketball launching device 100. A motor 102 may be mounted to a mounting structure 104. The mounting structure 104 may comprise one or more platforms, members, combinations thereof, or the like. However, the motor 102 may be mounted to any surface, such as but not limited to a frame, post, member(s), some combination thereof, or the like. In exemplary embodiments, the mounting structure 104, or one or more components attached thereto, may be configured for rotational and/or pivoting movement such that a direction of the basketball launching device 100, or components thereof, may be adjusted. The motor 102 may be mounted at an elevated position above the mounting structure 104 by way of one or more brackets 103, though such is not required. The mounting structure 104 may comprise a flat surface and/or a series of members forming a framework. The mounting structure 104 may comprise one or multiple surfaces and/or members.

The motor 102 may be coupled to a linkage 106. In exemplary embodiments, the linkage 106 may comprise three rigid, straight-line arms 106A, 106B, and 106C, though any number of arms or any type or kind, or other components, may be utilized. A proximal portion of a first arm 106A may be coupled to a drive shaft of the motor 102 such that the first arm 106A extends therefrom. In this way, the first arm 106A may act as a crank. A proximal portion of the second arm 106B may be connected to a distal portion of the first arm 106A. A distal portion of the second arm 106B may be connected to a proximal portion of the third arm 106C. A distal portion of the third arm 106C may be connected to a rotation device 108. The rotation device 108 may comprise an axle extending between the supports 110A, 110B. The connections between the first, second, and third arms 106A, 106B, and 106C may permit rotation relative to one another. For example, without limitation, a pin may be passed through the connection point between the first arm 106A and the second arm 106B as well as the connection point between the second arm 106B and the third arm 106C. The third arm 106C may be fixed to the rotation device 108 in a way which facilitates rotation of the third arm 106C. The linkage 106 may be configured to translate turning of the drive shaft of the motor 102 into movement of the three arms 106A, 106B, and 106C. In exemplary embodiments, the rotation device 108 may comprise a cylinder extending between support posts 110A and 110B. The rotation device 108 may, alternatively or additionally, comprise one or more screws, pins, posts, cams, cylinders, some combination thereof, or the like. Any device configured to permit rotational movement may be utilized. The third arm 106C may be connected to a sleeve extending about the cylinder of the rotation device 108.

A ram 112 may be mounted to the linkage 106. In exemplary embodiments, the ram 112 may be mounted to the third arm 106C. The ram 112 may comprise a rigid member. The ram 112 may be configured to exert a force on a catapult arm 118, and separately on an engagement arm 120 when moved. For example, without limitation, the ram 112 may be mounted at a non-zero angle relative to a longitudinal axis of the respective linkage 106 member, such as but not limited to the third arm 106C. In exemplary embodiments, the ram 112 may be mounted substantially perpendicular to the third arm 106C, though other non-zero angles may be utilized. A wheel 114 may be mounted to a distal portion of the ram 112 for movement along at least a portion of the engagement arm 120. The linkage 106 may be configured to translate turning of the drive shaft of the motor 102 into a back-and-forth swinging motion of the ram 112, for example without limitation, about the rotation device 108. When operated, the ram 112 may alternate between contacting and exerting force on the catapult arm 118 and the engagement arm 120. For example, without limitation, the ram 112 may contact each of the catapult arm 118 and the engagement arm 120 once during a single cycle of the motor 102.

In exemplary embodiments, a support arm 116 may extend between the ram 112 and the rotation device 108 for added support. The support arm 116 may be connected to a sleeve extending about an axle of the rotation device 108, for example without limitation. The support arm 116 may extend substantially parallel to the third arm 106C, though such is not required.

The catapult arm 118 may be placed in a first position. In the first position, a longitudinal axis of the catapult arm 118 may extend in a primarily vertical direction. However, other angles of the longitudinal axis of the catapult arm 118 may be utilized such as, but not limited to, between 35 degrees and 105 degrees. The catapult arm 118 may comprise a basketball holder 122. The basketball holder 122 may be located at a proximal portion of the catapult arm 118, such as a portion which extends rearward of the rotation device 108. In exemplary embodiments, the basketball holder 122 may comprise one or more members formed into an oblong shape creating an area for a basketball to rest. The basketball holder 122 may be comprised of one or more bended tube members, though such is not required.

A first stop bar 124 may extend between distal portions of the support posts 110A and 110B. The catapult arm 118 may be rotatably mounted between the support posts 110A and 110B, such as by way of the rotation device 108. In exemplary embodiments, the catapult arm 118 may be mounted to the rotation device 108 in a manner which facilitates rotational movement of the catapult arm 118 about the rotation device 108. While the catapult arm 118 and the linkage 106 may be connected to the same rotation device 108 in exemplary embodiments, it is contemplated that separate rotation devices 108 may be utilized.

The stop bar 124 may be configured to arrest the catapult arm 118 from rotation beyond the stop bar 124. The catapult arm 118 may be rotated forward, such as in a counterclockwise direction. In exemplary embodiments, a spring 130 may be secured to the catapult arm 118 to provide forces which cause such rotation of the catapult arm 118 when released from the engagement arm 120. For example, the spring 130 may be fixed at a first end thereof, and mounted to a second portion of the catapult arm 118 extending forward of the rotation device 108. The first end of the spring 130 may be fixed to the mounting structure 104, or one or more components extending therefrom. One or more stoppers 128 may be mounted to the catapult arm 118 and/or the stop bar 124. In exemplary embodiments, the stoppers 128 may comprise rubber protrusions placed between the catapult arm 118 and the stop bar 124 to cushion impact between the catapult arm 118 and the stop bar 124.

In exemplary embodiments, a first end of the spring 130 may be attached to a tension adjustment member 126. The attachment location of the spring 130 to the tension adjustment member 126 may be adjusted to increase or decrease the amount of tension in the spring 130, and thus the amount of force exerted on the catapult arm 118. The tension adjustment member 126 may be pivotally mounted to the mounting structure 104 at a proximal portion thereof such that the vertical placement of a distal portion of the tension adjustment member 126 may be adjusted to adjust forces exerted by the spring 130. Stated another way, the tension adjustment member 126 may act as a lever arm. In exemplary embodiments, the vertical placement of the distal portion of the tension adjustment member 126 may be moved between one of a number of positions along a post 144 to increase or decrease the amount of tension in the spring 130, and thus the amount of force exerted on the catapult arm 118. The positions along the post 144 may be defined by vertically spaced protrusions, slots, some combination thereof, or the like. The post 144 may extend vertically from the mounting structure 104. While one spring 130 is discussed, multiple spring 130 of the same or different type may be used.

As the motor 102 cycles, a first portion of the ram 112 may be placed into contact with a distal portion of the catapult arm 118. The first portion of the ram 112 may be driven forward, after contacting the catapult arm 118, to rotate the catapult arm 118 into a second position. The second position may place the catapult arm 118 in a primarily horizontal orientation. However, other positions such as between −45 and 45 degrees may be utilized. This may increase the tension forces in the spring 130. A proximal portion of the catapult arm 118 may comprise an attachment portion 132. In exemplary embodiments, the attachment portion 132 may comprise a cylinder extending between two spaced apart arms. The catapult arm 118, such as but not limited to the attachment portion 132, may be temporarily secured within a notch 134 of the engagement arm 120, such as but not limited to, when the catapult arm 118 is placed in the second position.

The engagement arm 120 may extend primarily in a vertical direction from the mounting structure 104. The engagement arm 120 may be configured to provide limited rotational or other movement of the engagement arm 120 relative to the mounting structure 104. In exemplary embodiments, such limited movement may be caused by flex in the engagement arm 120 and/or the mounting structure 104. In other exemplary embodiments, a pin, rotational device, or other movement mechanism may be utilized.

The engagement arm 120 may comprise a guide 136. The engagement arm 120 may comprise a securement portion 138. The notch 134 may be defined by the engagement arm 120, the guide 136, and/or the securement portion 138. In exemplary embodiments, the guide 136 may comprise a ramp. The guide 136 may extend from, or form part of, a front surface of the engagement arm 120 (e.g., divot, channel, protrusion, combinations thereof, or the like). The guide 136 and the securement portion 138 may extend from the engagement arm 120 as protrusions or may extend into the engagement arm 120 as depressions, some combination thereof, or the like.

As the catapult arm 118 is moved into the second position, the attachment portion 132 may be secured within the notch 134, thus securing the catapult arm 118 in the second position. During such time, a basketball may be moved into the basketball holder 122. For example, without limitation, a basketball may be rolled down a ramp onto the basketball holder 122. A stopper 128 or other protrusion may be positioned on the catapult arm 118 and extend within the basketball holder 122 to assist in holding the basketball in place.

Upon further movement of the motor 102, the ram 112 may be moved away from the catapult arm 118. The second portion of the ram 112 may be moved towards the engagement arm 120. The second portion of the ram 112 may contact the engagement arm 120 and cause sufficient movement of the engagement arm 120 to release the attachment portion 132 from the notch 134. In exemplary embodiments, the wheel 114 may travel along the ramp surface of the guide 136, thereby causing rotational movement of the engagement arm 120. Regardless, once the attachment portion 132 is freed from the notch 134, the forces from the spring 130 may cause the catapult arm 118 to rapidly move into the first position. Upon arrest of the catapult arm 118 at the stop bar 124, the basketball may be thrown from the basketball holder 122, thus resulting in a basketball passing motion to a user.

In exemplary embodiments, a second stop bar 140 may be mounted to a distal portion of catapult arm 118. The second stop bar 140 may be configured to impact stoppers 128 positioned along the support posts 110A and 110B, or the support posts 110A and 110B themselves, so as to further arrest the catapult arm 118 from rotational movement beyond the first position. The second stop bar 140 may be mounted substantially perpendicular to the longitudinal axis of the catapult arm 118, though such is not required. In exemplary embodiments, only the first or second stop bars 124, 140 may be utilized.

A support spring 142 may extend between one of the support posts 110A and 110B and the mounting structure 104. The support spring 142 may be configured to provide rigidity and stability to the support posts 110A and 110B. Additional support springs 142 or other stabilizing devices and/or members may be mounted to the support posts 110A and 110B or other components of the launching device 100.

As the motor 102 is cycled, the catapult arm 118 may be moved between the first and second positions. Each cycle of the motor 102 may be configured to result in one basketball pass, with the launching device 100 continuously resetting itself for the next basketball pass. The disclosed launching device 100 may provide one or more advantages including, for example without limitation, mimicking of a human basketball pass, reduced manufacturing costs, greater reliability, and a more compact design.

The connections, mounting, couplings, and the like described herein may be accomplished by press fits, welding, bonding, adhesives, fasteners, friction fittings, some combination thereof, or the like.

Figure 11:
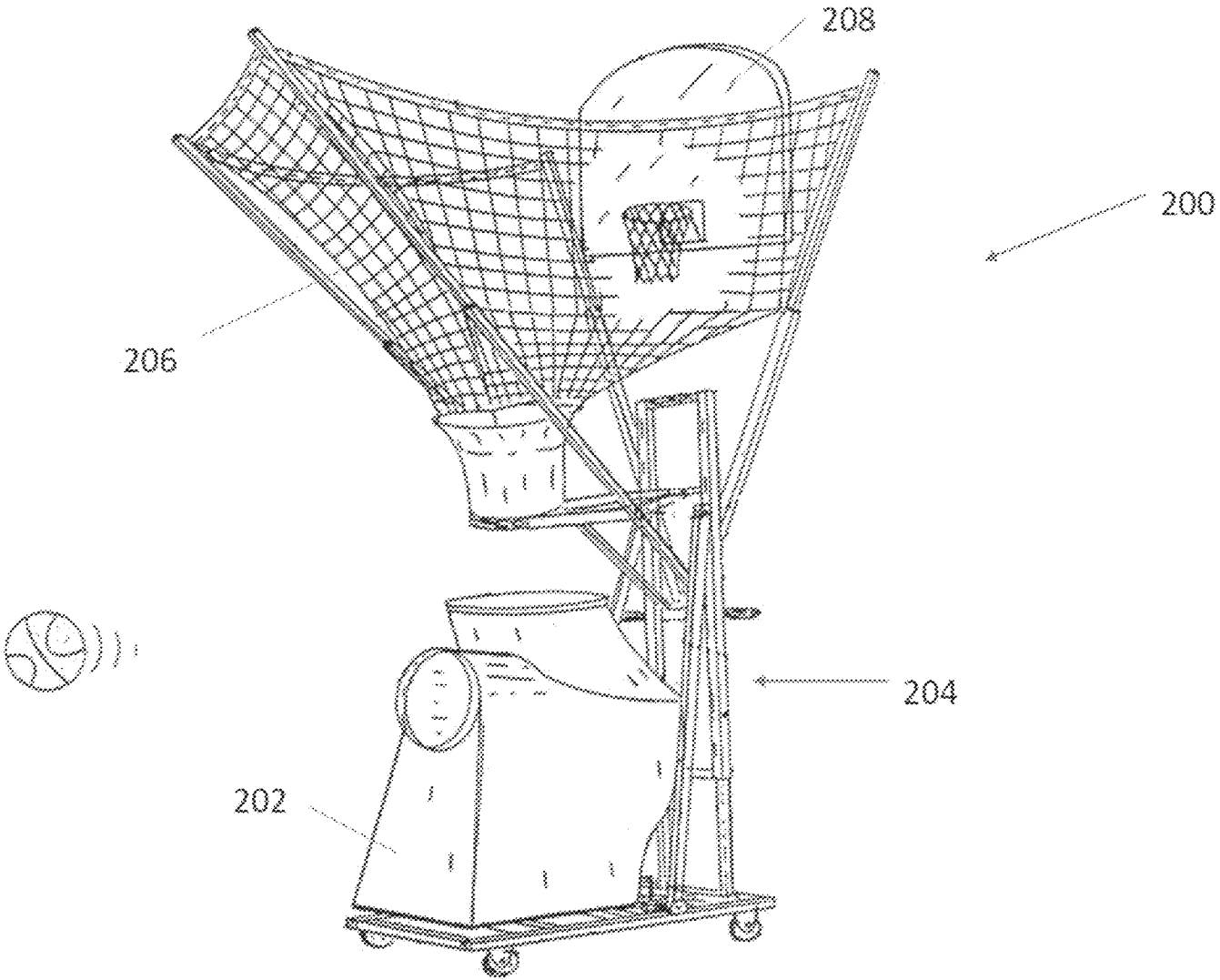
FIG. 11 is an exemplary basketball rebound machine for the basketball launching device of FIGS. 1-10.

FIG. 11 illustrates an exemplary basketball rebound machine 200 for use with the launching device 100. This basketball rebound machine 200 is provided for example and is not intended to be limiting. The basketball launching device 100 may be located within a housing 202. A portion of the frame 204 may extend behind the housing 202. A portion of the frame 204 may extend above the housing 204. The frame 204 may support a net 206. The net 206 may be configured to capture made shots and at least some missed shots and direct the basketballs to the basketball launching device 100. The frame 204 may be adjustable. The basketball rebound machine 200 may be positioned adjacent to a basketball goal 208 when operated. The net 206 may form a funnel shape about a portion of the basketball 208.

Figure 12:
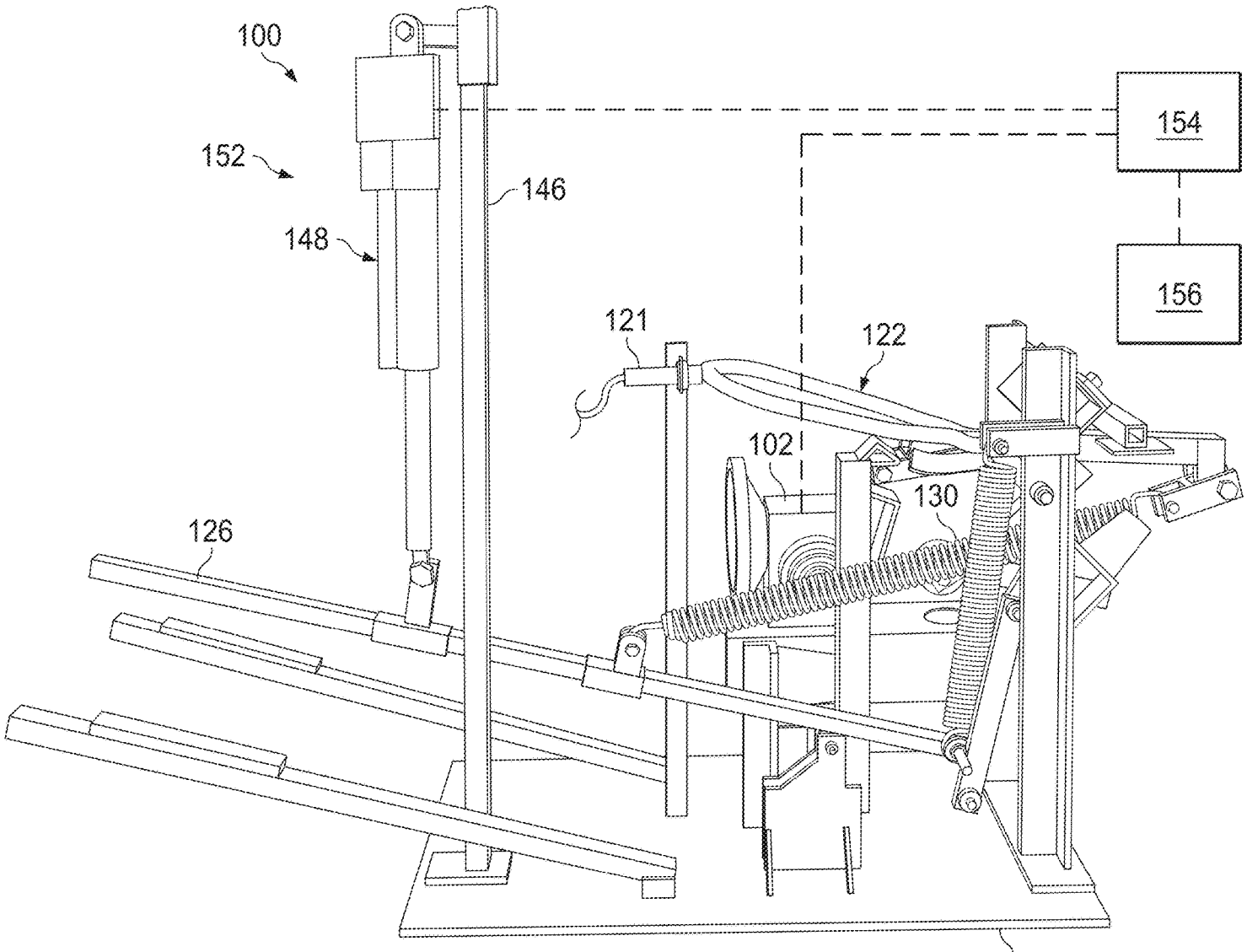
FIG. 12 is a side view of the basketball launching device of FIG. 1 with an exemplary distance adjustment mechanism.
Figure 13:
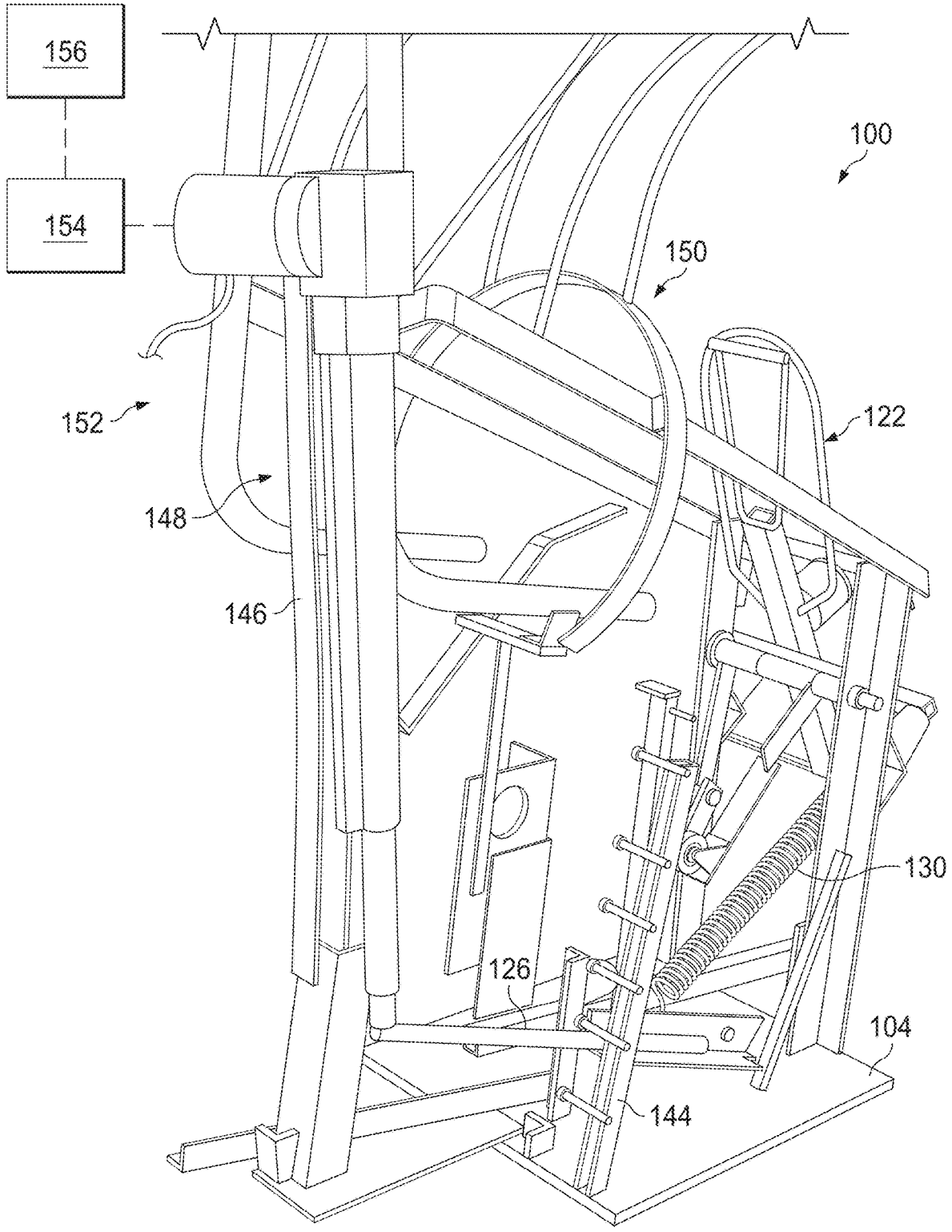
FIG. 13 is a rear perspective view of the device of FIG. 12.
Figure 14:
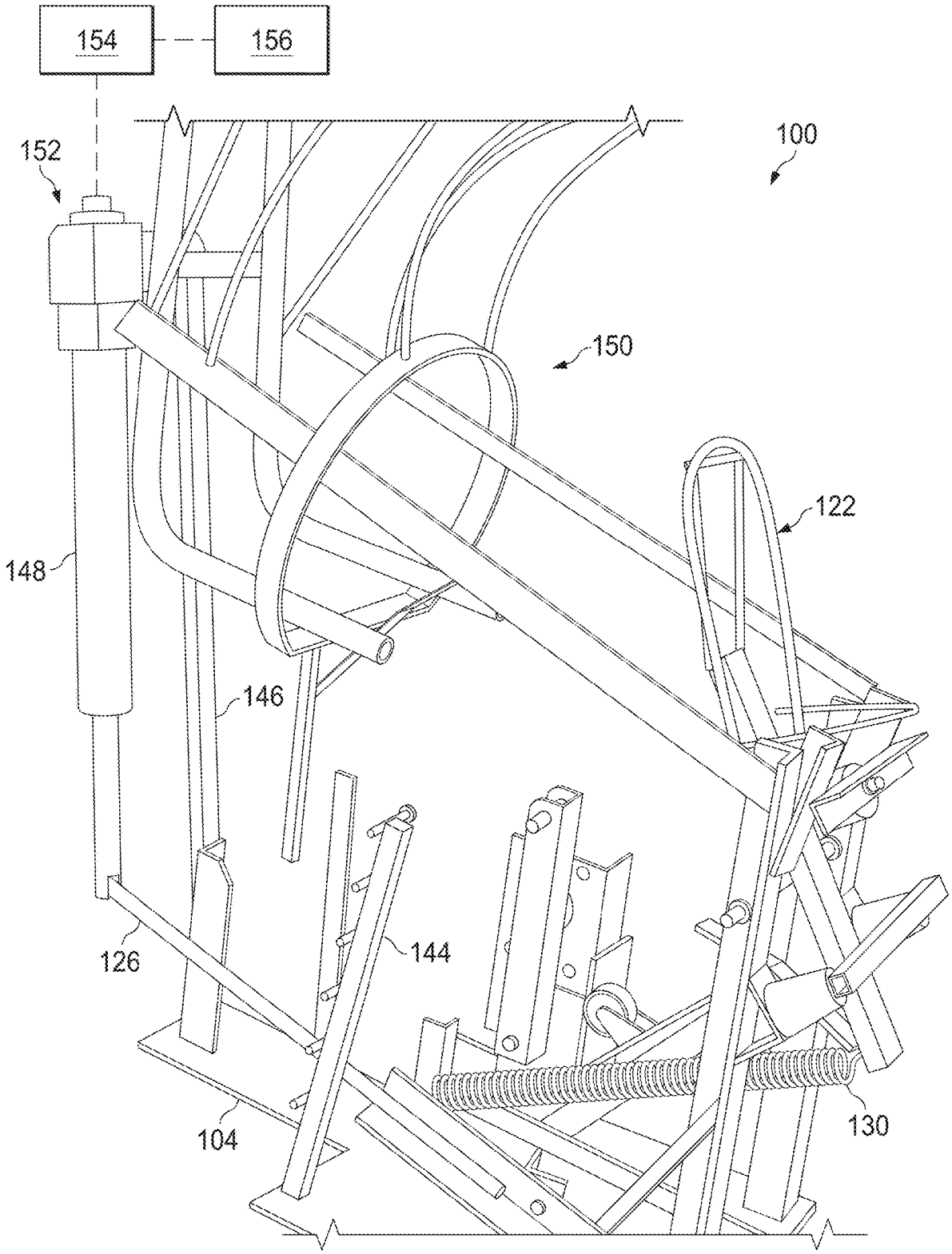
FIG. 14 is a front perspective view of a portion of the device of FIG. 12.

FIG. 12 through FIG. 14 illustrate the basketball launching device 100 with an automatic distance adjustment mechanism 152. The automatic distance adjustment mechanism 152 may be provided in addition to, or alternatively to, the post 144 which permits manual distance adjustment. The automatic distance adjustment mechanism 152 may comprise a support member 146. The automatic distance adjustment mechanism 152 may comprise a movement imparting mechanism 148, such as but not limited to, a movement imparting mechanism, piston, motor, actuator, screw, combinations thereof, or the like. The support member 146 may extend from the mounting structure 104 primarily in a vertical direction, though the support member 146 may extend in any direction. Multiple support members 146 may be utilized to provide adequate bracing. The movement imparting mechanism 148 may be secured to the support member 146. The movement imparting mechanism 148 may comprise a motor and a driver. The motor may be configured to move the driver in a particular direction, such as but not limited to, away from or towards the motor. Any type of movement imparting mechanism 148 or other movement imparting mechanism may be utilized. The movement imparting mechanism 148 may be installed to the support member 146 such that said movement imparting mechanism 148 is configured for movement in a vertical direction. The moving portion of the movement imparting mechanism 148 may be secured to the tension adjustment member 126. Other driving mechanisms and/or mechanical linkages may be interposed between the movement imparting mechanism 148 and the tension adjustment member 126 such as but not limited to, linkages, levers, gears, cams, slots, grooves, some combination thereof, or the like.

The movement imparting mechanism 148 may be configured for vertical movement which is translated into pivoting movement of the tension adjustment member 126, which results in increased or decreased tension forces placed on the spring 130. The increase of tension on the spring 130 may result in the basketball being thrown a greater distance and/or with greater force. The decrease of tension on the spring 130 may result in the basketball being thrown a reduced distance and/or with a reduced amount of force.

A directing device 150 may be provided adjacent to the basketball launching device 100. The directing device 150 may be configured to direct basketballs towards the basketball holder 122. The directing device 150 may form part of the rebounding machine 200.

One or more sensors 121 may be provided adjacent to one or more components of the basketball launching device 100. In exemplary embodiments, a limit switch 121 may be positioned adjacent to the location of the basketball holder 122 when the basketball holder 122 is in the second position. The sensors 121 may be in electronic communication with the controller 154 to determine the position, operating status, or the like, of the basketball holder 122 or other components. Any number of sensors 121 of any kind for any number of components may be utilized.

Figure 15:
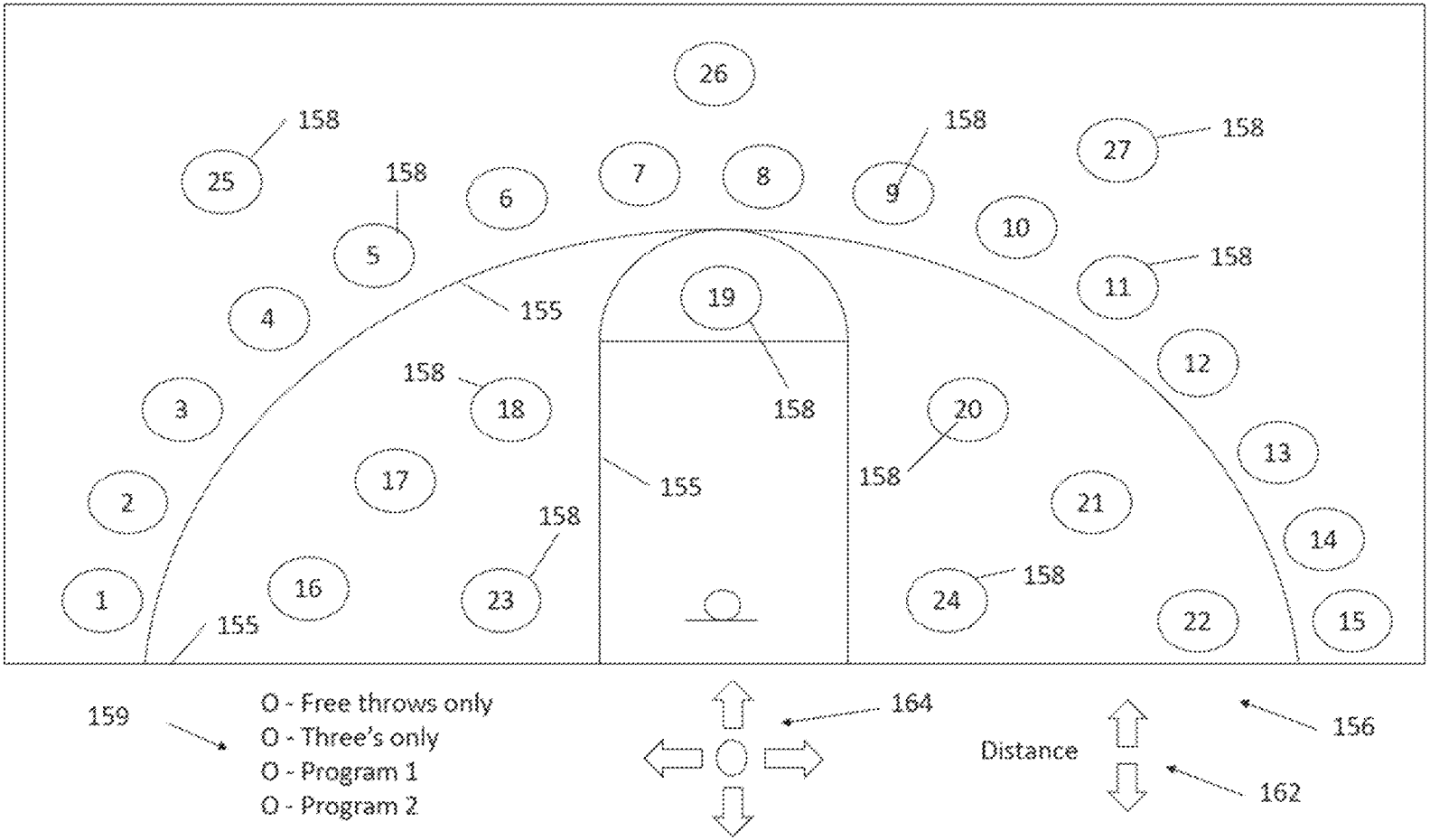
FIG. 15 is a plan view of an exemplary user interface for use with the basketball launching device and/or the distance adjustment mechanism of FIGS. 1-14.
Figure 16:
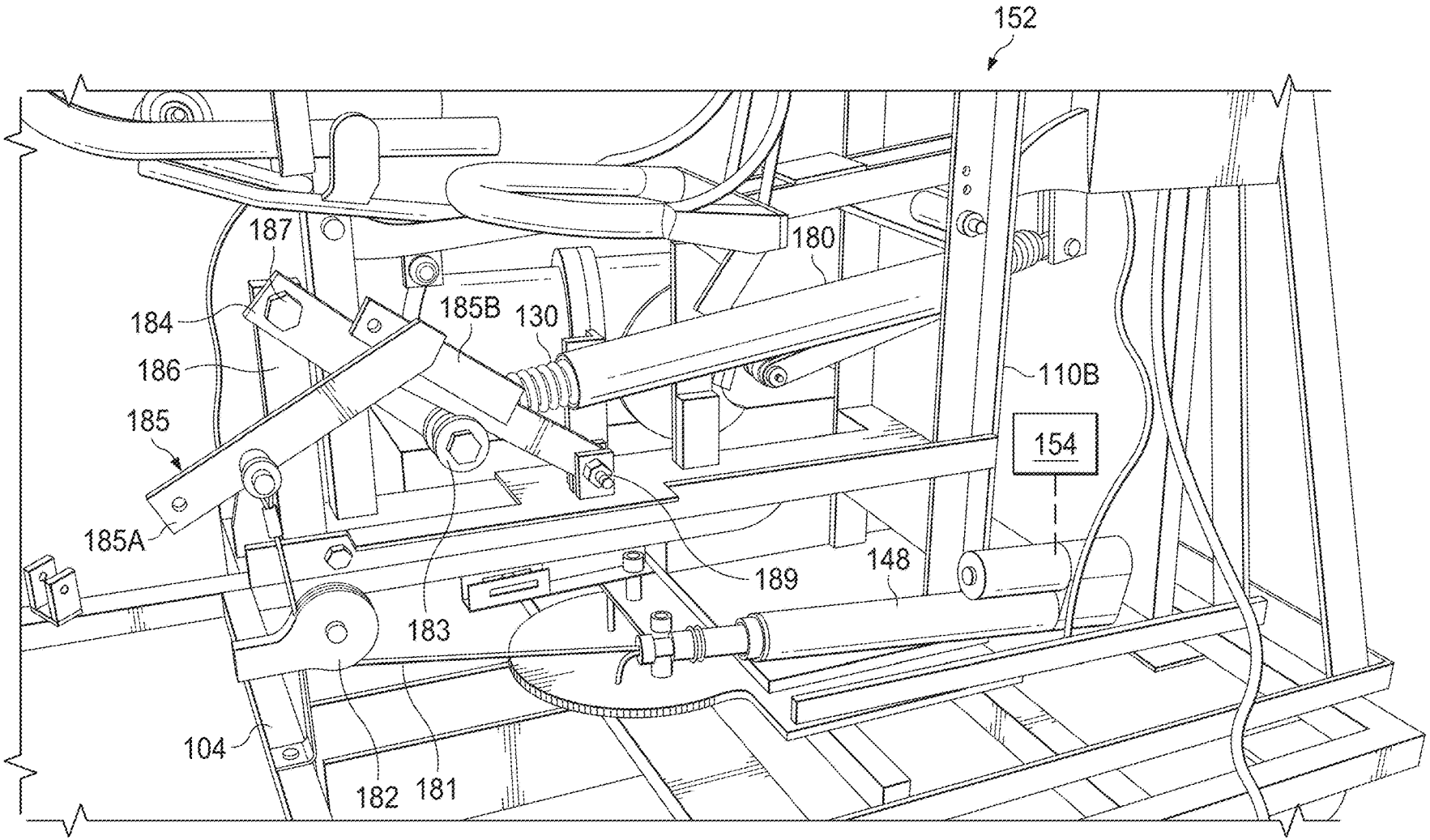
FIG. 16 is a left side view of a portion of the basketball launching device of FIG. 1 with another exemplary distance adjustment mechanism in a first position.
Figure 17:
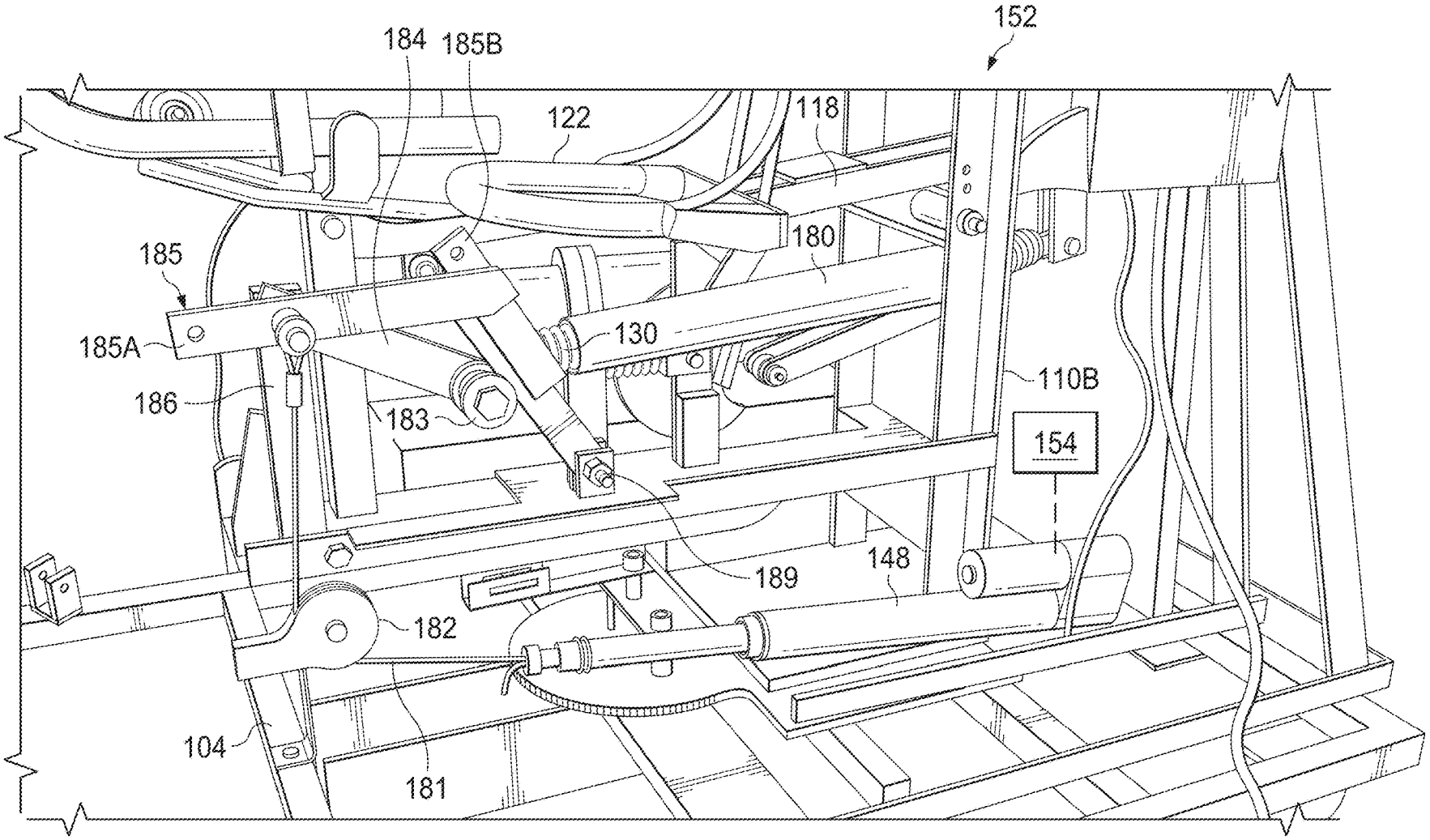
FIG. 17 is a left side view of a portion of the basketball launching device and distance adjustment mechanism of FIG. 16 in a second position.
Figure 18:
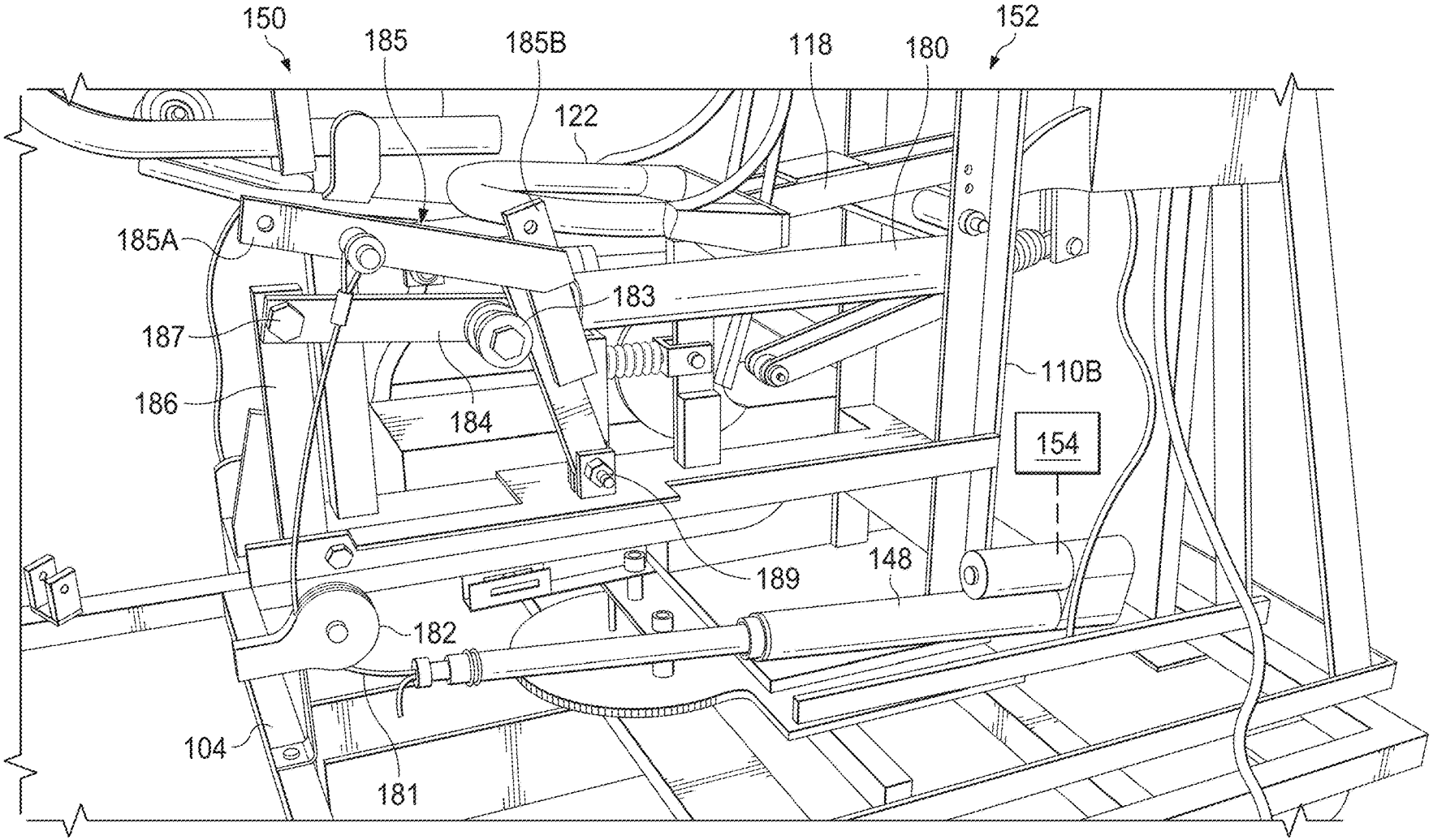
FIG. 18 is a left side view of a portion of the basketball launching device and distance adjustment mechanism of FIG. 16 in a third position.
Figure 19:
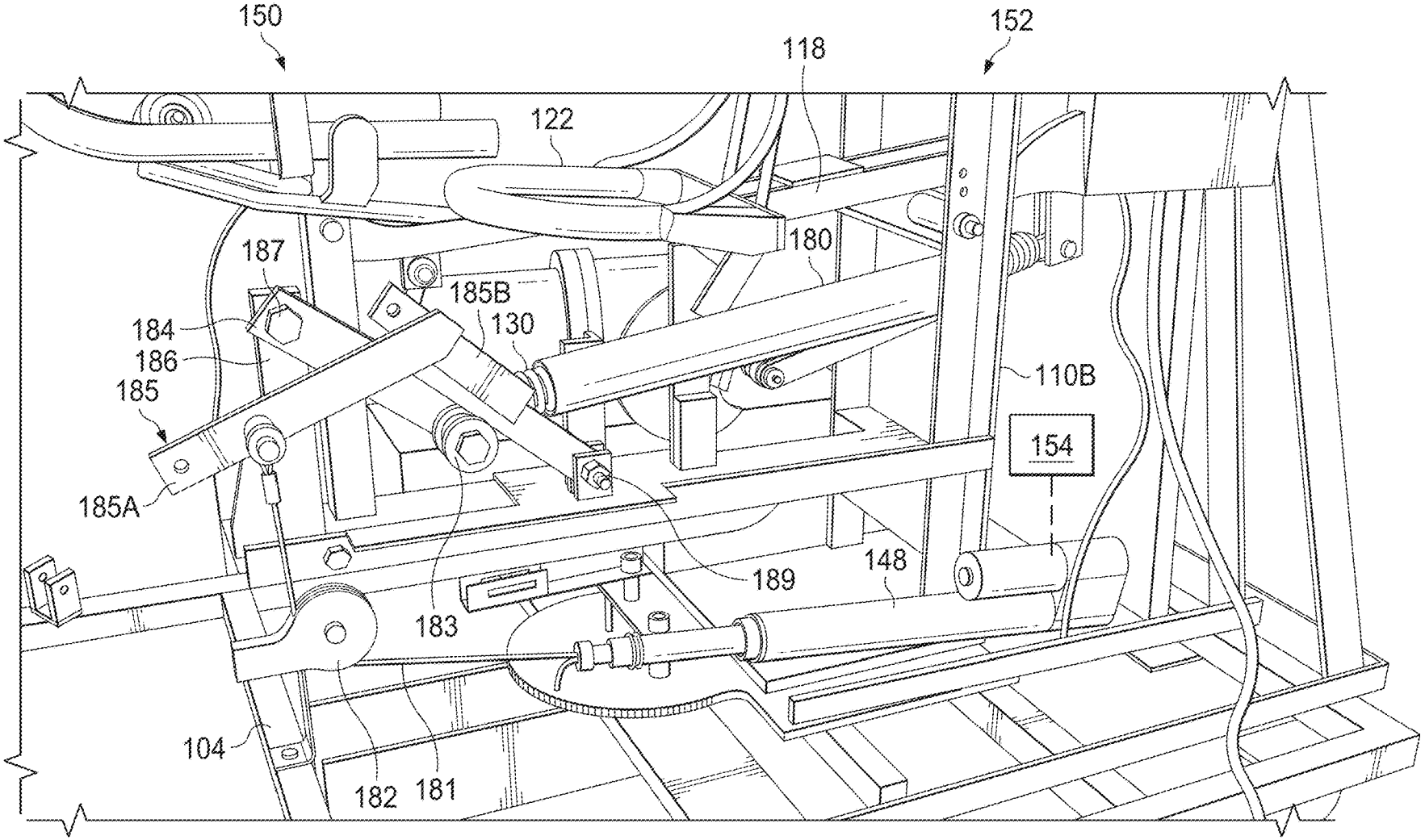
FIG. 19 is a left side view of a portion of the basketball launching device and distance adjustment mechanism of FIG. 16 in a fourth position.
Figure 20:
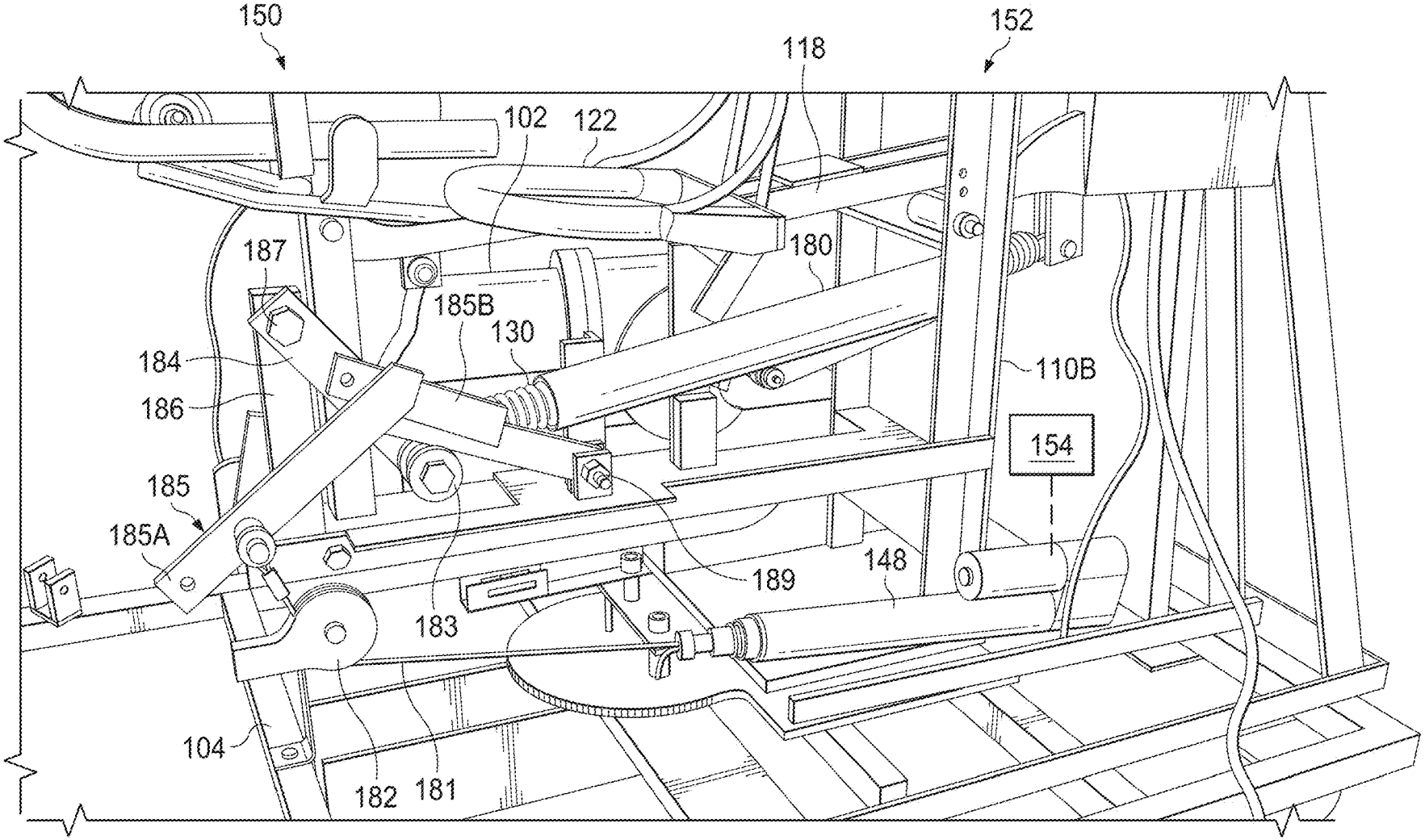
FIG. 20 is a left side view of a portion of the basketball launching device and distance adjustment mechanism of FIG. 16 in a fifth position.
Figure 21:
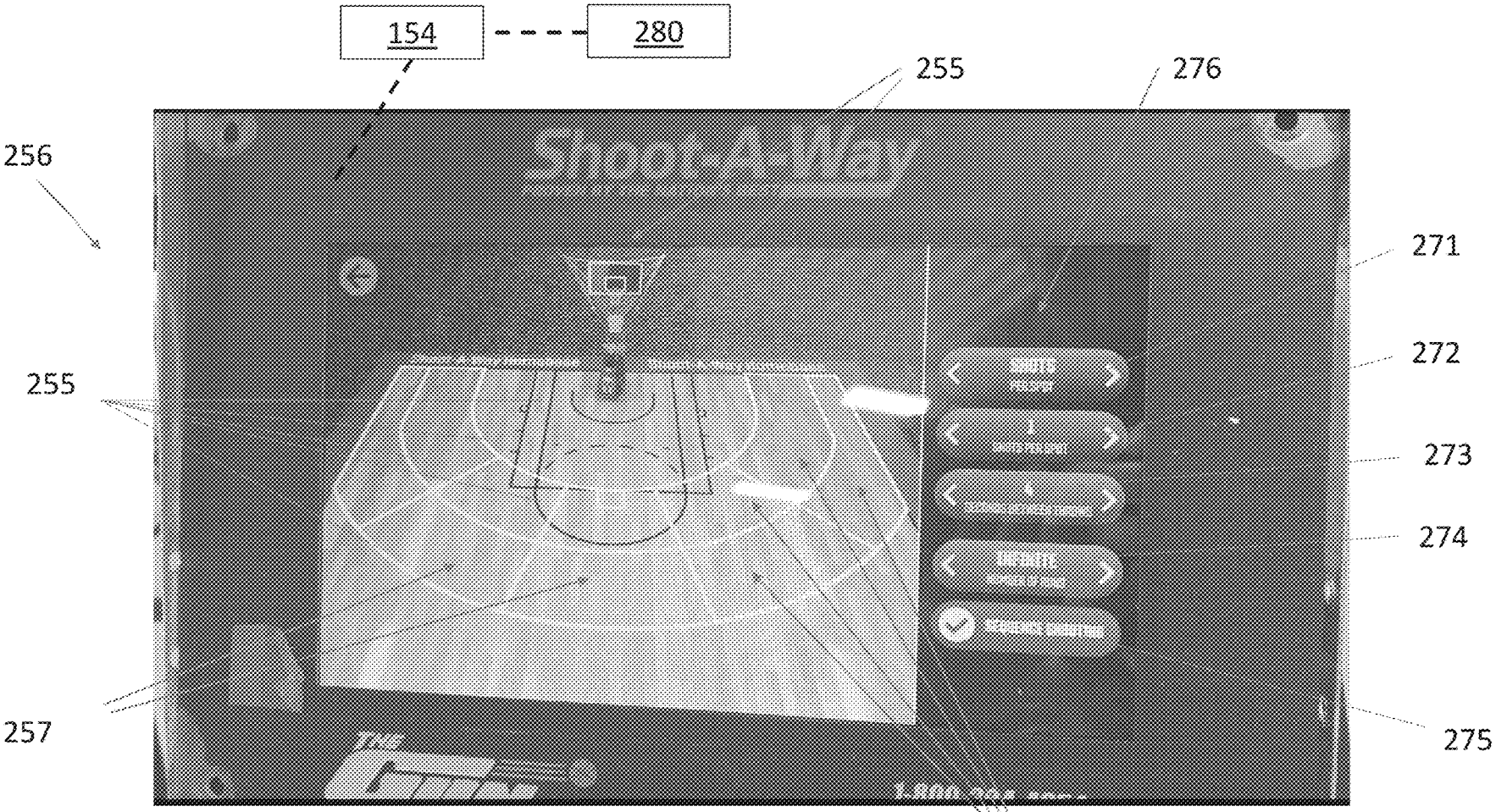
FIG. 21 is a front view of another exemplary user interface for use with the basketball launching device and/or the distance adjustment mechanism of FIGS. 1-20.
Figure 22:
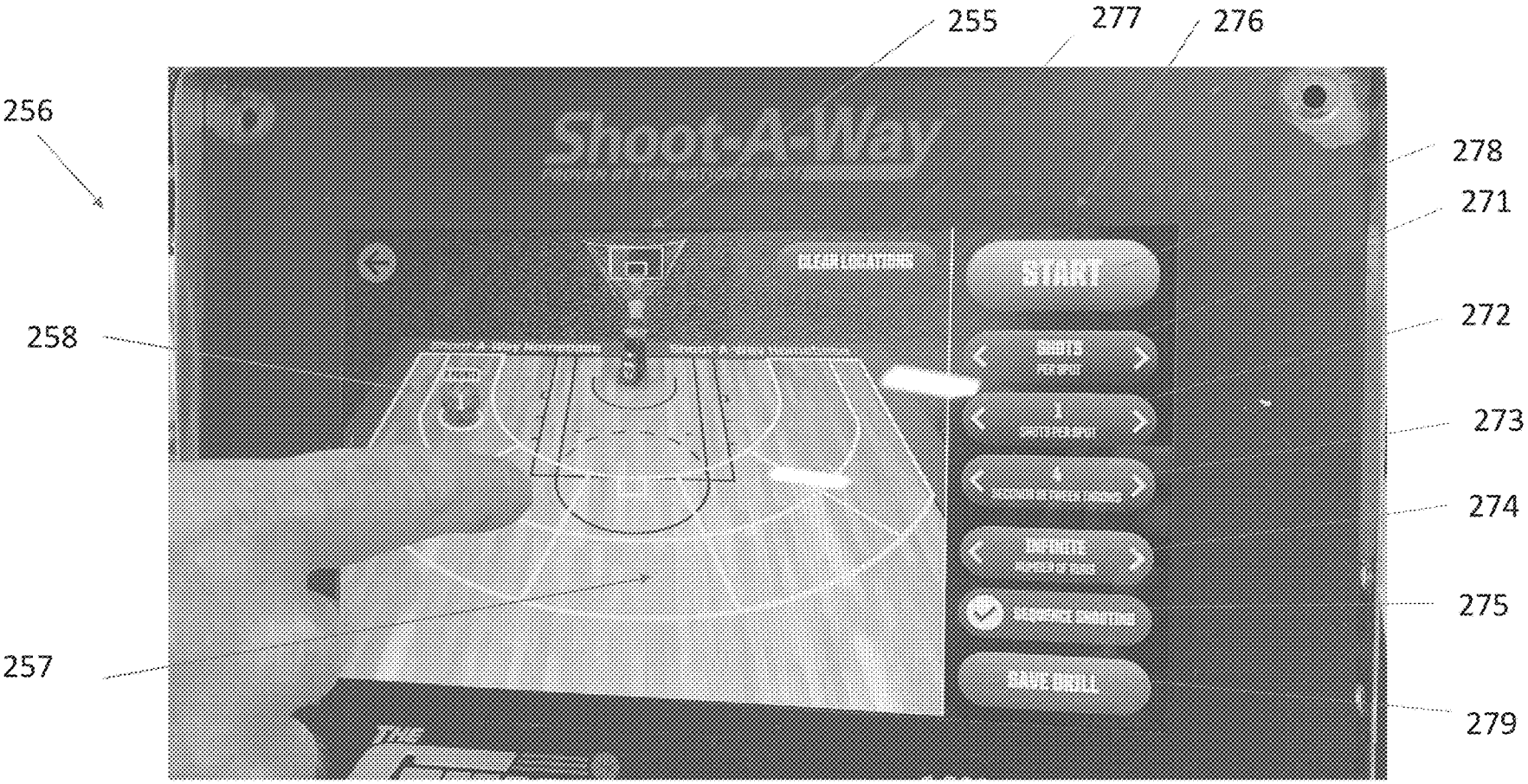
FIG. 22 is a front view of the exemplary user interface of FIG. 21 displaying results of exemplary user interaction.
Figure 23:
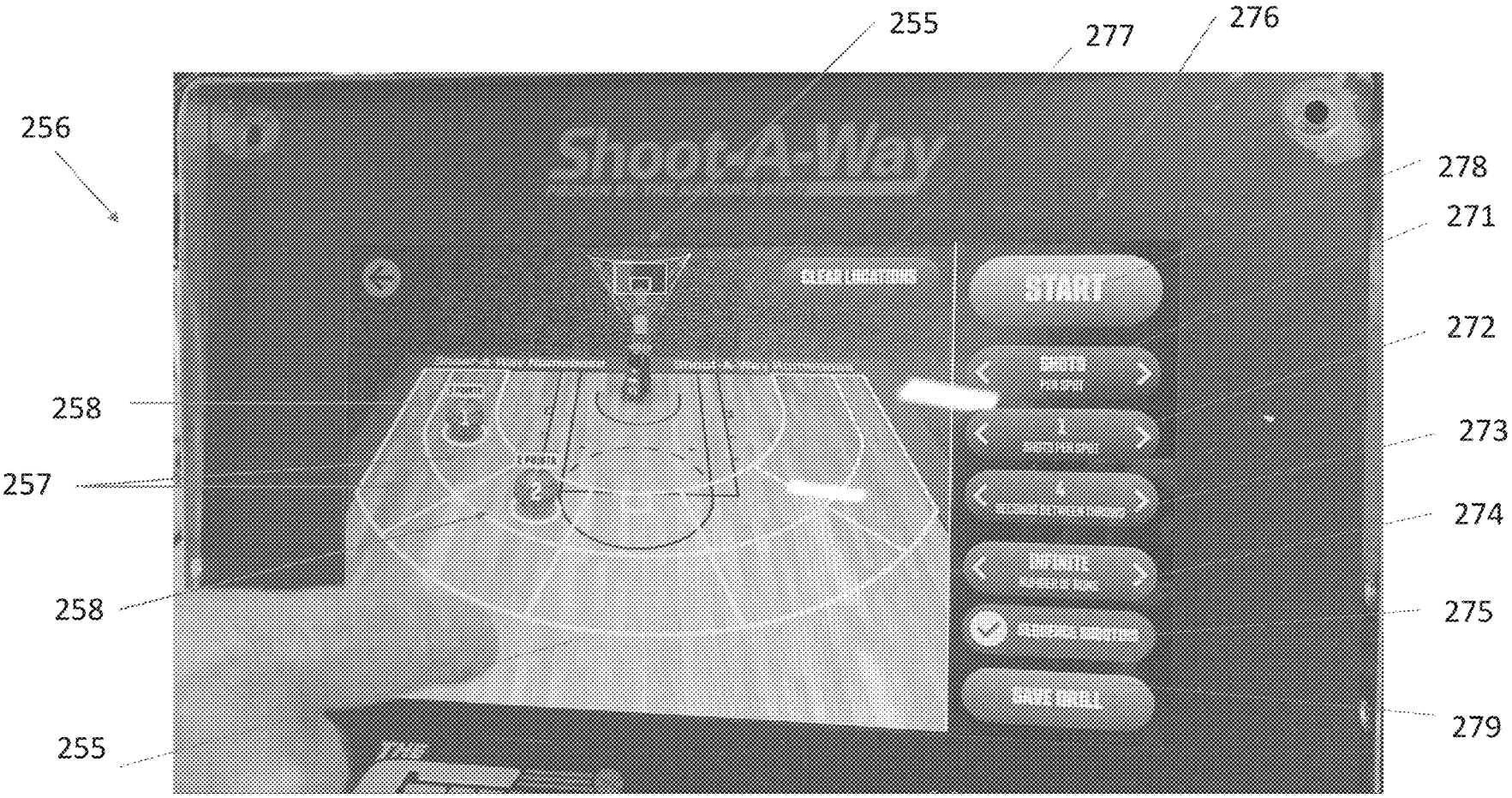
FIG. 23 is a front view of the exemplary user interface of FIG. 21 following exemplary user interaction.
Figure 24:
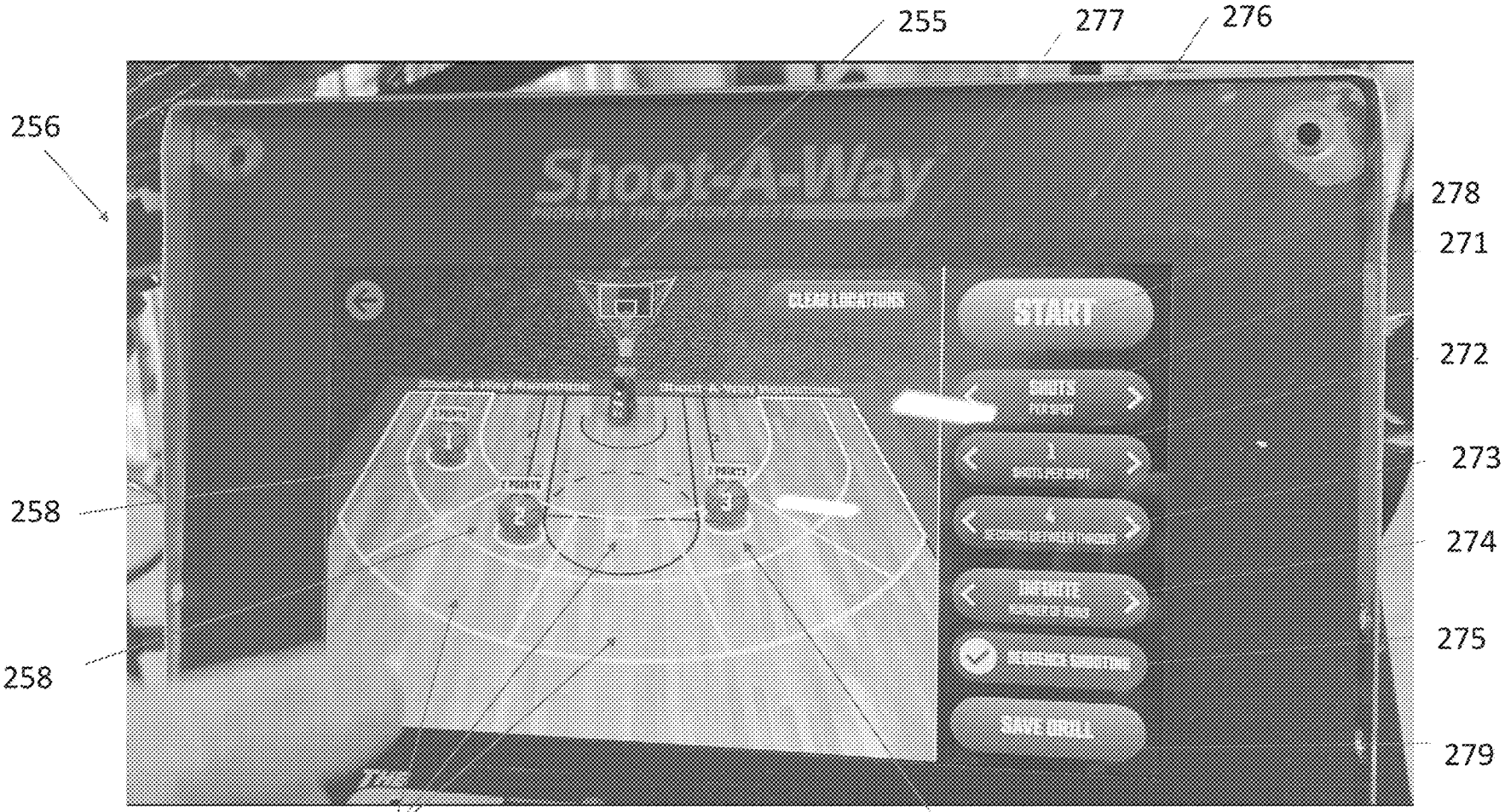
FIG. 24 is a front view of the exemplary user interface of FIG. 21 following exemplary user interaction.

FIG. 15 illustrates an exemplary user interface 156 for use with the basketball launching device 100 and/or the automatic distance adjustment mechanism 152. The movement imparting mechanism 148 may be in electronic communication with a controller 154. Alternatively, or additionally, the motor 102 may be in electronic communication with the controller 154. The controller 154 may be in electronic communication with a user interface 156.

The user interface 156 may be configured to receive user input regarding a basketball practice routine. The user input may be used to program the rebounding machine 200. For example, without limitation, the user input may indicate one or more locations on a basketball playing area the user desires to receive basketball passes. In exemplary embodiments, the user interface may comprise a number of selectable pass receipt locations 158. The user interface 156 may comprise a rendering 155 of a basketball playing area. The rendering 155 may comprise, for example without limitation, a baseline, a half court line, a key, a free throw line, a basketball hoop, one or more sidelines, some combination thereof, or the like. The selectable pass receipt locations 158 may be arranged about the rendering 155, though such is not required. The user input may comprise selection of one or more of the selectable pass receipt locations 158. The user input received at the user interface 156 may be transmitted to the controller 154 which may program the basketball launching device 100 and/or the automatic distance adjustment mechanism 152 to launch basketballs according to the received user input.

Alternatively, or additionally, the user interface 156 may be configured to permit selection of one or more pre-programmed collections of pass receipt locations 158. For example, without limitation, a collections selector 159 may permit for certain pre-programmed exercises to be quickly programmed. The collections selector 159 may comprise options for selecting custom routines created by user input at the selectable pass receipt locations 158, such as but not limited to, frequently used or preferred practice routines for quick access by the user.

The user interface 156 may be configured to permit the user to select the distance the basketballs are to be passed. The distance selection may be made by way of the selectable pass receipt locations 158 such that the basketballs are thrown relatively further when a selectable pass receipt location 158 located a relatively further distance is selected, and relatively closer when a selectable pass receipt location 158 located a relatively closer distance is selected. Proximity may be determined in relation to a rendering of the basketball hoop, the rebound machine 200, the baseline, or other location of the user interface 156. Alternatively, or additionally, a distance selection tool 162 may be provided.

User input may be received at the use interface 156 and transmitted to the controller 154. The controller 154 may transmit instructions to the basketball launching device 100 for launching the basketballs based on the received user input. The controller 154 may transmit instructions to the automatic distance adjustment mechanism 152 to adjust the tension in the spring 130 based on the received user input so as to adjust the distance the basketballs are launched.

The user interface 156 may comprise a panel. The selectable pass receipt locations 158 may comprise mechanical buttons. In other exemplary embodiments, the user interface 156 may comprise a touch panel. The selectable pass receipt locations 158 may comprise marking or indicia at the touch panel. In other exemplary embodiments, the selectable pass receipt locations 158 may comprise lights or other indicatable marking, selection of which is made by way of a selection tool 164. In such embodiments, the user interface 156 may comprise a panel and/or an electronic display. Each of the selectable pass receipt locations 158 may be marked with a number or other indicator, though such is not required. The illustrated user interface 156, including but not limited to, the type, shape, size, number, and location of the selectable pass receipt locations 158, the rendering 155, the distance selection tool 162, the selection tool 164, the collections selector 159, are merely exemplary and are not intended to be limiting. Any type, shape, size, number, and location of such features may be utilized.

FIG. 16 through FIG. 20 illustrate another exemplary automatic distance adjustment mechanism 152. The movement imparting mechanism 148 may be connected to the spring 130 by way of one or more linkages. In exemplary embodiments, the spring 130 may be partially or fully encased within a sleeve 180. The sleeve 180 may help to prevent the spring 130 from catching on other components of the basketball launching device 100, such as when the spring 130 is compressed and/or stretched. The sleeve 180 may further comprise lubricating materials configured to help preserve and/or facilitate movement of the spring 130.

The spring 130 may be connected to the catapult arm 118 at a first end. The spring 130 may be connected to a first linkage 184 at a second end. The first linkage 184 may be pivotably connected to the mounting structure 104 at a first pivoting connector 187. In exemplary embodiments, the first linkage 184 is connected to the mounting structure 104 at a post 186. The first pivoting connector 187 may comprise one or more pins, bearings, fasteners, combinations thereof, or the like. The first linkage 184 may comprise a rigid, straight line member though any size, shape, type, and number of members may be utilized. In exemplary embodiments, the first linkage member 184 may serve as the tension adjustment member 126.

The spring 130 may be connected to the first linkage 184 at a first end thereof. In exemplary embodiments, the spring 130 may be connected to the first linkage 184 at a protrusion 183, though such is not required. The protrusion 183 may be configured for mechanical interaction with a second linkage 185, such as during movement of said first linkage 184 and/or said second linkage 185. The protrusion 183 may comprise a guide, wheel, post, or the like which contacts and may move and/or guide movement of the second linkage 185.

The second linkage 185 may be pivotally connected to the mounting structure 104 at a first end, such as by way of a second pivoting connector 189. The second pivoting connector 189 may comprise one or more pins, bearings, fasteners, combinations thereof, or the like. The second linkage 185 may comprise two or more rigid members connected to one another at a non-linear angle, such as but not limited to, substantially 135 degrees though any non-linear angle may be utilized. The second linkage 185 may provide a surface for the protrusion 183 to physically interact with and/or travel. The second linkage 185 may, alternatively or additionally, provide an upper barrier to prevent the protrusion 183 from traveling too far. In exemplary embodiments, the second linkage 185 may comprise at least a first component 185A and a second component 185B. The first and second components 185A, B may be fastened, welded, bonded, adhered, or otherwise joined together. The first and second components 185A, B may be joined together at said non-linear angle, such as but not limited to substantially 135 degrees, though any non-linear angle may be utilized. Any number of components at the same or different linear or non-linear angles may be utilized to form the first and/or second linkages 184, 185.

A flexible member 181 may be connected to a second end of the second linkage 185. The flexible member 181 may comprise a cable, rope, spring, wire, combination thereof, or the like. One or more pulleys 182 may be connected to the support structure 104 or another member. The pulley(s) 182 may be configured to redirect movement of the flexible member 181 from a substantially vertical direction to a substantially horizontal direction. The pulley(s) 182 may change directions of the force and/or provide mechanical advantages. In exemplary embodiments, the pulley(s) 182 may be provided as one or more blocks and multiple loops of the flexible member 181 may extend between the movement imparting mechanism 148 and the pulley(s) 182 and/or the second pivoting linkage 185 to provide certain mechanical advantages.

A second end of the flexible member 181 may be connected to the movement imparting mechanism 148. The movement imparting mechanism 148 may be positioned substantially horizontally, such as along a lower portion of the basketball launching device 100. This may provide a more compact design for the basketball launching device 100. In other exemplary embodiments, other linkages may be used such as but not limited to chains and gears, levers, cams, combinations thereof, or the like. Alternatively, a direct connection between the movement imparting mechanism 148 and the second pivoting linkage 185 may be provided.

In exemplary embodiments, the movement imparting mechanism 148 may be selectively lengthened, thereby allowing the second linkage 185 to advance, such as in a clockwise fashion about the second pivoting connector 189, which permits the first linkage 184 to advance, such as in a counterclockwise fashion about the first pivoting connector 187, from a first position (see FIG. 16) to a second (see FIG. 17) and third position (see FIG. 18) which results in the spring 130 decreasing in length. This decreases the amount of force applied by the spring 130 against the catapult arm 118, thereby decreasing the distance the basketball is launched if otherwise unimpeded. Similarly, the movement imparting mechanism 148 may be shortened, thereby causing the second linkage 185 to retract, such as in a counterclockwise fashion about the second pivoting connector 189, which permits the first linkage 184 to retract, such as in a clockwise fashion about the first pivoting connector 187, from the third position (see FIG. 18) to a fourth (see FIG. 19) and fifth position (see FIG. 20) which results in the spring 130 increasing in length. This increases the amount of force applied by the spring 130 against the catapult arm 118, thereby increasing the distance the basketball is launched if otherwise unimpeded. Control of the movement imparting mechanism 148 may be accomplished by the controller 154 which may be in electronic communication (wired or wireless) with the movement imparting mechanism.

The various linkage members shown and/or described herein, such as but not limited to, the first linkage 184 and/or the second linkage 185 may be formed from multiple connected members or a single, integrally formed member. For example, without limitation, where multiple members are used, such members may be fastened, welded, bonded, adhered, combinations thereof, or the like.

FIG. 21 through FIG. 30 illustrates another exemplary user interface 256. The user interface 256 may be configured for use with the rebound machine 200, such as but not limited to, for use with the basketball launching device 100 and/or the automatic distance adjustment mechanism 152. The controller 154 may be in electronic communication with a user interface 256, which may place the user interface 256 in electronic communication with the movement imparting mechanism 148 and/or the motor 102 to control where the basketballs are launched on the basketball playing area. Other power sources may be used as alternatives to, or in addition to, the movement imparting mechanism 148 and/or the motor 102. The power source may be sufficient to cock and release a throwing mechanism for a basketball and/or adjust the distance a basketball is launched.

The user interface 256 may comprise a touch screen in exemplary embodiments. In other exemplary embodiments, the user interface 256 may comprise an electronic display, panel, combinations thereof, or the like. The user interface 256 may comprise one or more visual depictions 255 of certain elements of the basketball playing area, including but not limited to, a court, sidelines, a base line, key, foul line, restricted area arc, lane lines, combinations thereof, or the like. The visual depictions 255 may reflect any now developed or future developed court designs, regulations, or the like. The visual depictions 255 may, alternatively or additionally, comprise renderings of the rebound machine 200 and/or a basketball goal. The visual depictions 255 may be configured to provide a realistic simulation of an exemplary basketball playing surface including any such elements thereof, though cartoons or other graphical representations may be utilized.

A number of selection areas 257 may be positioned about the user interface 256 and may be defined, at least in part, by the visual depictions 255. The user interface 256 may be configured to receive user input indicating selection of pass receipt locations where the user desires to receive basketball passes as part of a custom basketball practice routine. In exemplary embodiments, each such pass receipt location and/or selection of the same may be represented by an icon 258 displayed at the user interface 256. For example, without limitation, the pass receipt locations may be represented by icons 258 which are displayed to represent pass receipt locations available for selection by the user. As another example, without limitation, the visual depictions 255 may be provided at the user interface 256 without the icons 258, and the icons 258 may instead be generated upon selection of an area of the user interface 256 corresponding to a location at the playing area the user desires to receive a basketball pass.

In exemplary embodiments, user selection anywhere within a given one of the selection areas 257 may cause the user interface 256 to record the user's desire to receive a pass at the given selection area 257. Upon such selection, an icon 258 may be generated and displayed at substantially the position selected by the user. The icon 258 may indicate the approximate position of the user selection. The icon 258 may indicate to the user where to stand to receive a corresponding basketball pass from the rebound machine 200.

The icon 258 may be provided in the form a graphic of a basketball, though any type or kind of icon 258 may be utilized. The same or different icons 258 may be used for each location and/or selection. The icon 258 may comprise pass and/or shooting information including, for example without limitation, a number of points associated with shots taken in association with the programmed pass, the number of the pass or position within the shooting sequence or program (e.g., the first location where one or more basketballs will be set, the second such location, etc.), a type of basketball shot to be taken at the location (e.g., jumper, stationary, off dribble, layup, fade away, or the like).

In exemplary embodiments, without limitation, user selection of any point within a given selection area 257 may be configured to cause the rebound machine 200 to launch a basketball to a single, common point on the basketball playing area corresponding with the given selection area 257. So, for example without limitation, if two pass receipt locations are selected within the given selection area 257, two passes may be made to substantially the same pass receipt location at the basketball playing area, even if two separate icons 258 are provided at two different locations. In this way, programming and operation of the rebound machine 200 may be simplified.

In other exemplary embodiments, the selection areas 257 may be provided solely for user convenience and reference and the basketballs may be passed approximately to their respective location on the basketballs playing area corresponding with selected pass receipt locations. So, for example without limitation, if two pass receipt locations are selected within a given selection area 257, two passes may be made to different locations within the same pass receipt location at the basketball playing area, such as to substantially where the icons 258 appear. In this way, programming and operation of the rebound machine 200 may be made more precise.

The user interface 256 may be configured to receive a user selection of pass receipt locations on the basketball playing surface for the launcher to pass the basketballs to. User selection may be made by direct, physical touch, such as by use of a touch screen or a panel with physically depressible buttons, or by way of one or more tools, such as but not limited to, the selection tool 164 shown and/or described with respect to FIG. 15. Various pass receipt locations about the user interface 256 may be selected by the user. The pass receipt locations may be selected with reference to one or more elements of the visual depiction 255 and may be graphically represented by icons 258 so that the user knows where to stand on the actual basketball playing area to receive the corresponding passes. For example, without limitation, if the user selects a pass receipt location near the foul line, one of the icons 258 may be generated on the user interface 256 near the foul line, and the user may then stand near the foul line (real or imaginary) to receive a corresponding pass. Any number and pass receipt locations may be selected to create one or more customized basketball practice routines.

The pass receipt locations selected by the user may be displayed as icons 258 and updated as they are selected. For example, without limitation, the icons 258 may be already displayed and may be illuminated, colorized, highlighted, changed, or otherwise altered upon selection. Alternatively, no icons 258 may be displayed and the user's touch at a given point may cause an icon 258 to be displayed upon selection. For example, without limitation, the icon 258 may appear upon selection.

The icons 258 may comprise a number, alphanumeric character, or other representation corresponding to the order in which the passes will be made (e.g., the first pass going to the icons 258 labeled with a "1", "A", or the like, the second pass to the icon 258 labeled "2", "B", or the like, and so forth). Initially, the icons 258 may be labeled with an order based on the order they were selected. The icons 258 may be labeled with a corresponding score to be recorded if a shot is successfully made from a pass associated with the icons 258. In exemplary embodiments, the points vary based on distance from the visual depiction 255 of the rebound machine 200 and/or the basketball goal. For example, without limitation, two points may be recorded for all pass receipt locations in front of the visual depiction 255 of the three-point line and three points may be recorded for all pass receipt locations behind the visual depiction 255 of the three-point line, though any scoring scheme may be utilized. In exemplary embodiments, such a determination may be made by which of the selection areas 257 are selected. The selection areas 257 may be physically or electronically separated, however, in exemplary embodiments such is not required.

FIGS. 21-30 illustrate exemplary programming of three exemplary pass receipt locations at the user interface 256. The user interface 256 may be configured to permit revision of the pass receipt locations after their initial selection, such as before the rebound machine 200 begins launching the basketballs, during the practice session, or after the practice session is completed. For example, without limitation, a given one of the icons 258 may be moved from an initial pass receipt location to a new pass receipt location. Such movement may be accomplished by a touch and drag technique. Such movement may, alternatively or additionally, be accomplished by a tap and drag technique, taping motion, swipe, click and drag technique, press and drag technique, combinations thereof, or the like. Regardless, the movement may be reflected by moving the icons 258 at the user interface 256.

Figure 25:
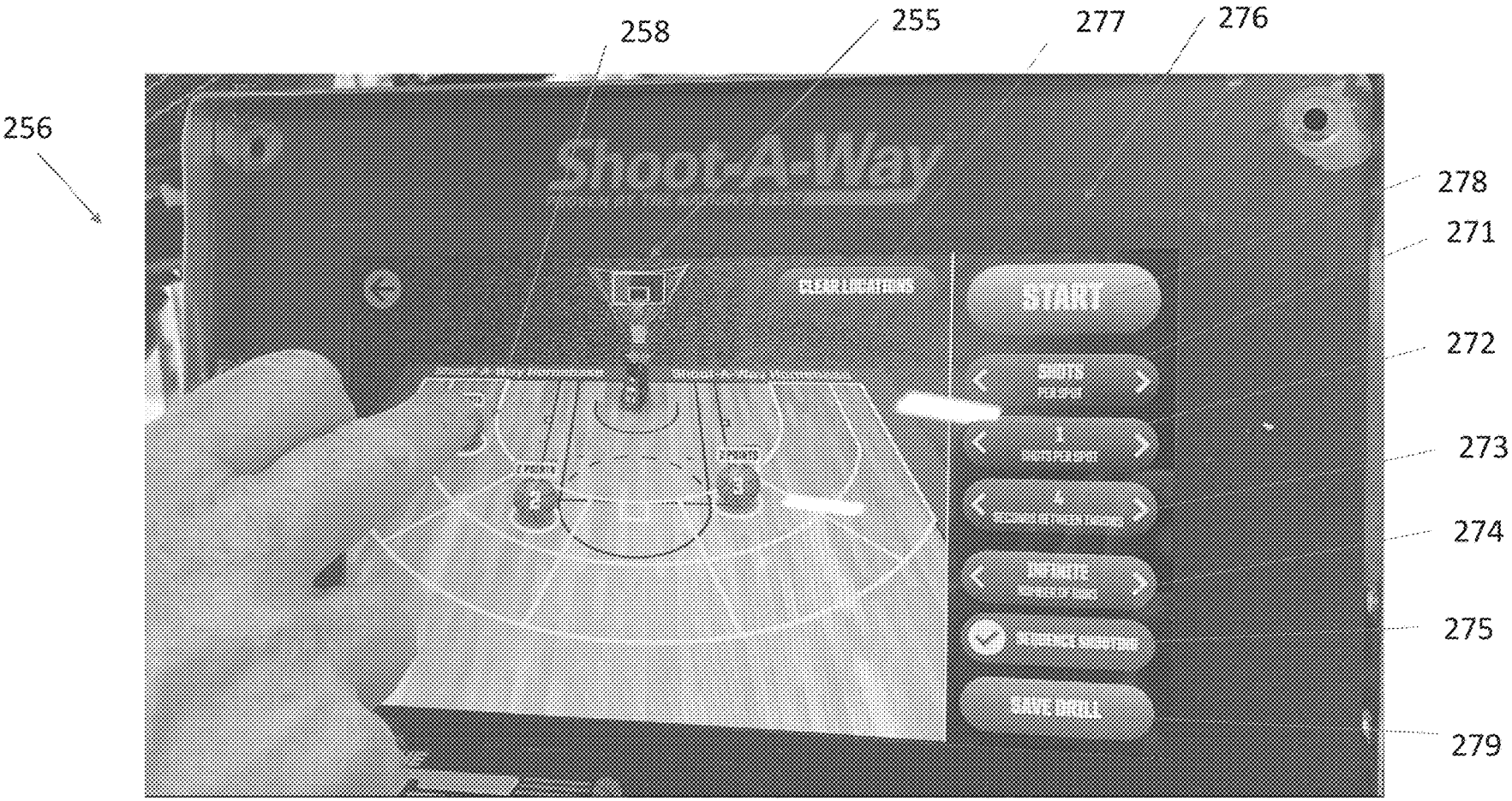
FIG. 25 is a front view of the exemplary user interface of FIG. 21 following exemplary user interaction.
Figure 26:
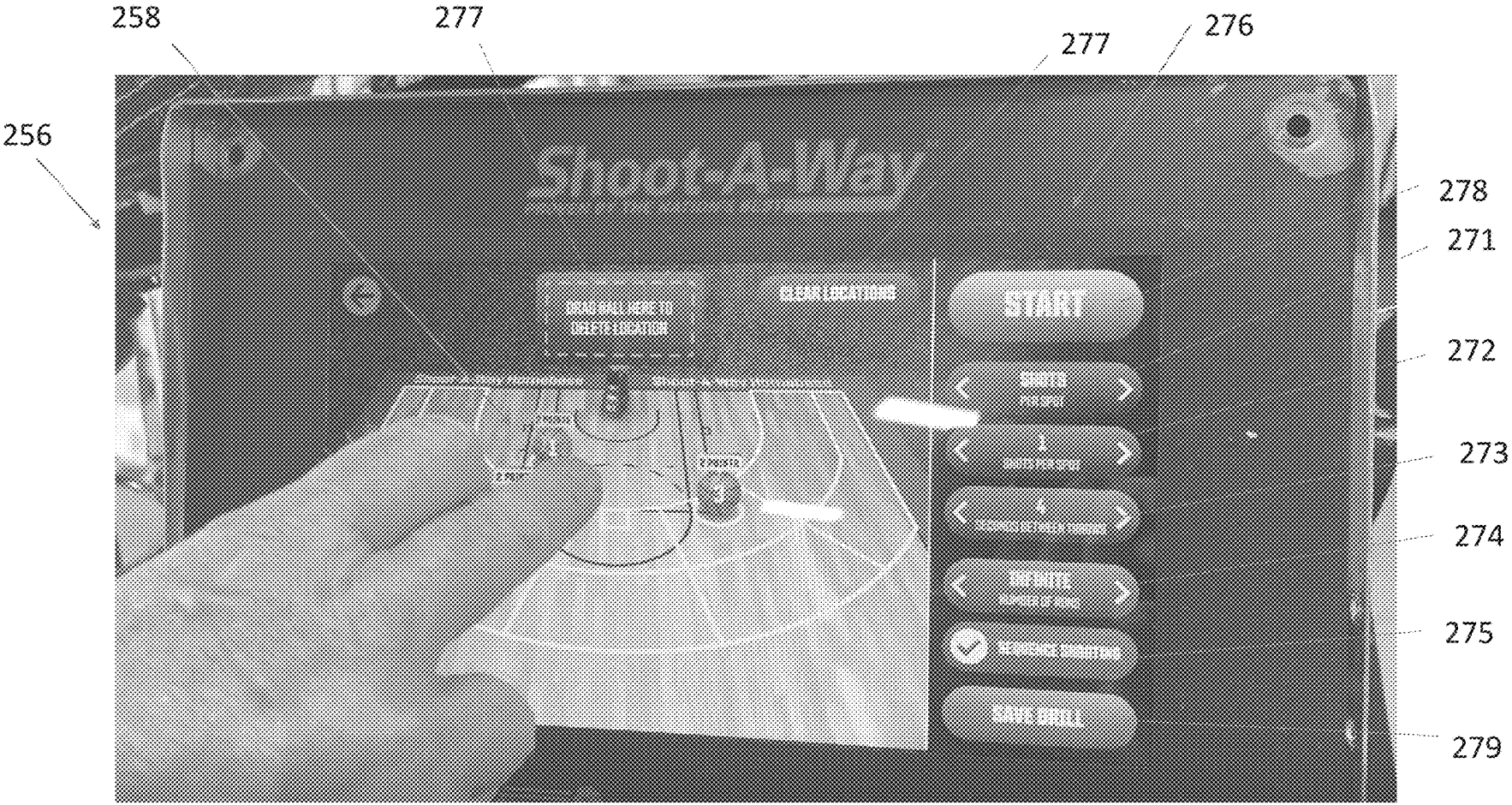
FIG. 26 is a front view of the exemplary user interface of FIG. 21 following exemplary user interaction.
Figure 27:
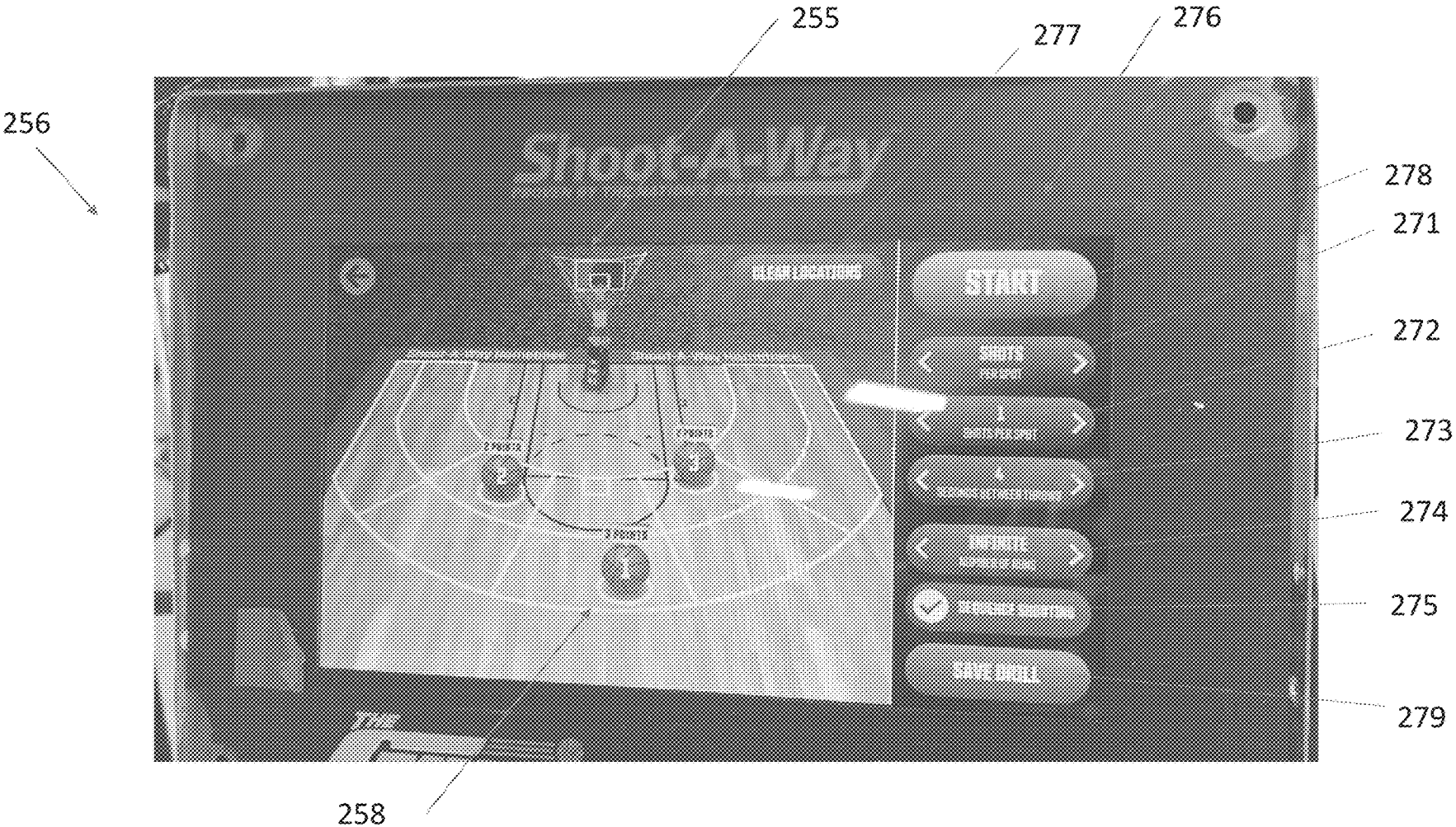
FIG. 27 is a front view of the exemplary user interface of FIG. 21 following exemplary user interaction.
Figure 28:
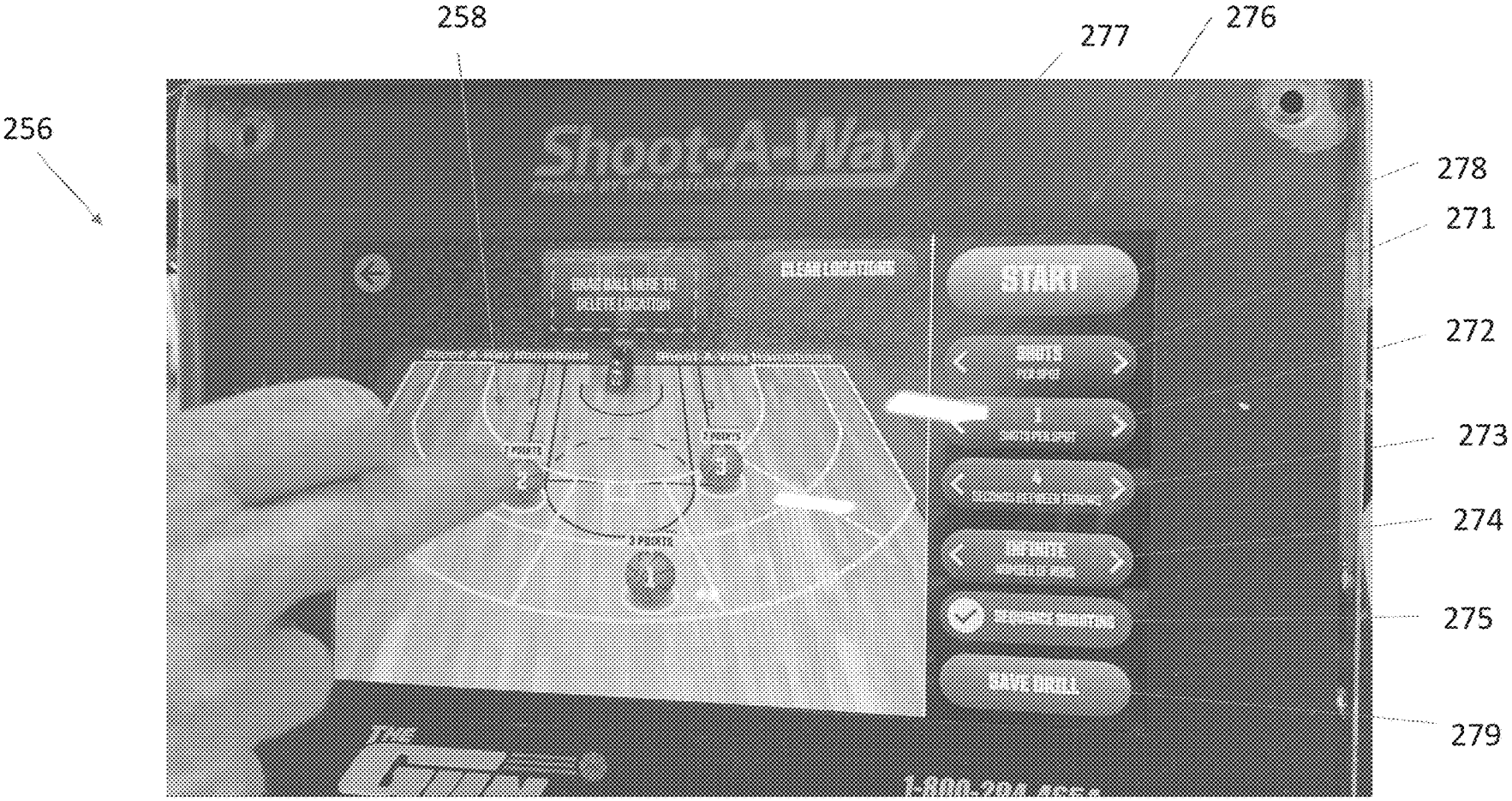
FIG. 28 is a front view of the exemplary user interface of FIG. 21 following exemplary user interaction.
Figure 29:
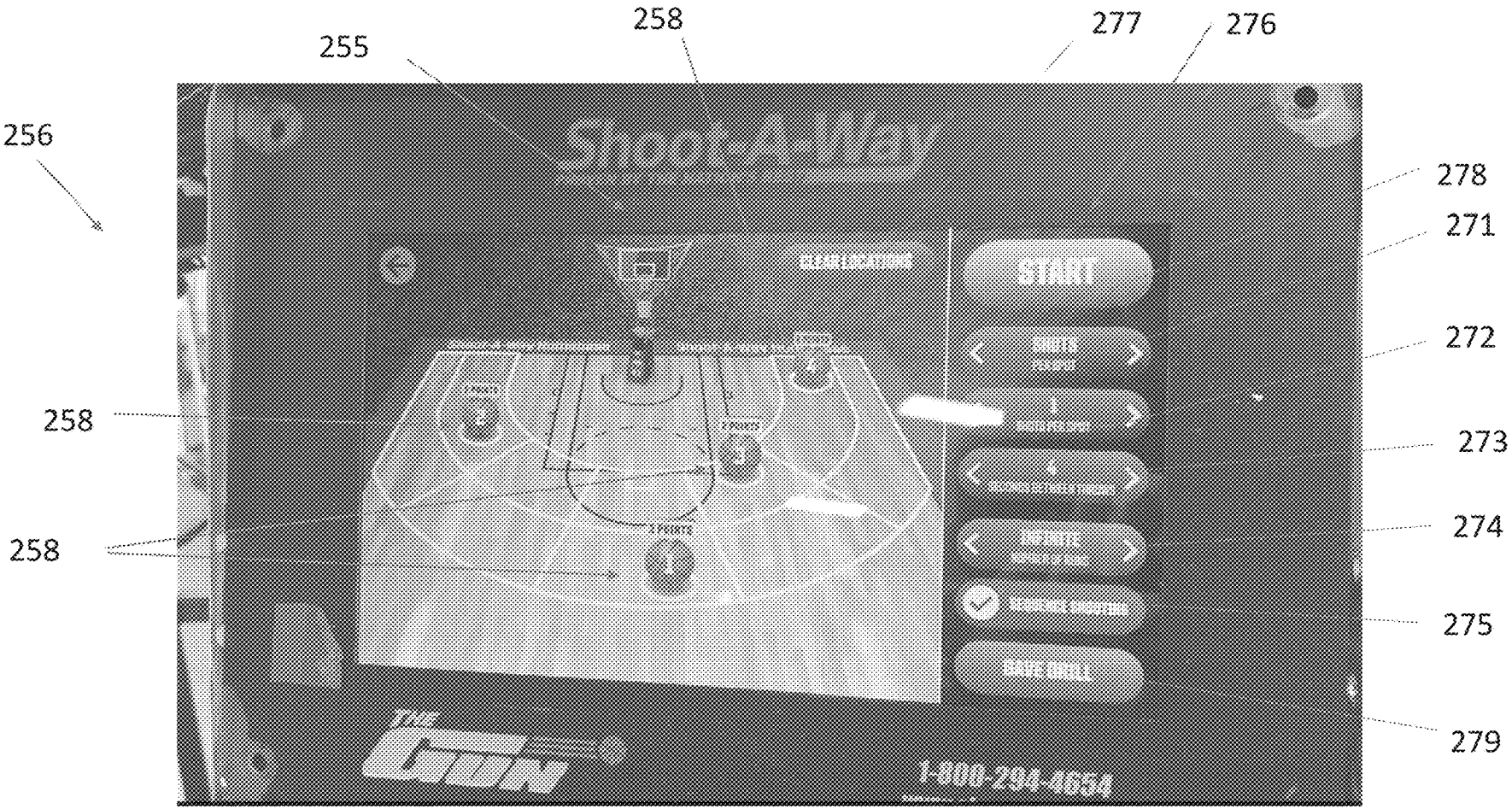
FIG. 29 is a front view of the exemplary user interface of FIG. 21 following exemplary user interaction.

FIGS. 25-27 show the movement of a first pass receipt locations, as represented by one of the icons 258, from an initial spot on the left side of the key to a new spot near the top of the key. FIGS. 25-27 illustrate the user interface 256 updating the first pass receipt locations from two points to three points based on the locations of the representative icon 258 relative to the visual depictions 255. FIGS. 28-29 illustrate, for example without limitation, movement of a second one of the pass receipt locations and addition of a fourth pass receipt locations, as represented by the icons 258. Any technique for moving the pass receipt locations may be utilized. The user interface 256 may be used to create a vast number of custom practice routines.

A delete tool 277 may be provided to remove the selected one of the pass receipt locations. The delete tool 277 may be displayed or otherwise provided only upon selection of one or more of the icons 258 in exemplary embodiments through such is not required. The delete tool 277 may comprise a defined area where the icons 258 for the pass receipt locations may be moved and result in its removal from the custom practice routine. In other exemplary embodiments, the delete tool 277 may normally be displayed or otherwise provided.

An options menu 276 may be provided at the user interface 256. In exemplary embodiments, the options menu 276 may be positioned adjacent to the visual depictions 255, though any location may be utilized. The options menu 276 may comprise a practice style option 271. The practice style option 271 may permit the user to choose between a number of programming options including, but not limited to, creation of a custom drill, use of a pre-programmed drill, a shots per location option, a makes in a row option, a made shots options, or the like. In the makes option, the controller 154 may program the rebound machine 200 to require indication of a number of shots made at a given selected pass receipt location before the rebound machine 200 moves to the next selected pass receipt locations. In the makes in a row option, the controller 154 may program the rebound machine 200 to require indication of a number of shots in a row at a given selected pass receipt locations before the rebound machine 200 moves to the next selected pass receipt locations. In the shots per location option, the controller 154 may program the rebound machine 200 to launch the number of passes selected at a shots per location option 272 to a given one of the selected pass receipt locations before moving to the next selected pass receipt location. The shots per location option 272 may be updated to a number of made shots or number of made shots in a row option depending on the user selection made at the practice style option 271.

The indication of shots made or missed may be made by way of one or more detectors 280. The detector(s) 280 may be in electronic communication with the user interface 256 and/or the controller 154. The detector(s) 280 may be selectively associated with the basketball goal, such as but not limited to, attachable to the post, rim, backboard, combination thereof, or the like. Alternatively, or additionally, the detector(s) 280 may be mounted to portions of the basketball rebound machine 200. The detector(s) 280 may comprise photo eyes, microphones, cameras, image recognition software, combinations thereof, or the like. In exemplary embodiments, some or all of the sensors 121 may serve as the detector(s) 280.

The options menu 276 may comprise a timing option 273. The timing option 273 may permit the user to select a time delay between passes.

The options menu 275 may comprise a number of runs options 274. The number of runs options 274 may permit the user to select a number of times the rebound machine 200 progresses through all of the selected pass receipt locations before terminating the practice session.

The options menu 275 may comprise a sequence shooting option 275. The sequence shooting option 275 may permit the user to select between automatic renumbering of the order of the selected icons 258 or ability to program a non-serial order of the selected pass receipt locations, as represented by the icons 258. Where the sequence shooting option 275 is not selected, for example, the order of the pass receipt locations within the custom practice arrangements may by automatically renumbered, and the icons 258 updated accordingly, such that the basketballs are always passed in a particular order, such as but not limited to from right to left, left to right, closest to furthest, further to closest, etc. Where the sequence shooting option 275 is selected, the order of the pass receipt locations within the custom practice arrangement may remain unchanged such that they may be provided in a non-serial order.

After one or more pass receipt locations are selected, such as represented by the icons 258, a save option 279 may be provided at the options menu 276. The save option 279 may permit the user to save the created program for subsequent use. After one or more pass receipt locations are selected, such as represented by the appearance or selection of the icons 258, a start option 278 may be provided at the options menu 276. The start option 278 may permit the user to initiate the created program. In exemplary embodiments, selection of the start option 278 may cause the user interface 256 to communicate the selected pass receipt locations forming the custom practice arrangements to the launcher 100 and/or other components of the rebound machine 200, such as but not limited to, by way of the controller 154.

For those pass receipt locations further from the rebound machine 200, such as represented by the icons 258 further from the visual depiction 255 of the launcher or basketball goal, the rebound machine 200 may be configured to automatically launch basketballs with greater force (thus causing their normal passing distance to increase), such as by way of the automatic distance adjustment mechanism 152. Likewise, for those pass receipt locations closer to the rebound machine 200, such as represented by the icons 258 further from the visual depiction 255 of the launcher or basketball goal, the rebound machine 200 may be configured to automatically launch basketballs with less force (thus causing their normal passing distance to decrease), such as by way of the automatic distance adjustment mechanism 152.

Figure 30:
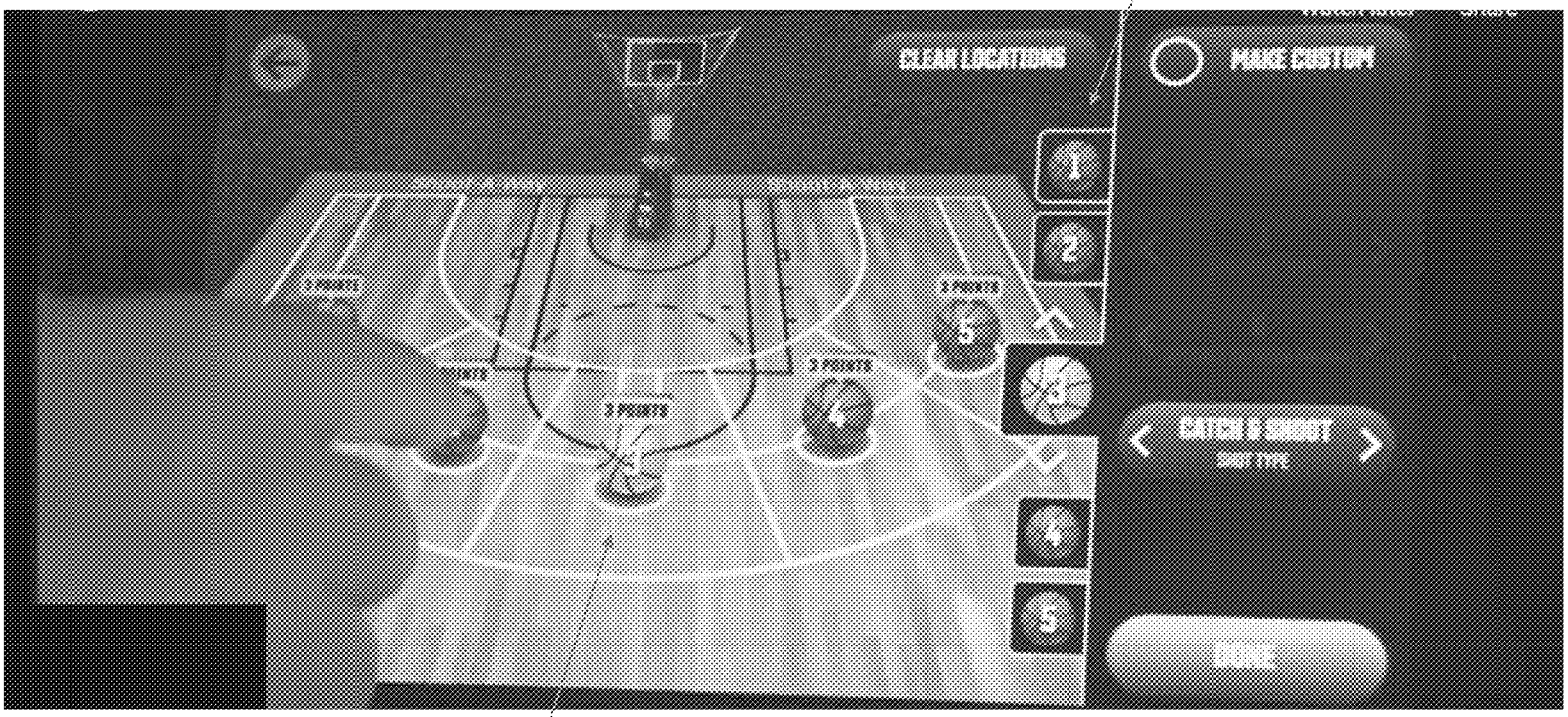
FIG. 30 is a front view of the exemplary user interface of FIG. 21 following exemplary user interaction.

FIG. 30 illustrates an exemplary highlighting of a selected one of the icons 258. In exemplary embodiments, the user interface 256 may be configured to highlight any of the icons 258 selected by user, such as by direct interaction (e.g., touch) or indirect selection. Any type or kind of highlighting, including color changes, symbol type or appearance changes, illumination, combinations thereof, or the like may be used.

Upon such selection of one of the icons 258, an order menu 259 may be provided at the user interface 256. The order menu 259 may be configured to permit the user to manually select the order of the selected ones of the pass receipt locations as represented by the selected ones of the icons 258. For example, without limitation, the order menu 259 may comprise the numbers 1-N, where N is the number of pass receipt locations selected as the user interface 256, such as represented by the number of the icons 258 displayed. The numbers may be vertically stacked, though such is not required.

Figure 31:
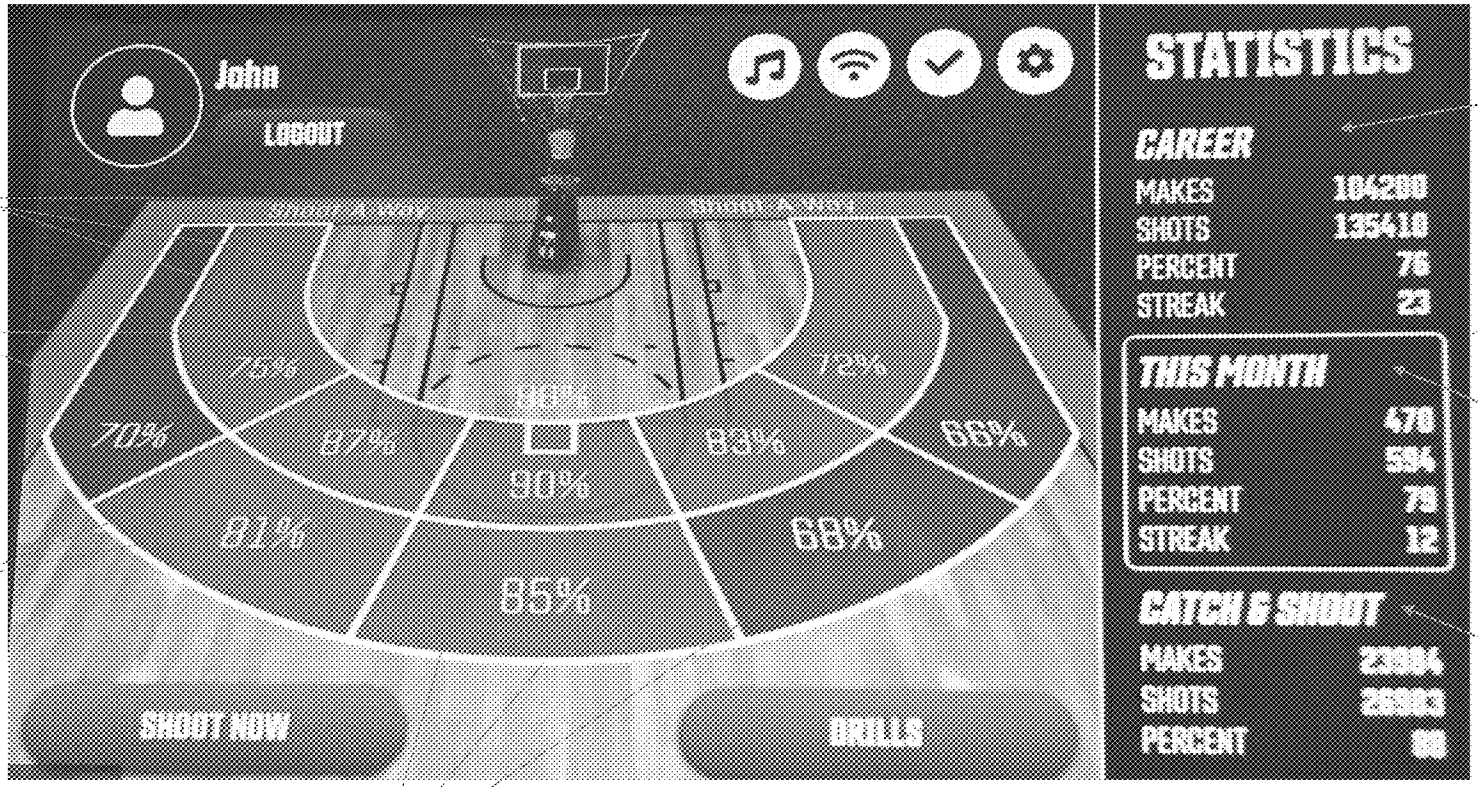
FIG. 31 is a front view of an exemplary performance report in accordance with the present invention.
Figure 32:
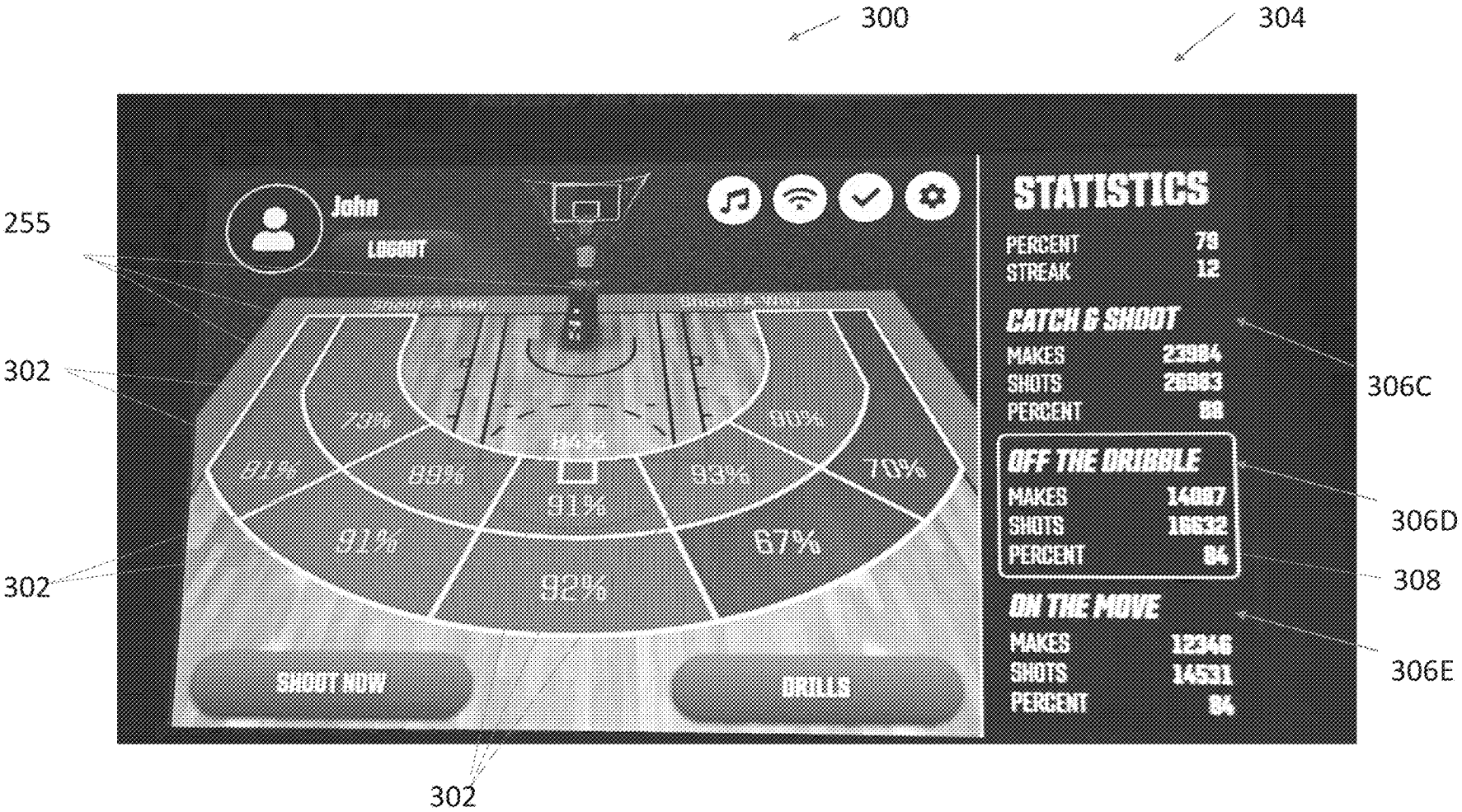
FIG. 32 is a front view of another exemplary embodiment of the performance report of FIG. 31.

FIG. 31 and FIG. 32 illustrate an exemplary performance report 300. The performance report 300 may be provided at the user interface 256, at other electronic devices (e.g., smartphone, tablet, laptop, or the like) in electronic communication with the basketball rebound machine 200, combinations thereof, or the like. Such electronic communication may be made by way of, for example without limitation, wireless or wired electronic communication, including but not limited to by way of the internet and one or more network communication devices. The report 300 may comprise the same or similar visual depiction 255 as provided for selecting the pass receipt locations and displaying the icons 258, though such is not required. The performance report 300 may be generated at the controller 154, the user interface 256, the other electronic devices, some combination thereof, or the like. The receiver of the report 300 may be the user who makes the selections at the user interface 256 or another party such as, a friend, parent, coach, assistant, player, or the like.

The report 300 may be generated based on data received from the user interface 256 regarding pass receipt locations selected, for example without limitation, and data received form the detector(s) 280 regarding shots made or missed, for example without limitation. The report 300 may comprise feedback 302 provided about the visual depiction 255 in approximate correspondence to the location where a basketball pass was sent and/or a basketball shot was taken.

The feedback 302 may comprise a number, percentage, combination thereof, or the like of made shots for each of the selection areas 257. For example, without limitation, all pass receipt locations (such as represented by the icons 258) selected within a given one of the selection areas 257 may be grouped into a common feedback 302 statistic, though such is not required. The feedback 302 may be color coded to indicate feedback above or below a predetermined threshold. For example, in the example provided in FIGS. 31-32, feedback above 70% is indicated with a red area while feedback at or below 70% is indicated in blue. Some of all of the feedback 302 may not be color coded.

A feedback category selectable area 304 may be provided as part of, or separate from, the performance report 300. A number of categories 306 for feedback 302 to be displayed at the feedback category selectable area 304 may be provided. The various categories 306 may be selected by a user, such as shown by selection indicator 308, and the corresponding category 306 of feedback 302 may be generated for display at the performance report 300. The selection indicator 308 may be, for example without limitation, a box around a selected category 306.

Such categories 306 may include, for example without limitation, career 306A (e.g., lifetime cumulative statistics for a given user), monthly 306B, catch and shoot 306C, off of the dribble 306D, on the move 306E, combinations thereof, or the like. In exemplary embodiments, the various categories 306 may be accessed by swiping, such as where the performance report 300 is provided on a touch screen, though other techniques may be utilized. In exemplary embodiments, the various categories 306 may be selected by touching, such as where the performance report 300 is provided on a touch screen, though other techniques may be utilized. In exemplary embodiments, off of the dribble shooting may be shooting attempts made following dribbling drills. On the move shooting may be shooting attempts made while the player is not stationary, but not necessarily following a dribble drill. The on the move shooting may include off the dribble shooting, or vice-versa, though such is not required.

Such off the dribble and/or on the move shooting may include, for example and without limitation, where the player takes a shot after performing a pre-shooting basketball move and/or performing such a pre-shooting basketball move immediately before receiving a pass and taking a shot. Such pre-shooting basketball moves may include any athletic, basketball related movements other than movements between the various pass receipt locations of the shooting drill. For example, without limitation, such pre-shooting basketball moves may include performing a simulated cut between pass receipt locations but exclude simply walking, jogging, running, or otherwise directly moving between the pass receipt locations.

Such off the dribble shooting may include, for example without limitation, types of basketball shots to be taken such as, but not limited to, layups (e.g., reverse layup, finger roll, tear drop, power layup, double clutch, combinations thereof, or the like), bank shot, putback and tip in, jump shots, slam dunks, fade away jumpers, combinations thereof, or the like. Such off of the dribble shooting may include, for example without limitation, other basketball actions taken pre- or post-receiving the pass, such as, but not limited to, movements (e.g., simulated or actual pick drill, roll, dodge, euro step, pro-hop, pro-hop euro step, power up, over-the head, combinations thereof, or the like) passing to another player or location (e.g., bounce pass, chest pass, over the head pass, touch pass, baseball pass, jump pass, blind pass, behind the back pass, combinations thereof, or the like), dribbling (e.g., cross over, between the legs dribble, behind the back dribble, wraparound, in and out dribble, v dribble, different heights dribble, ankle breaker dribble, hesitation move, combinations thereof, or the like), triple threat positions (e.g., pivot, jab step, pump fake, drawings contact, shuffle, combinations thereof, or the like), posting up (e.g., up and under, hook shot, drop step, power move, spin and dive, sikma move, dream shake, combinations thereof, of the like), two person games (e.g., give and go, dribble pitch or handoff, pick and roll, backdoor, alley-oop, combinations thereof, or the like), various combinations of the foregoing, or the like. Such off of the dribble shooting may include, for example without limitation, various drills incorporating one or more of the same. One or more of the foregoing examples may constitute a basketball move, for example without limitation. One or more of the foregoing examples, except for the types of basketball shots examples, may constitute a pre-shooting basketball move, for example without limitation. In exemplary embodiments, without limitation, such pre-shooting basketball moves comprise dribbling after receiving a pass from the launching device but before making a shooting attempt. Alternatively, or additionally, without limitation, such pre-shooting basketball moves comprise athletic movements of the user after making a shooting attempt at a first one of the pass receipt locations, but before making a shooting attempt at a second one of the pass receipt locations, that is not direct movement between the first and second one of the pass receipt locations and/or movement solely intended for transportation of the player between the first and second one of the pass receipt locations. Such pre-shooting basketball moves may be made immediately before and/or after receiving a pass at a pass receipt location.

In exemplary embodiments without limitation, such pre-shooting basketball moves may be those which are configured to simulate game conditions and may exclude exercise-related movements. For example, without limitation, the pre-shooting basketball move may be performed to simulate game conditions such as dribbling to get open, performing a juke, pick and roll, running off a pick, combinations thereof, or the like. As a further example, without limitation, such pre-shooting basketball moves may exclude purely exercise-related movements such as line drills, jogging laps, pushups, crunches, weight lifting, combinations thereof, or the like.

Such off the dribble shooting may be in contrast to stationary shots such as, but not limited to, free throws, planted feet shots, stationary catching and shooting attempts, combinations thereof, or the like. Such off of the dribble shooting may more realistically simulate game conditions, provide an increased workout, combinations thereof, or the like. However, particularly in an environment where shooting statistics are tracked and reported for the player or a third party to view, such as but not limited to, in a ranking across a team, group, multiple sessions, for a coach, parent, or other third party to view, the user may be reluctant to incorporate such off of the dribble shooting practice as their shooting performance statistics are likely to decrease due to the increased difficulty of such shooting attempts.

A prompt or option to designate one or more basketball passes received from the launcher 100 as being associated with an off the dribble and/or on the move shooting attempt may be provided at the interface 156. Such a prompt or option may be provided upon selection of an icon 285, selection of an area of the interface 156, or as a separate option or menu area of the interface 156. Designation of a pass and/or a pass receipt location as being associated with an off the dribble and/or on the move shooting attempt may be relayed to the controller 154 which may be configured to cause all made/missed data received from the detectors 280 to be recorded with an indication that such data is associated with off the dribble and/or on the move shooting attempts. This may permit the separate tracking and display of statistics related to such off the dribble and/or on the move shooting attempts.

In exemplary embodiments, off of the dribble shooting may be shooting attempts made following dribbling drills (e.g., catch the basketball, dribble it an amount, distance, time, combinations thereof, or the like, and then make a shooting attempt). On the move shooting may be shooting attempts made while the player is moving immediately before catching the basketball, and do not necessarily involve dribbling (e.g., running off a simulated or actual screen, pick and roll drill, cutting drill, combinations thereof, or the like). The on the move shooting may include off the dribble shooting, or vice-versa, though such is not required.

Cumulative feedback 302 for a given category 306 may be provided in association with each category 306. In exemplary embodiments, each category 306 may comprise at least a title, a cumulative number of made shots for the category, a cumulative number of shots taken for the category 306, and a percentage of made shots for the category 306. However, any number, type, kind, organization, and the like of such feedback 302 and such categories 306 may be utilized.

Figure 33:
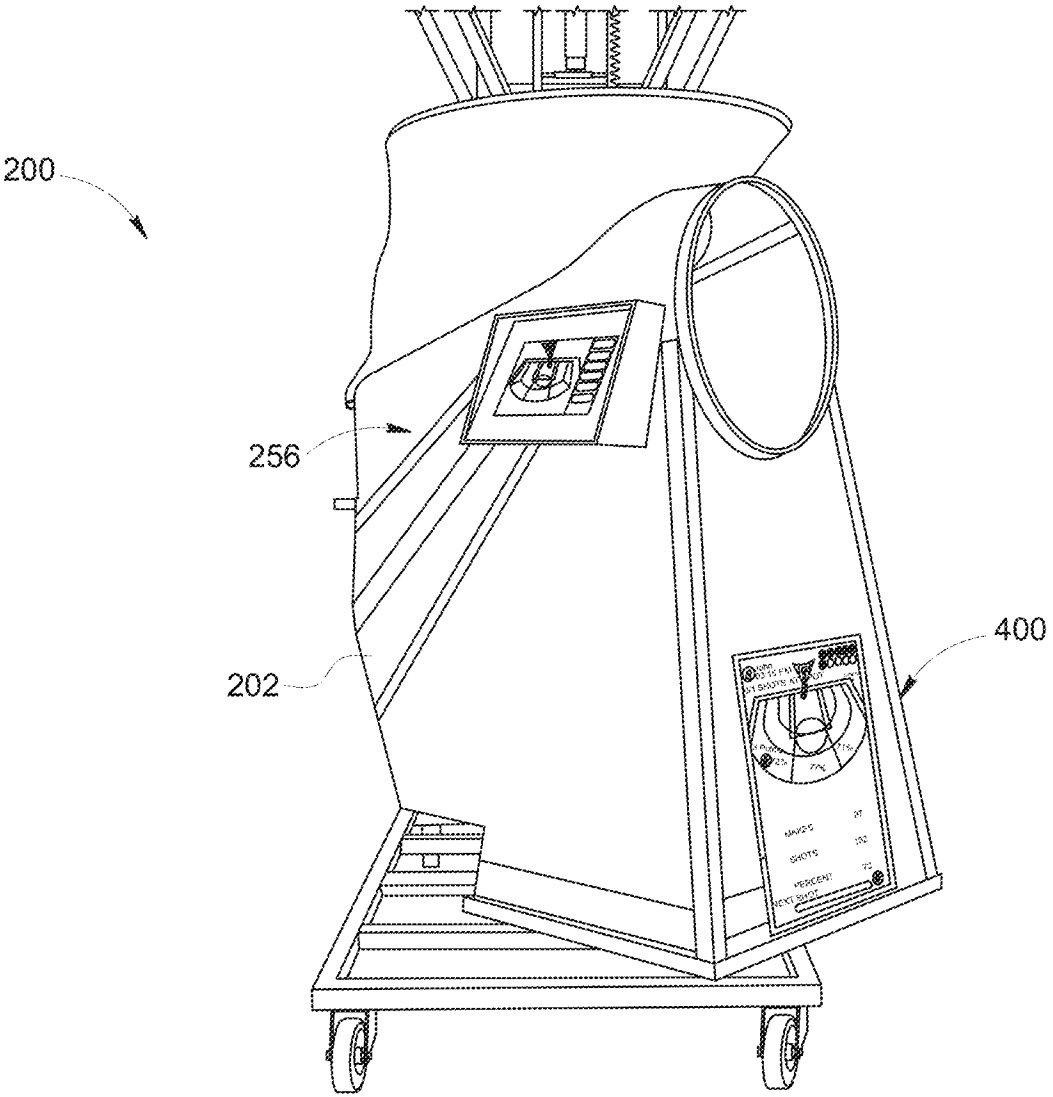
FIG. 33 is a detailed perspective view of an exemplary embodiment of the basketball rebound machine of FIG. 11.

FIG. 33 illustrates a detailed view of an exemplary embodiment of a portion of the rebound machine 200. The user interface 256 may be mounted to, fixed to, or otherwise associated with a first portion of the housing 202. A status display 400 may be mounted to, fixed to, or otherwise associated with a second portion of the housing 202. In exemplary embodiments, the user interface 256 is mounted to a side of the housing 202, while the status display 400 is mounted to a front portion of the housing 202, though the user interface 256 and/or the status display 400 may be located at any portion of the rebound machine 200. One or more apertures may be provided in the housing 202 for accepting basketballs from the collection net 206 and/or facilitating the passage of basketballs launched by the launching device 100. In other exemplary embodiments, the user interface 256 and/or the status display 400 may be mounted to the frame 204 and/or various members or structures extending therefrom. In yet other exemplary embodiments, the user interface 256 and/or the status display 400 may be remote from the rebound machine 200 and in wired or wireless communication with the rebound machine 200. For example, without limitation, the status display 400 may be provided as a scoreboard for a facility which displays certain shooting statistics for one or more such rebound machines 200 from one or more such facilities.

Figure 34:
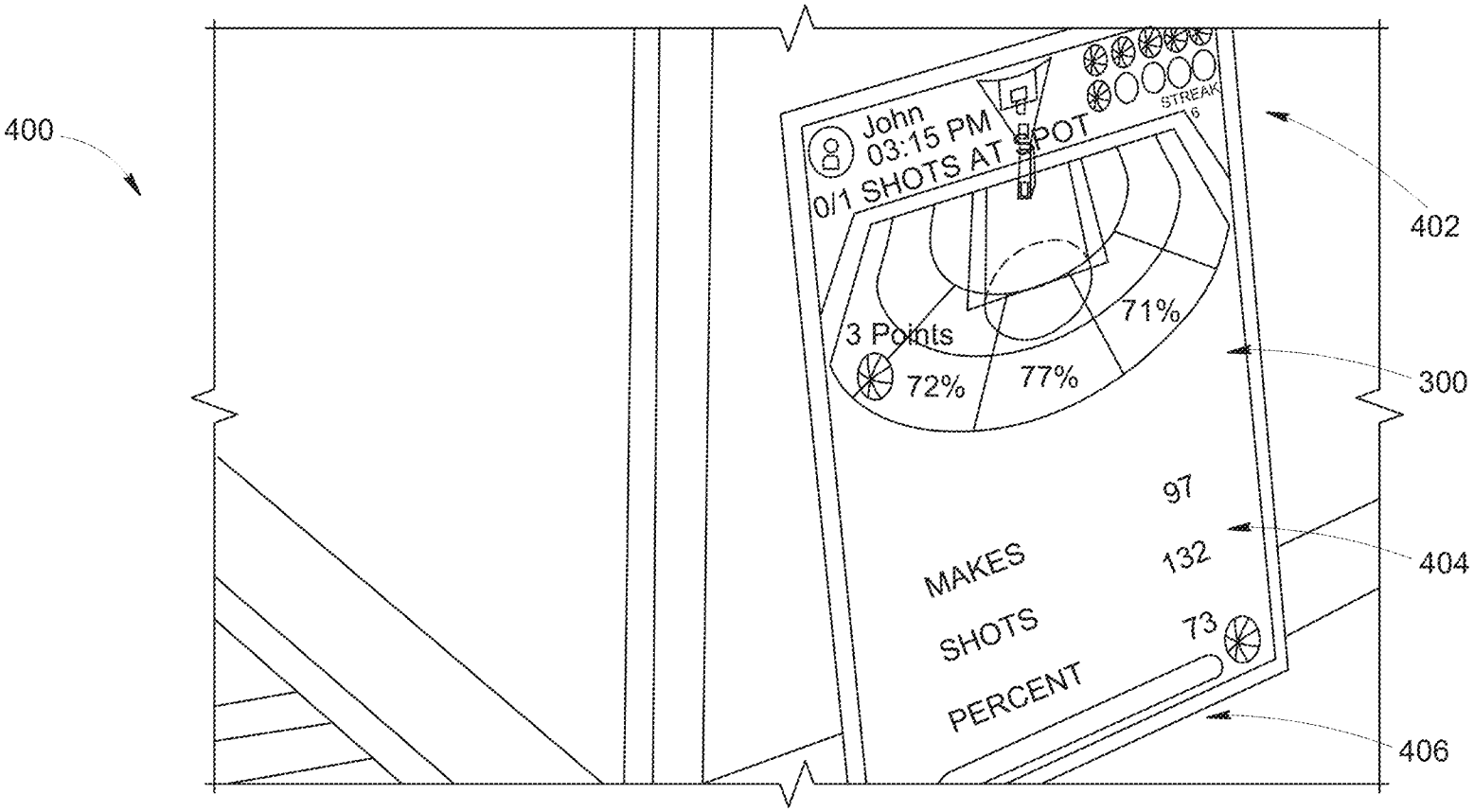
FIG. 34 is a detailed perspective view of a front display of the basketball rebound machine of FIG. 33.

FIG. 34 is a detailed view of the status display 400. The status display 400 may be in electronic communication with the controller 154, the user interface 256, the detector(s) 280, combinations thereof, or the like. The status display 400 may be configured to display one or more of: a streak display 402, the performance report 300 (including some or all of the various components thereof, such as but not limited to, the visual depictions 255, the feedback 302, the selection areas 257, combinations thereof, or the like), a cumulative statistics display 404, and a next pass status display 406. The status display 400 may, alternatively or additionally, comprise some or all elements of the user interface 256 display such as, but not limited to, the visual depictions 255, the icons 258, combinations thereof, or the like. The content displayed at the status display 400 may be controlled at the status display 400, the controller 154, combinations thereof, or the like.

In exemplary embodiments, the status display 400 may be provided, alternatively or additionally, elsewhere, such as but not limited to, at one or more remote electronic devices in electronic communication with the rebound machine 200.

The cumulative statistics display 404 may comprise a graphical representation of a number of made shots (e.g., as detected by the detectors 280), number of shots attempted (e.g., as determined by the number of passes launched by the launching device 100), and an overall percentage of made or missed shots for a given practice session (e.g., as determined by the controller 154 based on the aforementioned data points). In exemplary embodiments, the streak display 402 is provided along an upper edge of the status display 400, the performance report 300 is provided below the streak display 402, the cumulative statistics display 404 is provided below the performance report 300, and the next pass status display 406 is provided below the performance report 300, though any arrangement of the status display 400 and items displayed thereon may be utilized.

Figure 35:
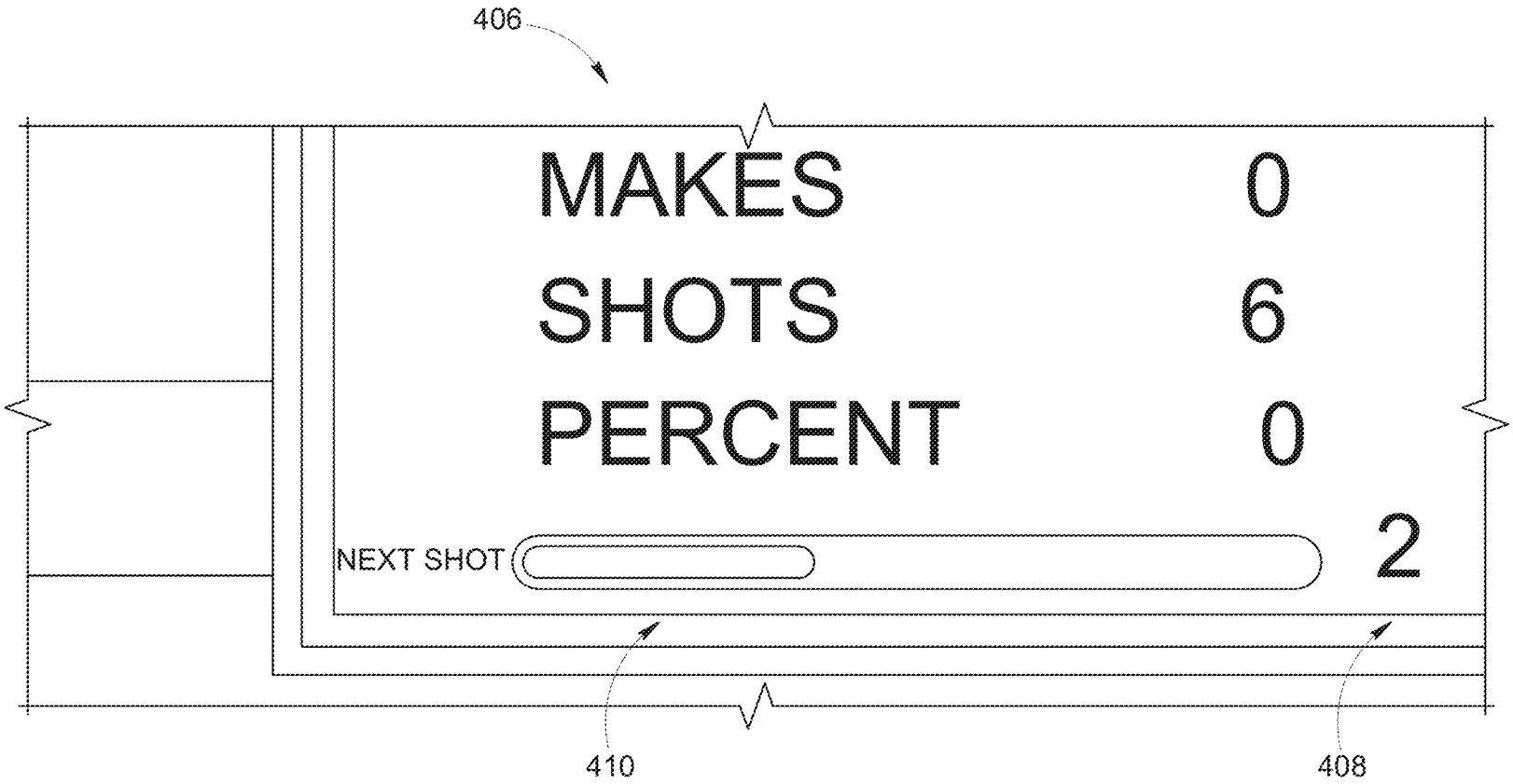
FIG. 35 is a detailed front view of a portion of the front display of FIG. 34.
Figure 36:
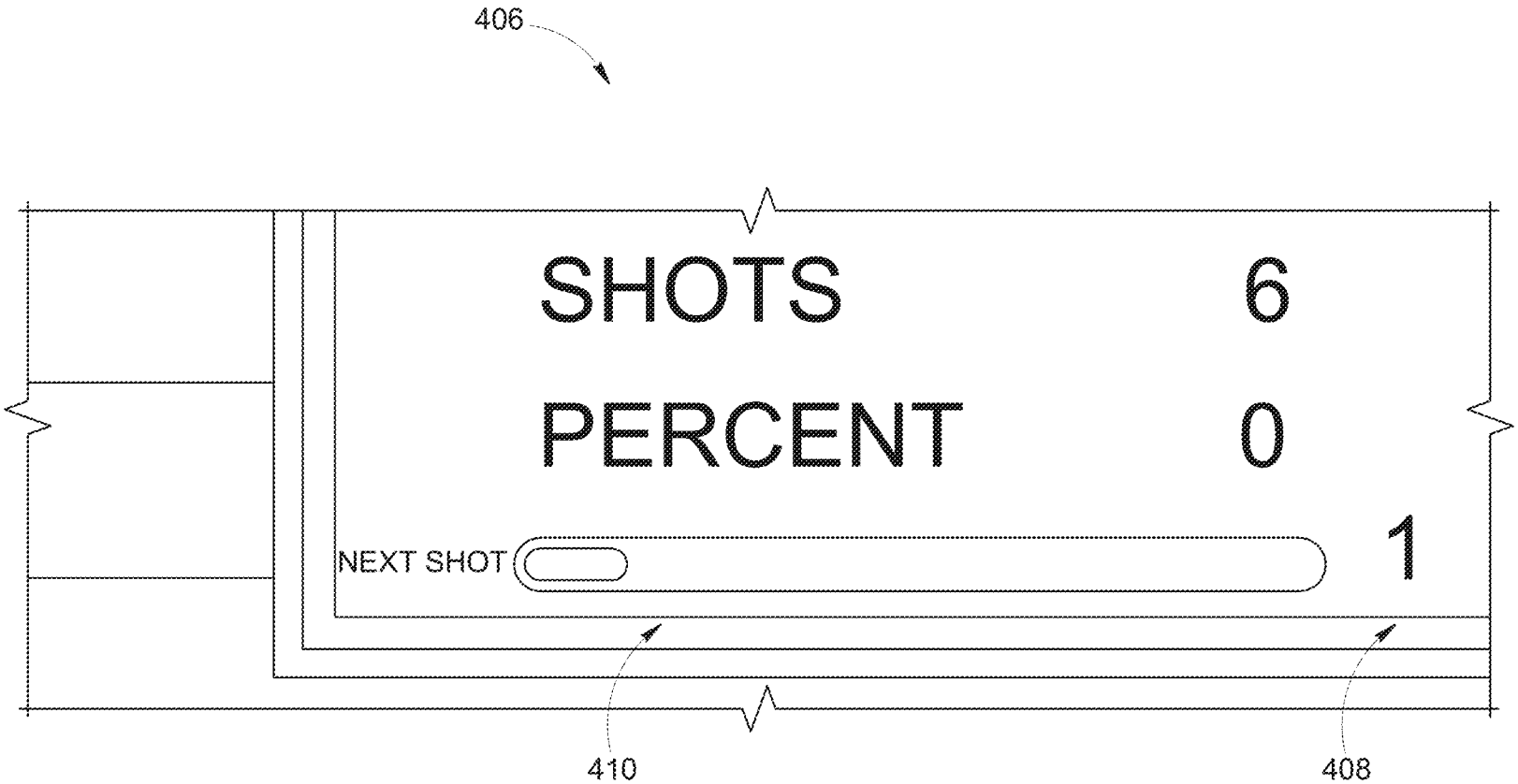
FIG. 36 is another exemplary embodiment of the portion of the front display of FIG. 34.
Figure 37:
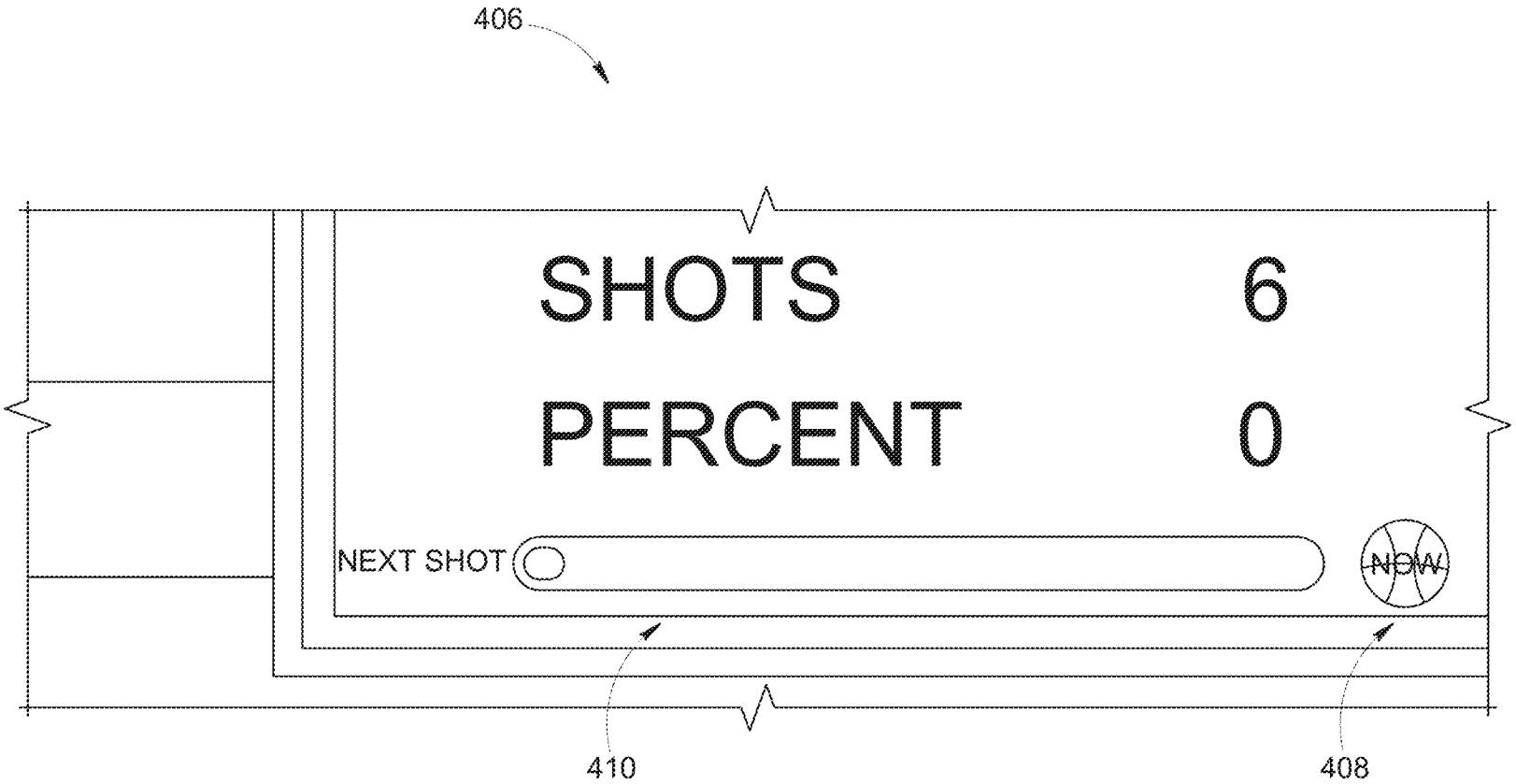
FIG. 37 is another exemplary embodiment of the portion of the front display of FIG. 34.

FIG. 35 through FIG. 37 illustrates an exemplary sequence of displays for the next pass status display 406. In exemplary embodiments, the next pass status display 406 may be provided along a bottom edge of the status display 400, though it may be provided elsewhere. The next pass status display 406 may comprise a timing display 408. The timing display 408 may comprise a numerical display of a number of seconds left until a next basketball is expected to be launched from the launching device 100.

The next pass status display 406 may comprise a graphical representation 410 of the number of seconds left until a next basketball is expected to be launched from the launching device 100. In exemplary embodiments, the graphical display 410 comprises a slider bar which decreases in length as the time for the next basketball to be launched nears. However, any type or kind of graphical display 410 may be utilized.

In exemplary embodiments, upon the timing display 408 reaching zero and/or the graphical display 410 reaching the anticipated next pass, the timing display 408 may display a graphic indicating the next pass is expected.

Figure 38:
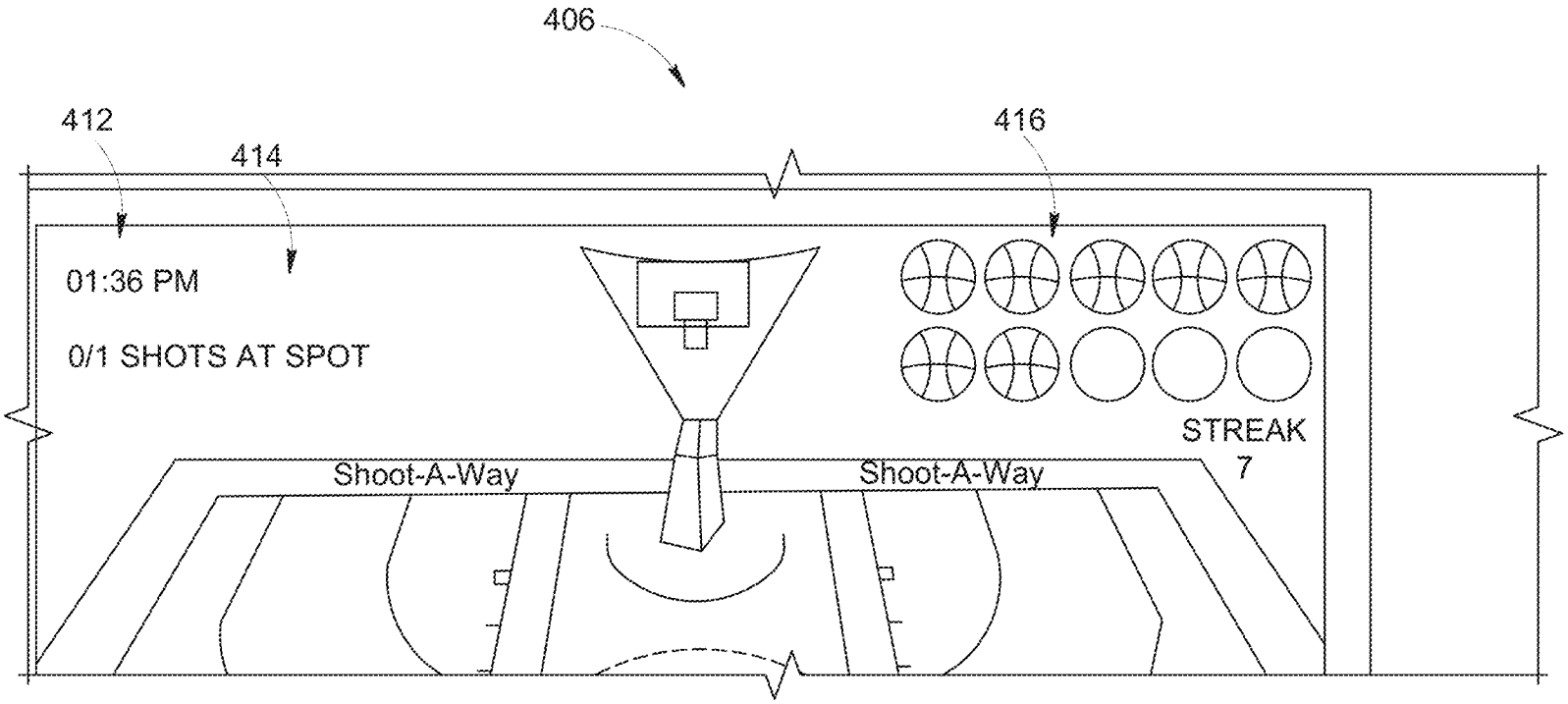
FIG. 38 is a detailed front view of another portion of the front display of FIG. 34.

FIG. 38 is a detailed exemplary streak display 402. In exemplary embodiments, the streak display 406 may comprise one or more of: a time display 412, a number of shots made/missed at a given pass receipt location display 414, and a number of shots made in a row display 416. The time display 412 may comprise the current time, which may be determined at the controller 154, which may comprise one or more timing devices. The number of shots made in a row display 416 may comprise a numerical representation of the player's current streak and/or a graphical representation. The graphical representation may comprise a number of basketball icons representing each of the made shots in a row, though any icon, symbol, or the like may be used.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, and the like configured to perform the operations described herein. The electronic devices may be general purpose computers or specialized computing devices. The electronic devices may be personal computers, smartphones, tablets, databases, servers, or the like. The electronic connections and transmissions described herein may be accomplished by wired or wireless means. The computerized hardware, software, components, systems, steps, methods, and/or processes described herein may serve to improve the speed of the computerized hardware, software, systems, steps, methods, and/or processes described herein.

What is claimed is:

1. A throwing mechanism for basketballs, said throwing mechanism comprising:

an axle;

a catapult arm connected to said axle at a mid-portion of said catapult arm such that a first portion of said catapult arm extends rearward of said axle and a second portion of said catapult arm extends forward of said axle when said catapult arm is in a second position;

a basketball holder located at said first portion of said catapult arm and configured to hold a basketball for launching a mounting structure located below at least the axle, catapult arm, and motor;

a spring having a first end attached to said second portion of said catapult arm and a second end that is fixed to the mounting structure;

an engagement arm located rearward of, and spaced apart from, said axle, said engagement arm comprising an opening configured to accommodate part of said first portion of said catapult arm so as to selectively engage said catapult arm thereby secure said catapult arm in said second position and selectively release said catapult arm for travel into a first position;

a motor;

linkage members which are interconnected for relative rotational movement, where a first one of said linkage members is connected to said motor and a second one of said linkage members is connected to said axle and a third one of said linkage members connects the first one of said linkage members and the second one of said linkage members; and a ram mounted to the second one of said linkage members such that a longitudinal axis of said ram extends transverse to a longitudinal axis of the second one of said linkage members, wherein said ram is otherwise suspended for swinging movement below said axle; and wherein said linkage members, said motor, and said ram are arranged such that each cycle of said motor in a given direction is configured to, by way of said linkage members, cause said ram to: swing in a forward direction to contact said second portion of said catapult arm and force said catapult arm to rotate with said axle into the second position where said part of said first portion of said catapult arm is secured within said opening of said engagement arm thereby securing said catapult arm in said second position, and subsequently swing in a rearward direction to disengage said catapult arm and instead contact and move said engagement arm to release said catapult arm from said opening such that said catapult arm rotates with said axle into said first position by way of forces exerted by said spring to launch said basketball located at said basketball holder.

2. The throwing mechanism of claim 1 further comprising:

supports, wherein said supports extend primarily in a vertical direction upward from said mounting structure, and wherein said axle extends between said supports.

3. The throwing mechanism of claim 2 wherein:

said linkage members comprise at least three straight-line members; and the second one of the linkage members is attached to said axle in a rotatable fashion.

4. The throwing mechanism of claim 2 further comprising:

stoppers located at said supports; and a stop bar provided at said second portion of said catapult arm configured to frictionally engage said stoppers as said catapult arm rotates to arrest movement of said catapult arm.

5. The throwing mechanism of claim 1 further comprising:

a ramped surface provided along at least a portion of said forward portion of said engagement arm; and a wheel located at a first end of said ram and configured to travel along said ramped surface to force at least an upper portion of said engagement arm having the opening to move away from said axle as said ram is advanced to release said catapult arm from said opening.

6. The throwing mechanism of claim 1 further comprising:

a controller configured to provide electronic commands to said motor based, at least in part, on user input received from an interface.

7. The throwing mechanism of claim 6 further comprising:

one or more sensors positioned and configured to detect a presence or non-presence of a portion of said catapult arm or said basketball holder when said catapult arm is located in said second position, wherein said controller is configured to receive data from said one or more sensors indicating said presence or non-presence of said portion of said catapult arm for counting a number of launched basketballs.

8. The throwing mechanism of claim 6 further comprising:

wherein said mounting structure comprises a base platform for at least said motor; and further comprising a tension adjustment member pivotably mounted to said base platform, wherein said spring is attached to said tension adjustment member; and an actuator connected to said tension adjustment member and configured to pivot said tension adjustment member to adjust tensioning forces in said spring based, at least in part, upon commands received from said controller.

9. The throwing mechanism of claim 8 wherein:

said actuator extends in a primarily vertical direction and such that retraction of said actuator is configured to pivot a distal end of said tensioning member upward to decrease tension forces in said spring and extension of said actuator is configured to pivot said distal end of said tensioning member downward to increase tensioning forces in said spring.

10. The throwing mechanism of claim 8 wherein:

said actuator extends in a primarily horizontal direction and is connected to said tension adjustment member by way of one or more flexible members which engage one or more pulleys such that retraction of said actuator is configured to pivot a distal end of said tensioning member downward to increase tension forces in said spring and extension of said actuator is configured to pivot said distal end of said tensioning member upward to decrease tensioning forces in said spring.

11. The throwing mechanism of claim 1 further comprising:

a tension adjustment member, wherein said spring is slidably attached to said tension adjustment member for manual repositioning at any of a number of discrete, spaced positions along said tension adjustment member to adjust tension in said spring.

12. The throwing mechanism of claim 1 further comprising:

a tension adjustment member configured for pivoting movement; and a post extending in a primarily vertical direction and comprising a number of protrusions spaced apart along at least a portion of said post, wherein said tension adjustment member is configured to be selectively secured between any of said number of protrusions to adjust tensioning forces in said spring.

13. A basketball rebound device comprising:

a frame;

a collection net supported by at least a portion of said frame for collecting basketballs thrown towards a basketball goal by a player;

a user interface configured to receive user input for creating a custom basketball practice session;

at least one display device configured to display feedback for said custom basketball practice session;

a launching device configured for launching said basketballs to a number of spaced apart pass receipt locations for said player to catch and throw towards said basketball goal, said launching device comprising:

supports extending in a primarily vertical direction;

an axle connected to, and extending between, said supports, where a centerline of said axle extends in a primarily horizontal direction;

a catapult arm mounted to said axle for rotational movement therewith, where a longitudinal axis of said catapult arm extends transverse to the centerline of said axle;

a basketball holder located at a first portion of said catapult arm for holding said basketballs, one at a time, for launching, wherein said first portion of said catapult arm extends rearward of said axle when the catapult arm is in a first position where the longitudinal axis of the catapult arm extends primarily in a horizontal direction;

a spring having a first end attached to a second portion of said catapult arm, wherein said second portion of said catapult arm extends forward of said axle when the catapult arm is in the first position, and wherein a second end of said spring is fixed to a mounting structure at a location below and rearward of the axle such that tension forces in said spring are increased as said catapult arm rotates in a first direction with said axle and said tension forces in said spring bias said catapult arm for rotation in a second direction with said axle, where said first direction is clockwise about the centerline of said axle, and where said second direction is counterclockwise about the centerline of said axle;

an engagement arm located rearward of, and spaced apart from, said catapult arm and comprising an opening for selectively engaging and releasing an end of the first portion of said catapult arm;

a motor;

linkages connecting said motor to said axle, said linkages comprising a crank arm connected to the motor, an intermediary arm connected to the crank arm, and a third arm connected to the intermediary arm and the axle, wherein each of said crank arm, said intermediary arm, and said third arm are configured for relative rotational movement;

a controller in electronic communication with said user interface and said motor and configured to selectively command said motor to operate based, at least in part, upon said user input received at said user interface; and a ram mounted to of said third arm such that a longitudinal axis of said ram extends transverse to a longitudinal axis of the third arm and said ram is otherwise suspended below said axle;

wherein continuous operation of said motor in a given direction is configured to, with each cycle of the motor and by way of the linkages, cause said ram to: swing forward along an arcuate pathway extending below said axle to push said second portion of said catapult arm, thereby pivoting said catapult arm with said axle in said first direction into the first position where said first portion of said catapult arm is secured by said engagement arm, and subsequently move rearward along the arcuate pathway to instead push said engagement arm away from said axle to release said catapult arm from said opening for pivoting movement with said axle from the first position in said second direction by said tension forces exerted by said spring until said catapult arm reaches a second position where the catapult arm is oriented primarily in a vertical direction.

14. The basketball rebound device of claim 13 further comprising:

an actuator in electronic communication with said controller and mechanically linked, directly or indirectly, to said spring to adjust tensioning forces provided by said spring based, at least in part, upon said user input received at said user interface.

15. The basketball rebound device of claim 13 further comprising:

stoppers located at the first and second supports; and a stop bar connected to the second portion of said catapult arm and having a longitudinal axis extending transverse to a longitudinal axis of said catapult arm so as to frictionally engage said stoppers upon pivoting movement of said catapult arm in said second direction to arrest movement of said catapult arm in sais first position.

16. A throwing mechanism for basketballs, said throwing mechanism comprising:

a catapult arm connected to an axle and comprising a basketball holder at a first portion of the catapult arm extending rearward of the axle;

a spring attached to a second portion of said catapult arm extending forward of the axle at one end and fixed to a mounting structure for the throwing mechanism at another end such that clockwise rotation of the catapult arm with the axle loads the spring and said spring is biased towards causing counterclockwise rotation of the catapult arm;

an engagement arm located rearward of, spaced apart from, and said axle, said engagement arm comprising an opening sized to accommodate part of said first portion of said catapult arm;

linkages, interconnected to one another such that a first one of the linkages is connected to a motor, a third one of the linkages is connected to the axle, and at least one intermediary linkage connects the first one of the linkages to the third one of the linkages;

a ram mounted to the third one of the linkages such that said ram is otherwise suspended below the axle and a longitudinal axis of the ram extends cross-wise to a longitudinal axis of said third one of the linkages;

wherein each cycle of said motor in a given direction is configured to cause, by way of said linkages, said ram to: swing in a first direction to contact and push said second portion of said catapult arm to cause clockwise rotation of the catapult arm at least until the part of said first portion of said catapult arm is secured within said opening, thereby securing said catapult arm in a second position, and swing a second, opposing direction to instead contact and push said engagement arm at least until said part of said first portion of said catapult arm is released from said opening, thereby allowing said catapult arm to rotate counterclockwise into a first position by way of forces exerted by said spring to launch a basketball located at said basketball holder.

* * * * *